US006547460B2

(12) United States Patent
Nozawa et al.

(10) Patent No.: US 6,547,460 B2
(45) Date of Patent: Apr. 15, 2003

(54) PHOTOSENSITIVE MATERIAL PROCESSING DEVICE

(75) Inventors: Ryoei Nozawa, Minami-Ashigara (JP); Toshihiro Suya, Minami-Ashigara (JP); Hideto Yamamoto, Minami-Ashigara (JP); Takayuki Iwamoto, Minami-Ashigara (JP); Shinichi Matsuda, Minami-Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/177,151

(22) Filed: Jun. 24, 2002

(65) Prior Publication Data

US 2002/0191977 A1 Dec. 19, 2002

Related U.S. Application Data

(62) Division of application No. 09/708,726, filed on Nov. 9, 2000, now Pat. No. 6,435,740.

(30) Foreign Application Priority Data

| | | |
|---|---|---|
| Nov. 9, 1999 | (JP) | 11-317771 |
| Mar. 23, 2000 | (JP) | 2000-081480 |
| Mar. 24, 2000 | (JP) | 2000-084970 |
| Mar. 28, 2000 | (JP) | 2000-089850 |
| Mar. 29, 2000 | (JP) | 2000-092060 |
| Mar. 29, 2000 | (JP) | 2000-092062 |
| Mar. 29, 2000 | (JP) | 2000-092063 |

(51) Int. Cl.[7] ..... G03D 3/08

(52) U.S. Cl. ..... 396/612; 396/617; 396/620

(58) Field of Search ..... 396/599, 604, 396/612–626, 636; 355/27–29; 134/64 P, 64 R, 122 P, 122 R

(56) References Cited

U.S. PATENT DOCUMENTS

| | | | | |
|---|---|---|---|---|
| 4,837,131 A | | 6/1989 | Kobayashi et al. | |
| 5,168,296 A | * | 12/1992 | Nakamura et al. | 396/620 |
| 5,687,418 A | * | 11/1997 | Earle et al. | 396/612 |

FOREIGN PATENT DOCUMENTS

| | | |
|---|---|---|
| JP | 11-095446 | 4/1999 |

* cited by examiner

*Primary Examiner*—D. Rutledge
(74) *Attorney, Agent, or Firm*—Sughrue Mion, PLLC

(57) ABSTRACT

In a shutter facing an aperture portion in a partition plate in a photosensitive material processing device, a blocking member, formed substantially in a semicircular cylindrical shape, is placed by the rotation of a shaft between blades thereby closing the aperture portion. The opening between the blades is opened by rotating the blocking member integrally with the shaft so that a photosensitive material can pass through. Multi-leveled surfaces are formed on the top surface of a guide plate. Aperture portions for mounting rollers with adaptors are formed in an alternating pattern on the surfaces. A plurality of protruding guide ribs are provided extending across the surfaces. A plurality of brush roller parameters are adjusted so that a winding mark index defined by the parameters falls within a predetermined range. Rollers are washed when a finisher control system is restarted after an unforeseen long stoppage.

6 Claims, 31 Drawing Sheets

PHOTOSENSITIVE MATERIAL PROCESSING DEVICE

This is a divisional of application Ser. No. 09/708,726 filed Nov. 9, 2000, now U.S. Pat. No. 6,435,740, the disclosure of which is incorporated herein by reference.

BACKGROUND OF THE INVENTION

1. Field of the Invention

The present invention relates to a photosensitive material processing device in which a photosensitive material that has been inserted via an insertion aperture is processed using processing solutions stored in processing tanks, and is then discharged via a discharge aperture and stacked.

More particularly, the present invention relates to a guide structure for a photosensitive material processing device for guiding a photosensitive material in a predetermined transporting direction in the processing tanks while supporting the photosensitive material in the processing device.

Moreover, the present invention relates to a photosensitive material processing device for processing a photosensitive material by brushing the surface of the photosensitive material using brush rollers.

Moreover, the present invention relates to a finishing solution control system used in the processing device in a finishing processing section for performing a desensitizing processing on the surface of the photosensitive material using finishing solution.

Moreover, the present invention relates to a water storage tank for storing water used to wash the photosensitive material and to dilute processing solution in the processing device.

The present invention also relates to a stacking device provided in the processing device for stacking photosensitive material ejected from the ejection aperture of the processing section after passing through the processing section of the processing device.

2. Description of the Related Art

In a photosensitive material processing device, processing such as developing and the like using a plurality of processing solutions is performed on a photosensitive material that has undergone image exposure as the photosensitive material is being transported, by immersing the photosensitive material in processing solutions, spraying processing solutions on the surface of the photosensitive material, and the like.

For example, in a photosensitive material processing device for processing photosensitive planographic printing plates (referred to below as "printing plates") as a photosensitive material, there are provided a plurality of processing steps that use processing solutions, such as: a developing step for developing the printing plate by immersing it in a developing solution; a washing step for washing the surface of the printing plate using washing water; and a desensitizing step for performing a desensitizing processing by coating the surface of the printing plate with finisher solution after it has finished the washing process in order to protect it. A printing plate that has previously undergone image exposure is thus subjected to developing, washing, and desensitizing processing in a processing device such as this.

However, the developing solutions used in processing a printing plate deteriorate as they come into contact with carbon dioxide in the atmosphere and the processing performance thereof is reduced. Moreover, the processing performance changes as the water content in the developing solutions evaporates. Furthermore, the finisher solution coated on the printing plate adheres to the rollers and is made to stick to the rollers if heated air from the drying step provided adjacent to the finisher step leaks into the finisher step. Pairs of transport rollers in the finisher step prior to the drying step end up sticking together, and the surface of the printing plate is damaged as the printing plate comes into contact with the rollers to which the finisher solution has stuck.

Therefore, in the processing device, the insertion apertures and discharge apertures through which the printing plate passes are closed off using a blade or slide type of shutter mechanism. Consequently, outside air can be prevented from coming in via the insertion aperture and discharge aperture when no printing plate is passing through. As a result, deterioration in the developing solutions, evaporation of the water content in the developing solutions, and the hardening of processing solutions such as the finisher solution adhered to the rollers can be prevented.

However, if the insertion apertures and discharge apertures are closed off using a blade and a printing plate is transported while in contact with this blade, then if the blade makes contact with the surface of the printing plate while processing solution is adhering to the printing plate, contact marks from the blade are left on the surface of the printing plate and the like, thereby affecting the product quality of the printing plate.

Moreover, if the insertion apertures and discharge apertures are opened and closed off using a slide type of shutter, space for the movement of the slide type shutter needs to be secured near the insertion apertures and discharge apertures. The securing of this space has sometimes been difficult, as printing plate processors have become more and more compact. In addition, in a slide type of shutter, if processing solution becomes adhered and fixed thereto, operating failures can occur and accurate opening and closing can be difficult. Consequently, the first problem evident in existing photosensitive material processing devices is the opening and closing of the portion used as a passage by the printing plate.

Here, examples of printing plates include, in addition to a commonly structured printing plate (presensitized or PS plate) comprising a photosensitive composition coated in a thin layer on an aluminum substrate, a photopolymer plate comprising a photo adhesion layer, a photo polymerization layer, and an overcoat layer superposed on a substrate, and a thermal plate comprising on a substrate a subbing layer and a photosensitive layer in which the photo energy of laser light is converted into thermal energy and which is either hardened (negative type) or made soluble (positive type) depending on the developing solution.

Printing plates on which images have been recorded undergo developing processing using a photosensitive material processing device and are used as printing plates for printing. Guide devices are provided inside the developing tanks of the processing device and printed plates are transported while being guided by the guide devices.

Some processing devices use only plate shaped guide devices depending on the printing plate being processed, while other processing devices transport the printing plates by guiding them via contact with a plurality of transporting rollers provided in the guide devices. When processing is performed using photopolymer plates, the unnecessary photosensitive layer is removed by rubbing the surface of the plate with brush rollers. At this time, transporting rollers may be provided at positions facing the brush rollers in the guide. Moreover, the printing plates come in various sizes and it is necessary to use a guide device having width dimensions that correspond to a size within the range that can be processed by the processing device.

Accordingly, the second problem in existing processing devices is the difficulty in lowering the cost brought about when guide devices that match the various sizes and types of printing plates being processed need to be used even if the guide devices used have a common configuration.

Next, in an automatic developing device, which is a photosensitive material processing device for performing developing processing on an image exposed photopolymer plate, an image is formed by immersing the photopolymer plate in developing solution, thereby swelling the unnecessary photosensitive layer (the photopolymer layer) in accordance with the exposure image, and then removing the unnecessary layer from the substrate. Moreover, in an automatic developing device, by brushing the surface of the printing plate that has been immersed in the developing solution using a brush roller, the removal of the unnecessary photosensitive layer from the substrate can be accelerated.

The brush rollers used when processing printing plates such as a photopolymer plate and the like are formed by attaching channel brushes around the roller body, or by using Morton rollers. However, brush rollers that use channel brushes have excellent durability, but tend to rub the printing plate unevenly. Morton brushes show superior performance as regards rubbing unevenness over brush rollers using channel brushes, however, their durability is poor. The rubbing unevenness of brush rollers has a great effect on the product quality of photopolymer plates. Namely, because photopolymer plates need to be brushed more vigorously than other type of printing plates, the brushing unevenness tends to stand out.

Namely, brush rollers that use channel brushes have difficulties in the placement of the brush hair material at a uniform density and at a uniform angle. Moreover, gaps appear between channels that become the base portion when the channel member is wound around the roller body. In order to fill in this gap between channels, it is necessary to lengthen the hair ends of the brush hair material, however, if the hair ends are lengthened, the stiffness of the hair material is weakened and vigorous brushing becomes difficult. Moreover, if the diameter of the hair material is increased in order to increase the stiffness thereof, then marks from the rubbing are made on the photopolymer plate.

Furthermore, when pressure is applied to portions of the surface of a Morton roller when the roller is used for vigorous brushing, the surface of the roller is deformed and rubbing unevenness is generated.

In contrast to the above rollers, in some cases a brush roller, in which a belt shaped member formed by weaving a brush hair material into a belt shaped fabric is wound around a roller body in a spiral shape, is used.

However, in a brush roller formed by winding a belt shaped material in a spiral configuration, although it is possible to make the gaps between the belt shaped material wound around the roller body extremely narrow, the gaps still remain to some extent. Therefore, unevenness in the rubbing on the surface of the printing plate caused by these gaps stands out as winding marks even when the brush roller uses a belt shaped member. This is the third problem of existing photosensitive material processing devices.

In a photosensitive material processing device, in order to transport the photosensitive material to the drying section after the desensitizing processing, a structure is employed in which the photosensitive material is nipped by a pair of transporting roller and this pair of transporting rollers is driven to rotate so that the photosensitive material is fed to the drying section.

Here, a transport system using the above pair of transporting rollers is formed in a processing device for a PS plate type of photosensitive material.

In a processing device for PS plates, the hardening of the finishing solution on the rollers is prevented by using a mechanical roller lift up mechanism. Because this roller lift up mechanism involves mostly manual operations by the user, the user may absentmindedly forget or intentionally omit the operation due to the complexity thereof.

In contrast, if the roller lift up mechanism is operated, and then the work restarted when the user has forgotten to restore the roller lift up mechanism, problems are caused such as the finisher solution pouring into the adjacent drying section.

Moreover, the finisher solution tends to become concentrated due to natural evaporation and the heat from the adjacent drying section, requiring the concentration of the finisher solution to be adjusted by supplying water manually.

In order to adjust the concentration of the finisher solution, dilution water is supplied by being dripped onto a roller thereby preventing the finisher solution from hardening on the surface of the roller.

This dripping of the dilution water onto a transporting roller pair is performed at the end of the work and by leaving the rollers for a lengthy period after they have been washed, when the next work is started, it is possible to prevent finisher solution from hardening on the roller surface and rollers getting stuck together, and to prevent finisher solution from adhering as precipitate on the roller surface and being transferred to the printing plate.

However, if a large amount of dilution water is used to wash the rollers, the finisher solution ends up becoming diluted. Therefore, it is necessary to limit the amount of dilution water that can be used by calculating the amount of evaporation for one day. However, the fourth problem of existing processing devices is that, if the washing device for washing the rollers by dripping dilution water onto them is operated while the device is temporarily halted (for example, during a lunch break or the like), the amount of dilution water that can be used when the device is finally shut down is reduced and the rollers cannot be properly washed.

Next, in the photosensitive material processing device, replenishment of the processing solutions is performed by supplying replenishing stock solutions of the developing solution and the finisher solution, as well as water for diluting the replenishing stock solutions, to the developing tank and the finisher tank.

A water supply tank for storing water is provided in the processing device and water used for washing and for diluting the replenishing stock solutions is stored in the water supply tank. If necessary, water can be fed out from the water supply tank using a pump or the like.

If water is left in the washing tank and water supply tank, mold forms. Therefore, the forming of mold is prevented by regularly adding a small amount of anti-mold agent (referred to below as "chemical agents") to the washing tank and water supply tank. For example, 30 milliliters of chemical agents are added for 10 liters of water.

Generally, the method of adding chemical agents involves the addition thereof by hand at regular intervals. In this type of addition method, the addition can be easily forgotten and this causes mold to end up being formed because the concentration of the chemical agents is reduced.

In order to prevent the addition of the chemical agents from being forgotten and to do away with the burden of the addition task, a method is sometimes employed in which chemical agents are pumped using a pump or the like from a chemical tank in which they are contained by timer control and then supplied to the washing tank or water supply tank.

However, because new water is fed to the washing tank and water supply tank in accordance with the printing plate processing amount, if chemical agents are added by timer control, it is possible that the amount added will either be excessive or insufficient. This is the fifth problem in existing processing devices.

Moreover, because of the high viscosity of the chemical agents they have difficulty in dispersing. Furthermore, when they are being dissolved in water, because the chemical agents gradually dissolve from their outer periphery, a lengthy amount of time is required until they are blended into the water. Therefore, when chemical agents have been added to the water supply tank, it is necessary to stir the water in the water supply tank manually, or to stir the water in the water supply tank by providing stirring means such as a circulation pump or stirring fins. Because of this, the workload when using the processing device is increased and the cost of the device tends to increase. As a result, the sixth problem of existing processing devices is being able to accelerate the blending of the chemical agents in a simpler structure.

Subsequently, after printing plates formed from a photosensitive material have undergone processing the respective types of processing device, they are usually stacked in a stacking device (stacker) provided at the ejection side of the processing device.

When seen from the side, this stacker is formed substantially in a V shape comprising a first slope and a second slope. The stacker is structured so as to allow printing plates fed out from, for example, the processing section or drying section of the processing device to slip down the first slope and then be caught at the bottom end of this slope. Printing plates that have been caught at the bottom end of the first slope and are standing at an angle against the inclined first slope are then transferred over to the second inclined slope (the stacking tray). This transferal may be performed by rotation around the bottom end of the first slope thereby changing the inclination of the printing plates so that they incline in the direction of the stacking tray, or by providing a plate that presses the printing plates away from the slope.

There are various sizes of printing plate (for example, from size A3 to size A0 in the representative industrial standards ANSI, BS, DIN, or JIS) and the length in the transporting direction of the printing plate differs depending on the size. Moreover, the transporting length of the printing plate also differs depending on the direction in which the printing plates are transported inside the processing device. Here, if the length in the transporting direction of the printing plates is long (for example, if an A0 size printing plate is transported in the longitudinal direction of the printing plate), when the printing plate is separated from the nipping rollers provided at the discharge aperture of the processing device, because the distance between the leading edge of the printing plate in the transporting direction and the bottom end of the slope is comparatively short, the shock received by the leading edge of the printing plate in the transporting direction is small and there is no problem. If the printing plate is, for example, an A3 size that is smaller than the A0 size and has a shorter length in the transporting direction, when the printing plate is separated from the nipping rollers, the distance between the leading edge of the printing plate in the transporting direction and the bottom end of the slope is longer. Because of this longer distance, the height from which the plate drops is higher and the shock received by the leading edge of the printing plate in the transporting direction when it slips under its own weight is greater. As a result, the printing plate sometimes bends and in some cases even breaks. Stackers are designed to be able to stack all sizes of printing plates, however, in an A3 size plate (thickness 0.4 mm), in particular, the shock received by the leading edge of the printing plate in the transporting direction when it slips down is great and the size of the deformation of the printing plate needs to be examined.

In order to solve this problem, it is possible to make the slope less steep, however, the less steep the slope, the size of the space required to install the stacker increases which is not preferable.

Another means may be considered in which a shock absorbent material is provided at the bottom end of the slope for absorbing the shock. Using this method, the force of the shock is softened, however, the condition of the stack becomes unstable, and problems occur such as the transferal to the stacking tray not being performed smoothly. This softening of the shock of falling on the printing plate is the seventh problem in a sloping stacking device in an existing processing device.

SUMMARY OF THE INVENTION

The first object of the present invention is to provide in a small space a photosensitive material processing device capable of accurately opening and closing a transit aperture for a photosensitive material such as an insertion aperture and a discharge aperture, in order to counter the above first problem.

The second object of the present invention is to provide a guide structure for a photosensitive material processing device capable of reducing costs by being able to be employed in variously structured photosensitive material processing devices, in order to counter the above second problem.

The third object of the present invention is to provide a photosensitive material processing device that suppresses the gaps between belt shaped members from appearing as winding marks on the surface of a photosensitive material when the photosensitive material is brushed using a brush roller formed by a belt shaped member comprising brush hair material wound in a spiral around a roller body, in order to counter the above third problem.

The fourth object of the present invention is to provide a finisher solution control system for a photosensitive material processing device that differentiates between a temporary stoppage and a final stoppage, and that enables control such that the concentration of the finisher solution is not changed when the replenishment of dilution water, necessary because of evaporation, and washing of rollers using this dilution water are performed in combination, in order to counter the above fourth problem.

The fifth object of the present invention is to provide a photosensitive material processing device in which, when chemical agents such as anti-mold agent are added to the water supply tank, the concentration of the chemical agents is kept substantially constant without the amount added being either excessive or insufficient, in order to counter the above fifth problem.

The sixth object of the present invention is to provide a photosensitive material processing device that has a simple structure and that accelerates the blending of the chemicals when chemical agents such as anti-mold agent are added to the water supply tank, in order to counter the above sixth problem.

The seventh object of the present invention is to provide a photosensitive material processing device provided with a photosensitive material stacking device capable of softening the force of the shock received by the photosensitive material when it drops down a slope while maintaining the steep angle of the slope, regardless of the size of the photosensitive material, in order to counter the above seventh problem.

In addition to the above seventh object, the eighth object of the present invention is to provide a photosensitive material processing device provided with a photosensitive material stacking device capable of rapidly stacking photosensitive material on the stacking device.

The first aspect of the present invention is a photosensitive material processing device for processing a photosensitive material inserted via a transit aperture provided upstream in a transporting direction of the photosensitive material using processing solutions stored in processing tanks, and discharging the photosensitive material via a transit aperture provided downstream in the transporting direction, comprising: blades provided above and below the transit passage and forming an aperture between tips of both blades protruding into the transit passage through which the photosensitive material is able to pass; a shutter section supported by a supporting shaft and formed in a cylindrical shape in an area facing the aperture; and a moving mechanism for moving a cylindrically shaped outer peripheral portion of the shutter section between a position of blocking the aperture portion and a position of opening the aperture portion.

According to this invention, blades are provided at a transit aperture of the photosensitive material and the photosensitive material passes through an aperture between the blades. The transit aperture is closed by the substantially circular cylinder-shaped outer peripheral portion of the shutter section being placed in the aperture between the blades and is opened by the substantially circular cylinder-shaped outer peripheral portion of the shutter section being withdrawn from the aperture between the blades.

In this way, by using blades to narrow the aperture through which the photosensitive material passes, the shutter section can be made smaller. Moreover, because the amount of the movement when the shutter section is withdrawn is small, the shutter section can be made compact in size.

The second aspect of the present invention is a guide structure for a photosensitive material processing device provided in a photosensitive material processing device for processing a photosensitive material using processing solutions by immersing the photosensitive material in processing solutions stored in processing tanks while transporting the photosensitive material, comprising: a guide plate placed facing the underside surface of the photosensitive material transported through the processing tank; guide ribs provided so as to protrude at predetermined intervals from the top surface of the guide plate and each extending in the transporting direction of the photosensitive material, for supporting and guiding the photosensitive material; and mounting portions, arranged at predetermined intervals in both a transporting direction of the photosensitive material and a direction orthogonal to the transporting direction, on which rollers are capable of being mounted in a freely rotatable manner such that at least a portion of an outer peripheral portion of the rollers protrude from the guide ribs.

According to this aspect of the invention, a plurality of guide ribs are provided on the top surface of a guide plate. Mounting portions on which rollers can be mounted are also formed in the guide plate.

As a result, when no rollers have been mounted, the guide plate can be used as a guide for transporting and guiding the photosensitive material using the guide ribs. When rollers have been mounted, the guide plate can be used as a guide for transporting and guiding the photosensitive material using the rollers.

Because the roller mounting portions are placed a predetermined distance apart in the transporting direction of the photosensitive material and in a direction orthogonal to the transporting direction, a guide can be formed having an optional number of rollers mounted in optional positions.

The third aspect of the present invention is a photosensitive material processing device for performing brushing processing on a surface of a photosensitive material being transported at a predetermined speed, by rotating brush rollers formed by winding a belt shaped member, comprising brush hair material on a surface of a belt shaped substrate, around a peripheral surface of a roller body in a spiral configuration from one end to the other end of the roller body, wherein a regulated winding mark index (L) is set in a predetermined range using as parameters:

(i) a width (W) of the belt shaped member, (ii) a size of a gap (h) between adjacent portions of the belt shaped member in an axial direction when the belt shaped member is wound in a spiral around the roller body, (iii) a size of an outer diameter (R) of the brush roller including the brush hair material, (iv) a size of a shaft diameter (r) which is an outer diameter of the roller body, (v) a transporting speed (V) of the photosensitive material, (vi) a number of revolutions (N) of the brush roller, and (vii) a pressing force (S) of the brush hair material when the photosensitive material is being brushed by the brush roller.

According to the third aspect of the invention, when a photosensitive material is brushed using a brush roller formed by winding a belt shaped member in a spiral around a roller body, due to the relationship between the distance moved in the axial direction of the roller by gaps between portions of the belt shaped member and the width of the gaps between portions of the belt shaped member, the extent of unevenness in the rubbing caused by these gaps changes in the time from when the brush hair material of the brush roller makes contact with the photosensitive material until it moves out of contact therewith.

Therefore, taking as parameters the width of the belt shaped member, the width of the gaps between those portions of the belt shaped member that are adjacent in the axial direction when the belt shaped member is wound in a spiral on a roller body, the outer diameter of the brush roller including the brush hair material, the diameter of the shaft which is the outer diameter of the roller body, the transporting speed of the photosensitive material, the number of revolutions of the brush roller, and the amount of the pressing by the brush hair material when the photosensitive material is brushed using the brush roller, rubbing unevenness is suppressed from appearing on the surface of the photosensitive material by setting these parameters such that rubbing unevenness on the surface of the photosensitive material is reduced, thereby an improvement in the product quality of the photosensitive material can be achieved.

The fourth aspect of the present invention is a control system for finishing solution in a finishing processing section used in a photosensitive material processing device for processing a photosensitive material using processing solution while transporting the photosensitive material using transporting rollers, the finishing processing section performing desensitizing processing on the surface of the photosensitive material using finishing solution comprising: a pair of transporting rollers provided in at least the finishing processing section for imparting transporting force to the photosensitive material by nipping the photosensitive material and transporting it through the finishing processing section; a washing device for washing the pair of transporting rollers using dilution water for diluting stock solution of the finishing solution; a stop mode selecting device for selecting any one of a temporary stop mode when a state in which an operation of the photosensitive material processor is stopped lasts for a comparatively short time, and a complete stop mode when a state in which an operation of the photosensitive material processor is stopped lasts for a comparatively long time; and a washing control mechanism for operating the washing device when the complete stop mode is selected in the selecting device, and for stopping the photosensitive material processing device from operating without operating the washing device, and operating the washing device when the photosensitive material processing device is restarted after a predetermined time has elapsed when the temporary stop mode is selected.

According to the fourth aspect of the present invention, when the device is stopped, a temporary stoppage or a complete stoppage is selected by the selecting device.

When the temporary stop mode is selected, because it can be basically assumed that the device will be restarted after the lapse of a short passage of time, the transporting rollers are not washed, unlike when the complete stop is selected.

Namely, because finisher solution is supplied to the rollers by the operation of the device before the finisher solution hardens and pairs of rollers stick together or the finisher solution adheres as a precipitate to the roller surfaces, the rollers are placed in a wet state by the finisher solution and washing of the rollers can be omitted. As a result, it is possible to control the needless use of dilution water and to ensure a sufficient amount of dilution water is available for washing the rollers at the complete stop time.

It should be noted that, in temporary stop mode, it is basically expected that the device will be restarted after the above short time, however, it may happen that the stoppage is lengthened for some reason or other. Therefore, in the washing control device, in temporary stop mode, when the device is restarted after a predetermined time has elapsed, it is determined that finisher solution has hardened and become adhered to the rollers and, in this case, the washing device that uses dilution water is operated. Namely, although the mode is temporary stop mode, when a predetermined length of time has passed, it is necessary to perform the same processing as for the complete stop mode. As a result, in the temporary stop mode, when the device is left unused (i.e. not restarted) for a long time for some reason or other, the rollers can be washed with dilution water in the same way as in the complete stop.

The fifth aspect of the present invention is a photosensitive material processing device for processing a photosensitive material using processing solution that uses water, comprising: a water supply tank for storing the water; a chemical agent adding device for adding chemical agent to the supply tank; a water supply device for supplying water to the water supply tank in accordance with an amount of the water that is used; and an adding control device for adding the chemical agent to the water supply tank by operating the chemical agent adding device in accordance with an amount of water supplied to the water supply tank.

According to the fifth aspect of the present invention, a water tank is provided and water used for diluting processing solutions or for washing water is pumped from this water tank to each processing tank. Moreover, water is supplied to this water tank in accordance with the amount of water pumped out, so that a state is maintained in which substantially a fixed amount of water is stored.

The adding control device adds chemical agents such as anti-mold agent or the like in accordance with the amount of water supplied to the water supply tank. As a result, water is stored in the water supply tank that has substantially a fixed concentration of chemical agent.

By adding chemical agent in accordance with the amount of water supplied to the water supply tank, in this way, there is no longer any need to add chemical agent separately to each processing tank, and it is possible to prevent mold, for example, and the like from forming by efficiently using chemical agent, without the user forgetting to add the chemical agent or adding an excessive or insufficient amount of the chemical agent.

The sixth aspect of the present invention is a photosensitive material processing device for processing photosensitive material using processing solutions that use water supplied from a water supply tank, comprising: a conduit portion slanted at a predetermined angle above the surface of water inside the water supply tank; a chemical agent adding device for adding chemical agent to the water supply tank by dropping the chemical agent from a predetermined position on the conduit portion; and a water supply device for supplying water to the water supply tank by dropping water down the conduit portion from a position above the position where the chemical agent is dropped onto the conduit portion.

According to the sixth aspect of the present invention, a conduit portion is provided in the water supply tank. When water is supplied to this conduit portion in the water supply device, the water runs down the conduit portion and falls into the water supply tank.

When chemical agent is supplied to this conduit portion in the chemical agent adding device, the chemical agent runs down the conduit portion.

In this case, when the chemical agent has a high viscosity, it runs at a slow speed down the conduit portion. When such a chemical agent is running down the middle of the conduit portion, if water is supplied to the conduit portion from the water supply device, the water washes down the chemical agent on the conduit portion as it flows down the conduit portion. As a result, it is possible to supply water in which chemical agent has already been mixed. Moreover, by mixing the chemical agent into the water flowing down the conduit portion, the chemical agent is more easily dissolved. Accordingly, the dissolving of the chemical agent in the water can be accelerated.

The seventh aspect of the present invention is a photosensitive material stacking device for stacking photosensitive material discharged from a discharge aperture of the photosensitive material processing device after having completed predetermined processing while being transported by the photosensitive material processing device, comprising: a slope down which the photosensitive material discharged from the discharge aperture is slid in a slanted state; stoppers provided on the slope for catching a front edge in the transporting direction of the photosensitive material discharged from the discharge aperture; a moving device for moving the stoppers from a position at the top portion of the slope, which is a reference position, to the bottom of the slope and then back again to the reference position; a transferring device for vertically stacking the photosensitive materials by transferring the photosensitive materials discharged from the discharge aperture and transported and placed in a slanted state at the bottommost end portion of the slope to a stacking shelf provided facing the slope; a front edge detecting sensor provided at the top end portion of the slope for detecting a front edge of the photosensitive material discharged from the discharge aperture; and a control device for controlling the moving device to start the stoppers moving down the slope from the reference position, with the stoppers not in contact with the photosensitive material, so as to match a transporting speed of the photosensitive material when it is discharged from the discharge aperture, using a signal output from the front edge detection sensor as a result of a detection of the front edge of the photosensitive material discharged from the discharge aperture, and the photosensitive material is caught by the stoppers as the photosensitive material separates from the discharge aperture and slides down the slope.

According to the seventh aspect of the present invention, firstly, the front edge of a photosensitive material discharged from the discharge aperture of a processing device is detected by a front edge detecting sensor.

When the front edge portion in the transporting direction of the photosensitive material is detected, then, regardless of the size of the photosensitive material, the operation of a moving means is started at a timing whereby the distance between the stoppers and the front edge of the photosensitive material is set at a comparatively short predetermined interval, and the stoppers start to move downwards from a reference position at the top of the slope. The speed of the movement of the stoppers is obtained from the speed at which the photosensitive material is being transported by the photosensitive material transporting device. It is preferable if the speed of the movement of the stoppers is the same as the transporting speed of the photosensitive material processing device, however, a slight difference in speeds is allowable.

As a result, the photosensitive material is discharged down the slope at the same speed as the speed at which the photosensitive material is being transported by the photosensitive material processing device until the rear edge thereof separates from the transporting roller pair at the discharge aperture of the photosensitive material processing device. However, because the stoppers are also descending together with the movement of the photosensitive material, the distance between the front edge of the photosensitive material and the stoppers is maintained at a comparatively short predetermined interval (i.e. shorter than the distance from the front edge of the photosensitive material to the bottommost end of the slope), thereby keeping the photosensitive material and the stoppers from coming into contact with each other.

At this point, when the photosensitive material separates from the discharge aperture, the photosensitive material slides down the slope under its own weight. However, because the photosensitive material that has slid down for a short distance is caught by the stoppers, the force of the shock received by the photosensitive material is extremely small, and it is possible to prevent the bottom edge portion of the photosensitive material (the front edge portion in the transporting direction) from being deformed.

When the stoppers reach a predetermined bottom end position, the font edge portion in the transporting direction of the photosensitive material is supported by the bottommost end portion of the slope. Thereafter, the stacking of the photosensitive material is completed when the photosensitive material is transferred to a stacking shelf.

BRIEF DESCRIPTION OF THE DRAWINGS

FIG. 8A is a schematic plan view, while FIG. 8B is a schematic view seen from the axial direction side of the roller.

FIG. 26A is a schematic plan view of the main portions, while FIG. 26B is a schematic cross-sectional view along the perpendicular direction of the main portions.

DESCRIPTION OF THE PREFERRED EMBODIMENTS

The embodiments of the present invention will now be described with reference to the drawings.

(First Embodiment)

Figure 1:
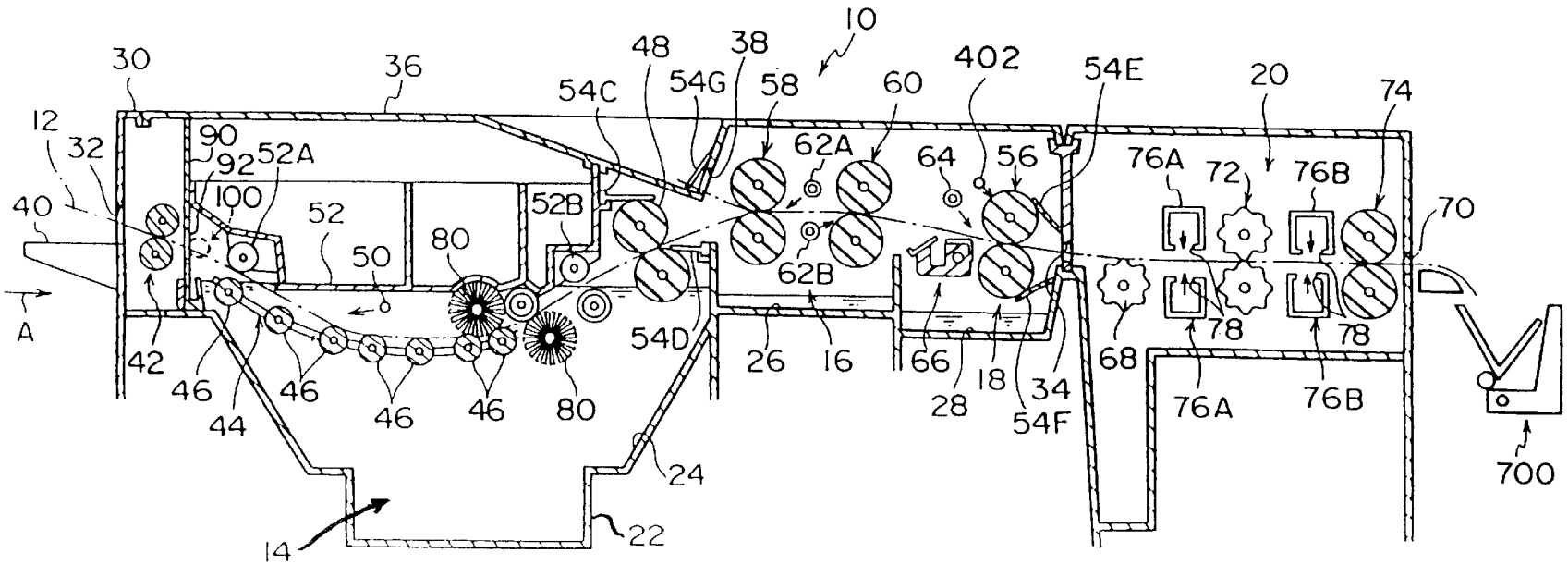
FIG. 1 is a schematic structural view of a PS plate processor in which the first embodiment is applied.

A photosensitive planographic printing plate processing device (referred to below as the automatic developing device 10) used as an example of a photosensitive material processing device is shown in FIG. 1. This automatic developing device 10 performs developing processing on a photosensitive planographic printing plate (referred to below as the PS plate 12), on which an image has been printed by a printing device (not shown in the drawings), as a photosensitive material.

The PS plates processed in the automatic developing device 10 are multipurpose printing plates used conventionally and have a structure which comprises a photosensitive composition coated in a thin layer on a substrate formed from an aluminum plate. The surface of the substrate of this PS plate 12 is given a satin finish by performing a surface roughening process thereon using a mechanical method such as a brushing grain method or a ball grain method or an electrochemical method such as an electric grain method, or by performing a combination of mechanical and electrochemical methods. The substrate is then etched using an acid or alkali or the like aqueous solution, anodizing processing, hydrophilic processing, and the like are then performed, after which the photosensitive layer is formed.

Both positive and negative types of photosensitive layer exist. For example, when a photosensitive composition for forming a negative type of photosensitive layer is used, the exposure portion changes to one soluble in alkali. Therefore, by using an alkali developing solution, the photosensitive layer of the exposure portion is dissolved and the hydrophilic surface of the substrate can be exposed. Moreover, when a photosensitive composition for forming a negative type of photosensitive layer is used, the unexposed portion can be removed using developing solution. By removing this unexposed photosensitive layer portion, it is possible to expose the hydrophilic surface of the substrate.

The automatic developing device 10 is provided with: a developing section 14 for processing the PS plate 12 using developing solution; a washing section 16 for performing a washing processing on the developing solution adhered to the PS plate 12; a finisher section 18 for performing a desensitizing processing by coating the washed PS plate 12 with a gum solution; and a drying section 20 for drying the PS plate 12. A stacking device 700 for stacking processed PS plates 12 may also be provided.

A processing tank 22 is provided in the automatic developing tank 10. A developing tank 24 is formed in the processing tank 22 at the position of the developing section 14. A washing tank 26 and a finisher tank 28 are formed as processing tanks at the positions of the washing section 16 and the finisher section 18.

An insertion aperture 32 is formed in an outer plate panel covering the processing tank 22. A discharge aperture 34 is formed at the drying section 20 side of the processing tank 34. A reentry insertion aperture (a sub-insertion aperture) 38 for inserting a PS plate 12 is provided in a cover 36 covering the processing tank 22 between the developing section 14 and the drying section 16. The reentry insertion aperture 38 is an insertion aperture for PS plates 12 for when processing other than that performed in the developing section 14 is performed by the automatic developing device 10.

An insertion stand 40 is provided to the outside of the insertion aperture 32. A pair of rubber transporting rollers 42 are provided at the side of the developing section 14 at which the PS plates 112 are inserted. A PS plate 12 on which an image has been printed is loaded on the insertion stand 40 and inserted in the direction indicated by the arrow A via the insertion aperture 32. It is then fed between the transporting roller pair 42.

The pair of transporting rollers 42 is rotated by the driving force of a drive device (not shown in the drawings) so as to pull in the inserted PS plate 12. The transporting rollers 42 then feed the PS plate 12 to the developing section 14 at an angle of between 15° and 31° to the horizontal direction. Note that, in the present embodiment, a single sided type of PS plate 12 comprising a photosensitive layer formed on a single surface of an aluminum substrate having a predetermined thickness is used as an example. The PS plate 12 is inserted into the automatic developing device 10 via the insertion aperture 32 with the photosensitive layer facing upwards.

The developing tank 24 formed in the processing tank 22 is shaped substantially like a mountain with the center of the bottom portion thereof protruding downwards. Developing solution for performing developing processing on the PS plate 12 is stored in the developing tank 24. A guide plate 44 is provided running along the bottom portion of the developing tank 24 in the transporting direction of the PS plate 12 and to the underside thereof.

A plurality of freely rotatable small rollers 46 are attached to the guide plate 44 in the upstream portion of the developing tank 24 (i.e. towards the insertion aperture 32 side). The axis of rotation of these small rollers 46 is orthogonal to the direction in which the PS plate 12 is transported. A PS plate 12 fed into the developing section 14 by the pair of transporting rollers 42 is transported onto the guide plate 44 while being guided by the plurality of rollers 46. At this time, because the rollers 46 rotate freely with the PS plate 12 held above the surface of the guide plate 44, there are no scratches generated on the PS plate 12 by sliding. The improvement of the guide structure including these rollers 46 is described in detail below with reference to FIGS. 6 to 11.

A pair of rubber transporting rollers 48 are provided at the washing section 16 side of the developing tank 24. PS plates 12 that have been guided through the developing tank 24 are nipped by these transporting rollers 48 and fed out from the developing tank 24. The PS plates 12 are immersed in developing solution when they are transported in this way through the developing tank 24. The photosensitive layer that has been photosensitized by image printing is swelled by the developing solution and peels away from the substrate. The unnecessary photosensitive layer is removed by a brush roller 80 corresponding to the printed image. The improvements to this brush roller 80 are described below in detail with reference to FIGS. 12 to 16B.

A spray pipe 50 is provided in the developing tank 24. Developing solution expelled towards the upstream side of the transporting direction of the PS plate 12 by the spray pipe 50 is sprayed onto the photosensitive layer surface of the PS plate 12 that is transported through the developing solution. Note that, the developing solution sprayed onto the photosensitive layer surface is circulated from the tank 24 by a pump and piping (both not shown in the drawings) so as to be returned to the spray pipe 50. Note also that the direction of the spray of the developing solution from the spray pipe 50 onto the PS plate 12 being transported through the developing solution is not limited to the upstream side of the transporting direction of the PS plate 12, but may be towards the downstream side of the transporting direction of the PS plate 12, or may be another direction such as a direction orthogonal to the transported PS plate 12.

The PS plate 12 pulled out from the developing tank 24 by the transporting rollers 48 is fed to the washing section 16 while the developing solution adhered to the surface thereof is squeezed off by the transporting rollers 48.

Two pairs of transporting rollers 58 and 60 are provided in the washing section 16 above the washing tank 26. The PS plate 12 pulled out from the developing tank 24 is nipped and transported through the washing section 16 by the transporting rollers 58 and 60.

Spray pipes 62A and 62B are provided as an upper and lower pair on either side of the transporting path of the PS plate 12. The spray pipes 62A and 62B are positioned such that the axial direction thereof runs in the transverse direction of the PS plate 12 (i.e. in a direction orthogonal to the transporting direction). A plurality of spray holes are formed in the pipes 62A and 62B parallel to the transverse direction of the PS plate 12 and facing the transporting path of the PS plate 12.

Washing water supplied by a pump from a washing water tank (not shown in the drawings) in synchronization with the transporting of the PS plate 12 is sprayed from the spray holes towards the PS plate 12, thereby washing the front and rear surfaces of the PS plate 12. The water that has washed the PS plate 12 is squeezed off the PS plate 12 by the transporting roller pair 60, is collected in the washing tank 26, and is discharged from the washing tank 26. Note that, although the direction of the spray of the washing water from the spray pipe 62A is towards the upstream side of the transporting direction of the PS plate 12, while the direction of the spray of the washing water from the spray pipe 62B is towards the downstream side of the transporting direction of the PS plate 12, the directions of the spray are not limited to these directions and may face in other directions.

A pair of transporting rollers 56 are provided in the finisher section 18 above the finisher tank 28. After the PS plate 12 has been transported through the finisher section 18 by the transporting rollers 56, it is fed out via the discharge aperture 34.

A spray pipe 64 is provide in the finisher section 18 on the upper side of the transporting path of the PS plate 12. The axial direction of the spray pipe 64 is positioned along the transverse direction of the PS plate 12. A plurality of spray holes are formed in the spray pipe 64 facing the transporting path of the PS plate 12. A spray unit 66, in which a series of slits are formed extending in the transverse direction of the PS plate 12, is provided in the finisher section 18 beneath the transporting path of the PS plate 12. A dilution pipe 402 may also be provided above the transporting rollers 56.

Finishing (e.g. gum) solution used to protect the plate surface of the PS plate 12 is stored in the finisher tank 28. This finishing solution is supplied to the spray pipe 64 and spray unit 66 by a pump (not shown in FIG. 1) that operates in synchronization with the transporting of the PS plate 12. The spray pipe 64 drips the finishing solution onto the PS plate 12 thereby coating it widely over the front surface of the PS plate 12. When the rear surface of the PS plate 12 passes over the slit portion while in contact with the slit portion, the spray unit 66 coats the entire rear surface of the PS plate 12 with finishing solution expelled from the slits. The improvement in the control of this finishing solution is described in detail below with reference to FIGS. 17 and 18.

A protective film is formed on the PS plate 12 by the finishing solution coated on the front and rear surfaces thereof. Note that the direction of the spray of the finishing solution from the spray pipe 64 is not limited to the down stream side of the transporting direction of the PS plate 12, and may be another direction. In addition, the spray unit 66 is provided on the lower side of the transporting path of the PS plate 12 for coating finishing solution on the PS plate 12, however, the provision is not limited to a spray unit 66 and a spray pipe may be provided for the coating of the finishing solution.

The PS plate coated with the finishing solution in the finisher section 18 is nipped by the pair of transporting rollers 56 and is discharged via the discharge aperture 34 with a slight amount of finishing solution left on the front and rear surfaces. The PS plate 12 is then fed to the drying section 20.

A supporting roller 68 for supporting the PS plate 12 in the vicinity of the discharge aperture 34 is provided in the drying section 20. Moreover, pairs of transporting rollers 72 and 74 are provided near the center of the transport path of the PS plate 12 and in the vicinity of the discharge aperture 70 in the drying section 20. The PS plate 12 is transported through the drying section 20 by the supporting roller 68 and the transporting rollers 72 and 74.

Pairs of ducts 76A and 76B are provided between the supporting roller 68 and the transporting rollers 72 and between the transporting rollers 72 and the transporting rollers 74 on either side of the transporting path of the PS plate 12. The ducts 76A and 76B are positioned such that the longitudinal direction thereof extends in the transverse direction of the PS plate 12. Slit holes 78 are formed in the surfaces of the ducts 76A and 76B that face the transporting path of the PS plate 12.

When a drying wind generated by a wind generating device (not shown in the drawings) is supplied from one longitudinal end of the ducts 76A and 76B, this drying wind is expelled from the slit holes 78 in the direction of the transporting path of the PS plate 12 and is blown onto the PS plate 12. As a result, the finisher solution coated on the front and rear surfaces of the PS plate 12 is dried thereby forming a protective film. Note that a shutter (not shown) is provided at the discharge aperture 334 for separating the drying section 20 from the developing section 14 as far as the finisher section 18 where the PS plate 12 is processed with processing solution. The shutter prevents the discharge aperture 34 from being unnecessarily opened and air heated in the drying section 20 from entering into the finisher section 18.

Returning now to the developing section 14, a solution surface lid is provided such that the bottom surface thereof is lower than the surface of the developing solution stored in the developing tank 24. Shielding members 54C and 54D are mounted on the wall surfaces of the solution surface lid 52 and the developing tank 24 at the washing section 24 side thereof. Shielding members 54E and 54F are mounted in the processing tank 22 in the vicinity of the discharge aperture 34. Moreover, a shielding member 54G is mounted on the reentry insertion aperture 38 of the cover 36.

The distal end portions of the shielding members 54C and 54D abut respectively against the peripheral surface of the upper roller of the transporting roller pair 48 and against the peripheral surface of the lower roller of the transporting roller pair 48. The distal end portions of the shielding members 54E and 54F abut against the peripheral surface of the upper roller and against the peripheral surface of the lower roller of the transporting roller pair 56 provided adjacent to the discharge aperture 34. A shielding member 54G is also provided for covering the reentry insertion aperture 38.

In the developing section 14, the area of the surface of the developing solution that comes into contact with air is reduced by the solution surface lid 52. Moreover, the developing section 14 is closed off by the transporting roller pair 48 and the shielding members 54C and 54D and also by the transporting roller pair 56 and the shielding members 54E and 54F such that fresh air from the discharge aperture 34 side and heated air from the drying section 20 is prevented from coming in. As a result, deterioration of the developing solution and evaporation of the water component in the developing solution inside the developing tank 24 caused by the carbon dioxide in the air when fresh air gets into the area around the surface of the developing solution can be suppressed.

Note that skewer rollers 52A and 52B are provided beneath the bottom surface of the solution surface lid 52 at the upstream end portion and the downstream end portion in the transporting direction of the PS plate 12. Marks on the surface (usually the photosensitive surface) of the PS plate 12 being transported through the developing section 14 caused by it coming into contact with the bottom surface of the solution surface lid 52 are thus prevented.

As is shown in FIG. 1, a partition plate 90 is provided inside the insertion aperture 32 on the developing section 14 side of the transporting rollers 42. The top portion of this partition plate 90 is fixed, for example, to an outer plate panel 30, while the bottom portion thereof is fixed to the processing tank 22. The surface of the solution surface lid 52 on the side of the insertion aperture 32 is in tight contact with the partition plate 90. An aperture portion or a transit passage 92 for the passage of the PS plate 12 is formed at a predetermined position in the partition plate 90.

Figure 2:
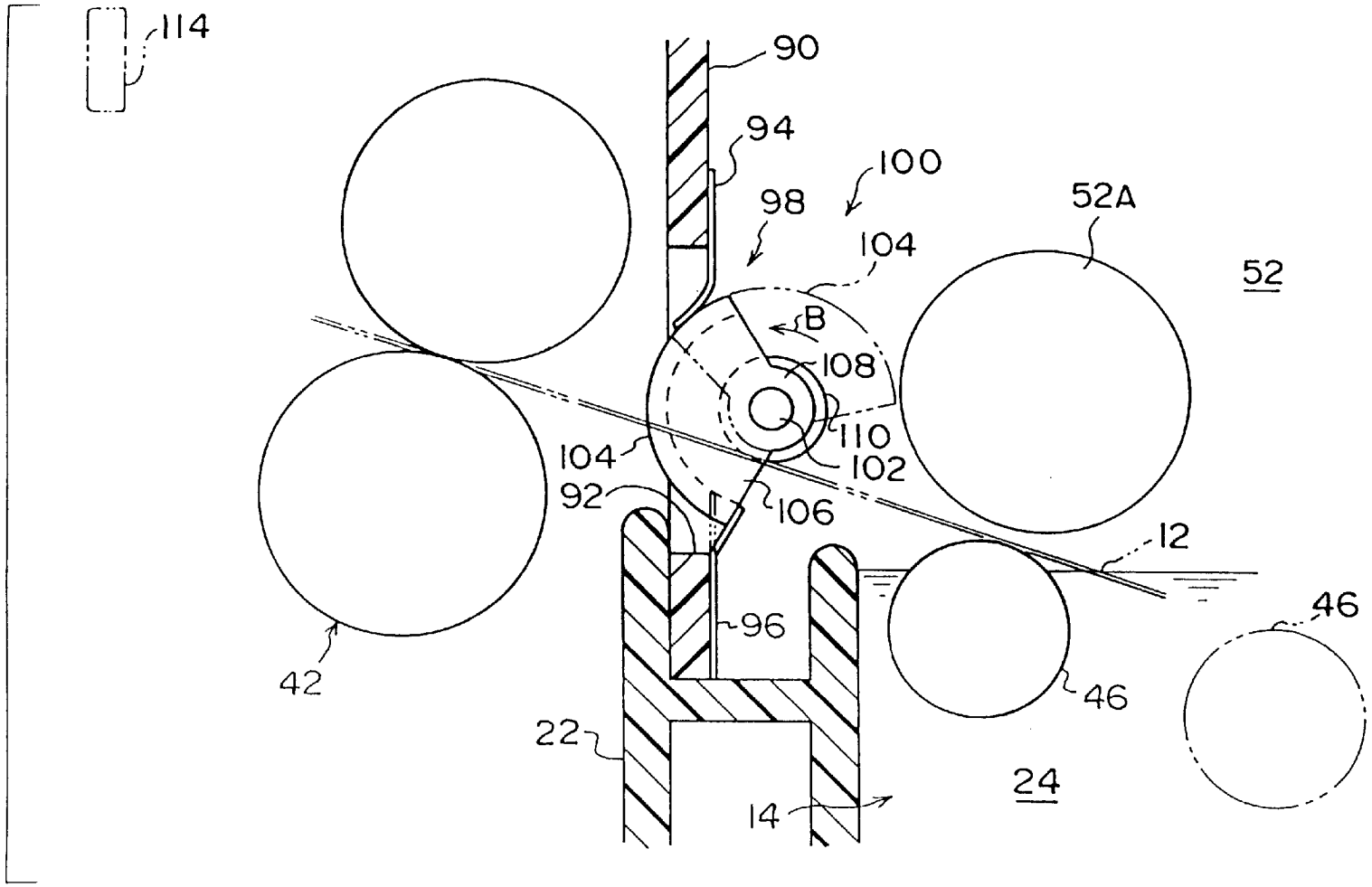
FIG. 2 is a schematic structural view of the area upstream of the developing section showing the shutter used in the first embodiment.

As is shown in FIG. 2, a pair of blades 94 and 96 are provided at the upper side and lower side of the aperture 92 in the partition plate 90. The blades 94 and 96 are both formed from a sheet shaped elastic member such as silicon rubber. The blades 94 and 96 are also both formed projecting outwards so as to narrow the top and bottom of the aperture 92. The PS plate 12 passes through a slit shaped aperture 98 formed by the blades 94 and 96. Note that the blades 94 and 96 are placed at positions and at a distance apart such that their tips do not come into contact with the PS plate 12 as it passes through the aperture 98.

Figure 3:
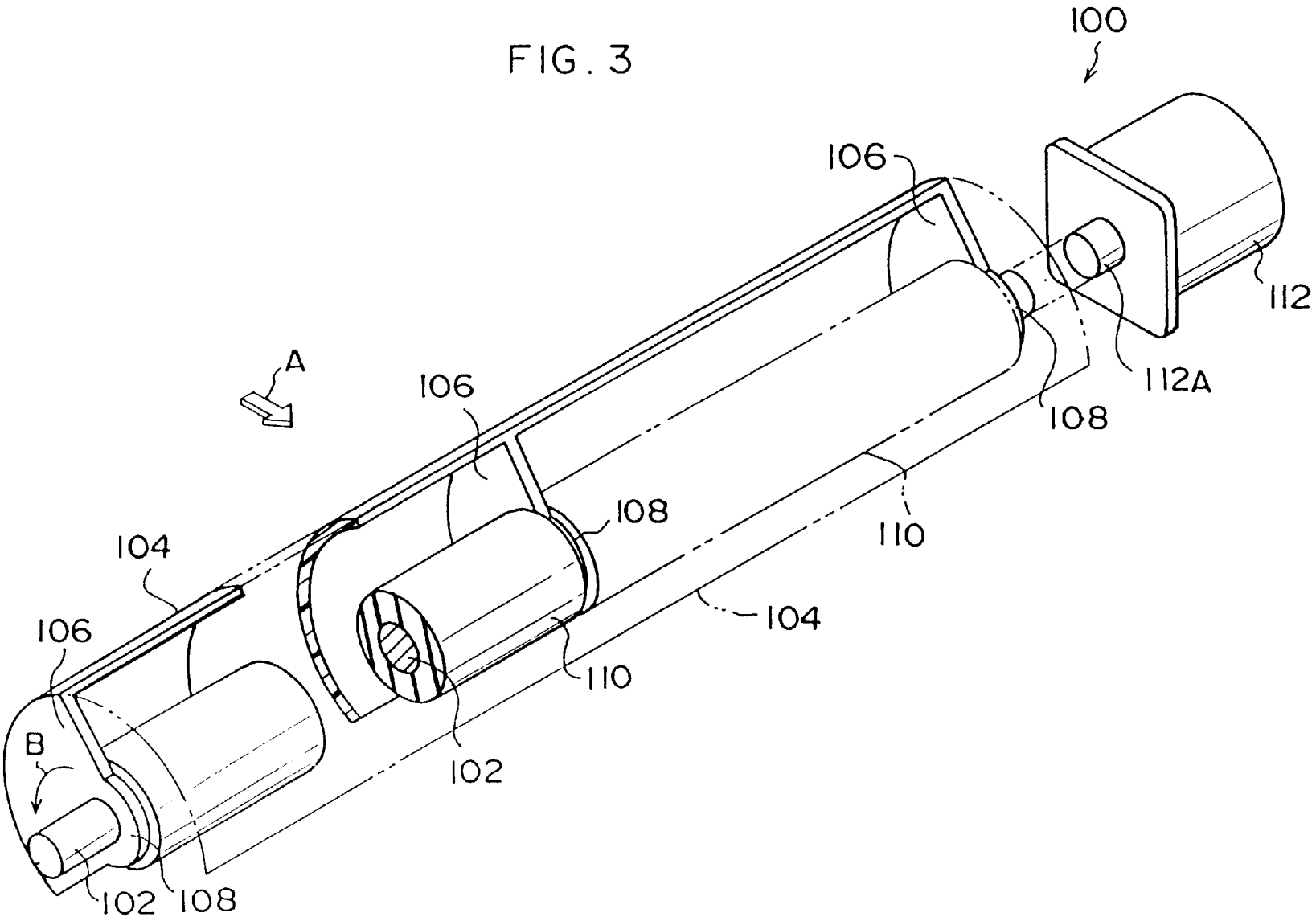
FIG. 3 is a perspective view of main portions showing the schematic structure of the shutter used in the first embodiment.

In the first embodiment, a shutter 100 is provided at the inner side (the developing tank 24 side) of the partition plate 90. As is shown in FIGS. 2 and 3, a shaft 102 is proved in the shutter 100 such that the axial direction thereof runs in a direction orthogonal to the transporting direction of the PS plate 12 above the transporting path of the PS plate 12. The shaft 102 is axially supported by, for example, being suspended between rack side plates (not shown in the drawings) provided inside the developing tank 24.

A blocking member 104 is provided in the shutter 100. The blocking member 104 is formed substantially in a semi-circular cylindrical shape, and is placed at the periphery of the shaft 102 and coaxially with the shaft 102.

Support legs 106 are provided at both ends and in the central portion in the axial direction of the blocking member 104. The support legs are formed substantially in a fan shape. A base portion 108 is connected to the shaft 102 so as to be able to rotate integrally with the shaft 102. The distal ends of the support legs 106 are connected to the blocking member 104.

As is shown in FIG. 2, by rotating the shaft 102 in the direction of the arrow B and positioning the blocking member 104 in a blocking position facing the aperture portion 92 of the partition plate 90 (not shown in FIG. 3), the blocking member 104 enters into the gap between the tips of the blades 94 and 96. As a result, the tips of the blades 94 and 96 are placed in tight contact with the peripheral surface of the blocking member 104, thereby closing off the aperture portion 92 of the partition plate 90 together with the blades 94 and 96 and preventing fresh air from getting into the developing tank 14 via the insertion aperture 32.

Furthermore, by rotating the blocking member 104 in the opposite direction to that shown by the arrow B from the position where it is blocking the aperture portion 92, the blocking member is move to a withdrawal position above the shaft 102. As a result, the aperture 98 between the blades 94 and 96 is opened and the PS plate 12 is able to pass through.

As is shown in FIGS. 2 and 3, guide rollers 110 are provided on the shaft 102 between the supporting legs 106. The outer peripheral portions of the guide rollers 110 are formed from an elastic member such as silicon rubber and are placed so as to be able to rotate freely around the shaft 102. The guide rollers 110 are sized (i.e. have a radius) such that their outer peripheral portions protrude from the base portion 108 of the supporting legs 106. When the blocking member 104 is moved to the withdrawal position, the outer peripheral portions of the guide rollers 110 are exposed to the transporting path of the PS plates 12.

Consequently, the guide rollers 110 rotate while in contact with the PS plate 12 as it passes through the aperture 98 between the blades 94 and 96, and guide the PS plate 12 towards the developing tank 24. When the rear edge portion of the PS plate 12 is passing through, the guide rollers 110, by being in contact with this rear edge portion, prevent the rear edge of the PS plate 12 from lifting up and coming into contact with the outer edge of the aperture portion 92 of the partition plate 90 or the tip of the blade 94.

As is shown in FIG. 3, one end of the shaft 102 is connected to a drive shaft 112A of an opening and closing motor 112. This opening and closing motor 112 rotates the shaft 102 within a predetermined angular range.

As a result, by driving the opening and closing motor so that the shaft 102 is rotated within the predetermined angular range, the blocking member 104 is moved between the blocking position and the withdrawal position. Note that the drive shaft 112A of the opening and closing motor 112 may be directly connected to the shaft 102. Alternatively, it may be connected thereto via a transmission mechanism using a plurality of gears or the like.

As is shown in FIG. 2, a plate detection sensor 114 (not shown in FIG. 1) is provided inside the insertion aperture 32 in order to detect a PS plate 12 passing through the insertion aperture 32.

Figure 4:
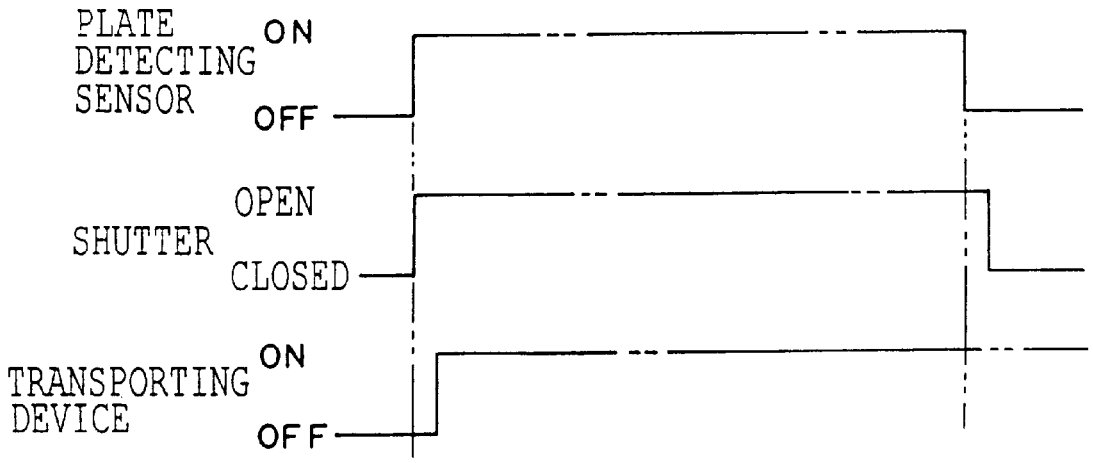
FIG. 4 is a timing chart showing an outline of the operation of a shutter based on the results of a detection by a plate detection sensor.

As is shown in FIG. 4, the automatic developing device 10 begins to drive the transporting devices such as the transporting rollers 42 and the like based on detection results from the plate detection sensor 114. At this time, in the automatic developing device 10, when it is detected by the plate detection sensor 114 that the front edge of a PS plate 12 has been inserted (i.e. ON), firstly, the opening and closing motor 112 is operated and the blocking member 104 is moved to the withdrawal position, thereby opening the aperture 98 between the blades 94 and 96. After this, the transport devices are operated (ON). When the plate detection sensor 114 detects the rear edge of the PS plate 12 (OFF), the automatic developing device 10 operates the opening and closing motor 112 at the time when the rear edge of the PS plate 12 has passed between the blades 94 and 96 (i.e. the aperture 98), thereby moving the blocking member 104 between the blades 94 and 96 and closing off the aperture 98.

The operation of the present embodiment will be described below.

A PS plate 12 on which an image has been recorded by a printing device or the like (not shown in the drawings) is placed on the insertion stand 40. When it is inserted into the insertion aperture 32, the PS plate 12 is pulled in by the pair of transporting rollers 42 and fed into the developing tank 14. Note that, in the automatic developing device 10, when the PS plate 12 passing through the insertion aperture 32 is detected by a sensor (not shown in the drawings), a timer is started. This timer is used in the automatic developing device 10 to time the operation of the drive device for transporting the PS plate 12, the timing of the ejection of washing water from the spray pipes 62A and 62B in the washing section 16, and the timing of the ejection of finishing solution in the finisher section 18.

In the developing section 14, the PS plate 12 is then fed by the pair of transporting rollers 42 at an insertion angle of between 15° and 31° relative to horizontal while being immersed in the developing solution. The PS plate 12 is then fed out of the developing solution at a discharge angle of between 17° and 31° relative to horizontal. By immersing the PS plate 12 in the developing solution in the developing section 14, the photosensitive layer is swelled corresponding to the exposed image. The swelled photosensitive layer is then removed from the substrate. Note that it is also possible for the removal of unnecessary photosensitive layer from the PS plate 12 to be accelerated by the brush rollers 80 inside the developing tank 24 (see FIG. 1), and for dirt adhering to the PS plate 12 to be removed by the brush rollers 80.

The PS plate 12 fed out from the developing solution in the developing section 14 is pulled out by the pair of transporting rollers 48, and is fed to the washing section 16 while developing solution adhering to the front and rear surfaces is squeezed off. In the washing section 16, while the PS plate 12 is being nipped and transported by the transporting roller pairs 58 and 60, the front and rear surfaces of the PS plate 12 are washed by washing water sprayed from the spray pipes 62A and 62B. This washing water is squeezed off the PS plate 12 by the pair of transporting rollers 60.

After the PS plate 12 has completed the washing processing, it is fed to the finisher section 18 by the pair of transporting rollers 60. After the PS plate 12 has been transported into the finisher section 18 by the pair of transporting rollers 56, it is fed out via the discharge aperture 34. In the finisher section 18, the front and rear surface of the PS plate 12 are coated with finishing solution sprayed from the spray pipe 64 and the spray unit 66, thereby implementing a desensitizing processing for protecting the plate surfaces of the PS plate 12.

After the PS plate 12 has been coated with the finishing solution, it is fed to the drying section 20 via the discharge aperture 34. Note that a shutter (not shown in the drawings) provided at the discharge aperture 34 is operated either at the timing at which the PS plate 12 begins processing or at the timing at which the PS plate 12 is fed out from the finisher section 18 so as to open the discharge aperture 34. This shutter prevents drying wind from coming unnecessarily into the finisher section 18 and prevents the finishing solution from hardening on the pair of transporting rollers 56. It also prevents air getting in from the discharge aperture 34 and reaching the developing section 14, and the subsequent deterioration of the developing solution due to the carbon dioxide gas in this air. It also prevents washing water and the water content in the developing solution from evaporating and escaping via the discharge aperture 34.

In the drying section 20, a drying wind is blown onto the Ps plate 12 from the ducts 76A and 76B while the PS plate 12 is being transported by the supporting roller 68 and the transporting roller pairs 72 and 74. As a result, a protective film is formed on the PS plate 12 by the coated finishing solution and the PS plate 12 is then discharged from the discharge aperture 70.

Note that a partition plate 90 is provided on the insertion aperture 32 side of the developing tank 14. The PS plate 12 passes through an aperture portion 92 formed in the partition plate 90 and is fed to the developing section 14. A shutter 100 is also provided in this partition plate 90 and when the PS plate 12 is not passing through, the aperture portion 92 of the partition 90 is blocked by the blades 94 and 96 positioned as a pair above and below the aperture portion 92 and by the blocking member 104 of the shutter 100.

When the PS plate 12 is detected by the plate detection sensor 114, the opening and closing motor 112 is operated and the blocking member 104 is moved to the withdrawal position. As a result, the gap between the blades 94 and 96 is opened and it becomes possible for the PS plate 12 to pass through the aperture portion 92. When the plate detection sensor 114 detects the passage of the rear edge of the PS plate 12, the opening and closing motor 112 is operated at the timing at which the passage of the rear edge of the PS plate 12 between the blades 94 and 96 is ended, and the blocking member 104 is moved to the aperture 98 between the blades 94 and 96 and blocks the aperture portion 92 of the partition plate 90 together with the blades 94 and 96.

Consequently, in the developing section 14, the area of the surface of the developing solution that comes into contact with air is reduced by the solution surface lid 52. In addition, the developing tank 14 is tightly sealed when a PS plate is inserted or ejected by the solution surface lid 52, the shielding members 54C and 54D that are attached to the solution surface lid 52 and the side walls of the processing tank 22 and that slide across the peripheral surface of the pair of transporting rollers 48 while in contact therewith, and the partition plate 90. Because of this, the ingress of fresh air and heated air from the drying section 20 can be suppressed.

As a result, in the automatic developing device 10, changes in the processing performance caused by deterioration of the developing solution in the developing tank 24 and the like can be suppressed, and Ps plates having a constant product quality can be produced.

Furthermore, in the shutter 100, because the guide rollers 110 provided on the shaft 102 are exposed on the PS plate 12 transporting path side when the blocking member 104 is withdrawn, the PS plate 12 is fed to the developing section 14 while being guided by this guide roller 110. Moreover, the rear edge in the transporting direction of the PS plate 12 is also largely prevented from warping by this guide roller 110, therefore, even if the PS plate 12 is transported while being bent downwards, there is no damage from the rear edge of the PS plate 12 coming in contact with the peripheral edges of the aperture portion 92 of the partition plate 90 or the tip of the blade 94 and no rubbing marks are made.

In the shutter 100 having this type of structure, the blocking member 104 is rotated around the axis of the shaft 102 provided in the area above the transporting path of the PS plate 12. Accordingly, no large space is required in order to open or close the aperture portion 92 of the partition plate 90. It is possible to mount the shutter 102 in the limited space available between the partition plate 90 and the solution surface lid 52.

Note that, in the shutter 100, the opening and closing motor 112 is used when the blocking member 104 is moved, however, the structure is not limited to as motor and any optional structure for rotating the shaft 102 can be used. Further, both the shaft 102 and the blocking member 104 are rotated integrally in the shaft 100, however, the blocking member 104 may be made freely rotatable relative to the shaft 102. Alternatively, it is possible to make only the blocking member 104 rotatable around the axis of the shaft 102 using a link mechanism or the like.

(Second Embodiment)

The second embodiment of the present invention will now be described. Note that the basic structure of the second embodiment is the same as that of the above first embodiment. In the second embodiment, those portions that are the same as in the first embodiment are given the same descriptive symbols and a description thereof is omitted.

Figure 5:
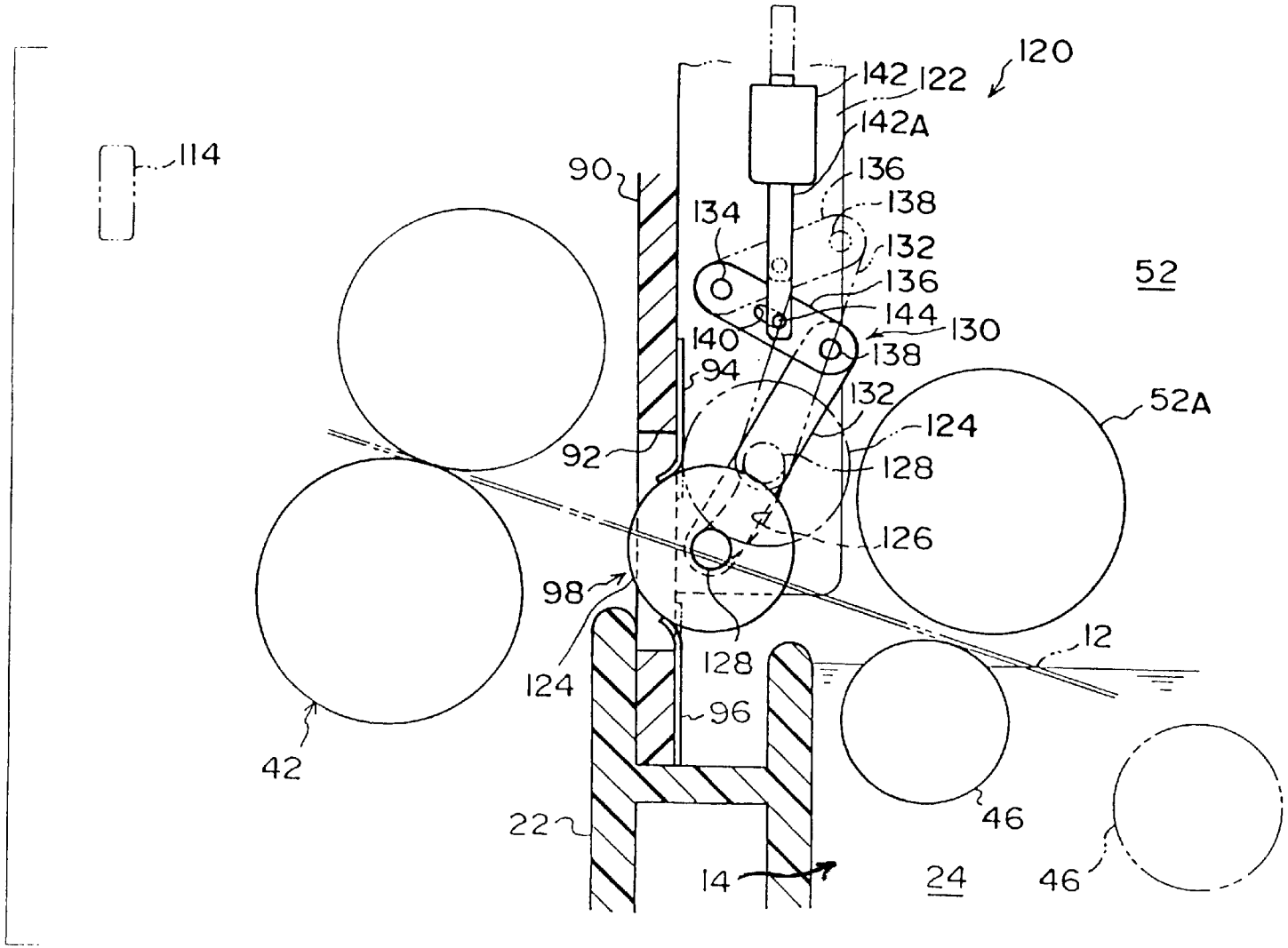
FIG. 5 is a perspective view of essential portions showing the schematic structure of the shutter used in the second embodiment.

In FIG. 5, the shutter 120 applied in the second embodiment in place of the shutter 100 of the first embodiment is shown. This shutter 120 is provided with a pair (only one of which is shown in FIG. 5) of sub side plates 122 sandwiching the transporting path of the PS plate 12.

These sub side plates 122 may be attached to the tank walls of the developing tank 24 or may be attached to the partition plate 90. It is also possible, when rack side plates are provided in the developing tank 24 to attach the sub side plates 122 to the rack side plates or to form the sub side plates 122 integrally with the rack side plates.

A guide roller 124 is provided between the pair of sub side plates 122 facing the aperture portion 92 of the partition plate 90. The outer peripheral portions of the guide roller 124 are formed from an elastic member such a silicon rubber or the like so that no rubbing marks or contact marks are left on the surface of the PS plate 12 when the guide roller 124 comes in contact with the PS plate 12.

Groove holes 126 are formed in the sub side plates 122. When the rotation shafts 128 at both ends in the axial direction of the guide roller 124 are inserted in and supported by these groove holes 126, the guide roller 124 is able to move within the groove holes 126. Note that it is also possible for the rotation shaft 128 and the guide roller 124 to be able to freely rotate within the groove holes 126. It is also possible for the guide roller 124 to be able to rotate freely relative to the rotation shaft 128.

The groove holes 126 are formed such that the guide roller 124 can be moved between a blocking position, where it is placed in the aperture 98 between the blades 94 and 96, and a withdrawal position, where it is placed above the transporting path of the PS plate 12 so as to leave open the aperture 98 between the blades 94 and 96.

Each of the sub side plates 122 is provided with a link mechanism 130. The link mechanism 130 is provided with a link arm 132 into one end of which is rotatably inserted the rotation shaft 128 of the guide roller 124, and with a link arm 136 one end of which is supported by a pin 134 provided in the rack side plate 120. The other end of the link arms 132 and 136 are connected so as to be freely rotatable by a pin 138.

An elongated hole 140 is formed in the central portion in the longitudinal direction of one link arm 136. The longitudinal direction of this elongated hole 140 extends in the longitudinal direction of the link arm 136.

Solenoids 142 are provided in each of the rack side plates 122 above the link mechanism 130 (above the link arm 136). A pin 144 attached to the tip of a plunger 142A in each solenoid 142 is inserted in the elongated hole of the link arm 136 so as to be engaged therewith.

As a result, when the solenoid 142 is off, the guide roller 124 is moved to the bottom end side of the groove holes 126 and is placed between the blades 94 and 96, as is shown by the solid line in FIG. 5. However, when the solenoid 142 is turned on, the link arms 136 are lifted up resulting in the guide roller 124 being moved to the withdrawal position at the top end of the groove holes 126, as is shown by the broken line in FIG. 5.

In a shutter structured in this way, when the front edge of a PS plate 12 is detected by the plate detection sensor 114, the solenoid 142 is turned on and the guide roller 124 is moved to the withdrawal position above the transporting path of the PS plate 12.

As a result, the PS plate 12 inserted via the insertion aperture 32 passes through the aperture portion 92 of the partition plate 90 and through the aperture 98 between the blades 94 and 96 and is fed to the developing section 14. At this time, by positioning the guide roller 124 above the transporting path of the PS plate 12, the PS plate 12 can be guided smoothly by the guide roller 124 to the developing tank 24 of the developing section 14. Moreover, because the guide roller 124 suppresses the lifting of the rear edge of the PS plate 12, the PS plate 12 is guided to the developing tank 24 without coming into contact with the peripheral edge of the aperture portion 92 of the partition plate 90 or with the tip of the blade 94.

Furthermore, when the plate detection sensor 114 detects the rear edge of the PS plate 12, the solenoid 142 is turned off at the time when the rear edge of the PS plate 12 has finished passing through the aperture 98 between the blades 94 and 96. By turning off the solenoid 142, the guide roller 124 is moved to the bottom end of the groove holes 126 by its own weight, and a portion of the outer peripheral portion of the guide roller 124 enters into the aperture 98 between the blades 94 and 96. As a result, the tips of the blades 94 and 96 are placed in tight contact with the peripheral surface of the guide roller 124, and the aperture portion 92 of the partition plate 90 is blocked by the blades 94 and 96 and by the guide roller 124.

Because this type of shutter 120 uses a guide roller 124 that doubles as a blocking member, when the aperture portion 92 of the partition plate 90 (the aperture 98 between the blades 94 and 96) is opened, the guide roller 124 only needs to be moved a slight distance and can therefore be provided in a narrow installation space.

Note that, in the above described second embodiment, the guide roller 124 is made to move inside the groove holes 126 and block the aperture portion 92 of the partition plate 90 by its own weight, however, it is also possible to use an urging device such as a coil spring or the like for urging the guide roller 124 to move to the bottom end of the groove holes 126.

Moreover, in the shutter mechanism 120, the link mechanism 130 and the solenoid 142 were used to move the guide roller 124, however, the structure of the moving mechanism is not limited to this, and a conventionally known arbitrary structure may be employed.

Furthermore, in the first and second embodiments, a description is given of when the shutters 100 and 120 are provided upstream of the developing section 14, however, the shutters 100 and 120 may also be provided at the discharge aperture 34, and may also be provided between the developing section 14 and the washing section 16.

Note that the above described present embodiment simply shows one example of the present invention and does not limit the structure of the present invention. For example, in the present embodiment, a description is given of an example in which the automatic developing device 10 is used as the photosensitive material processing device to perform developing processing on the PS plate 12, however, the present invention is not limited to the automatic developing device 10 and can be applied to an optionally structured photosensitive material processing device for processing other photosensitive materials such as photographic film, printing paper, and the like using processing solutions.

Figure 6:
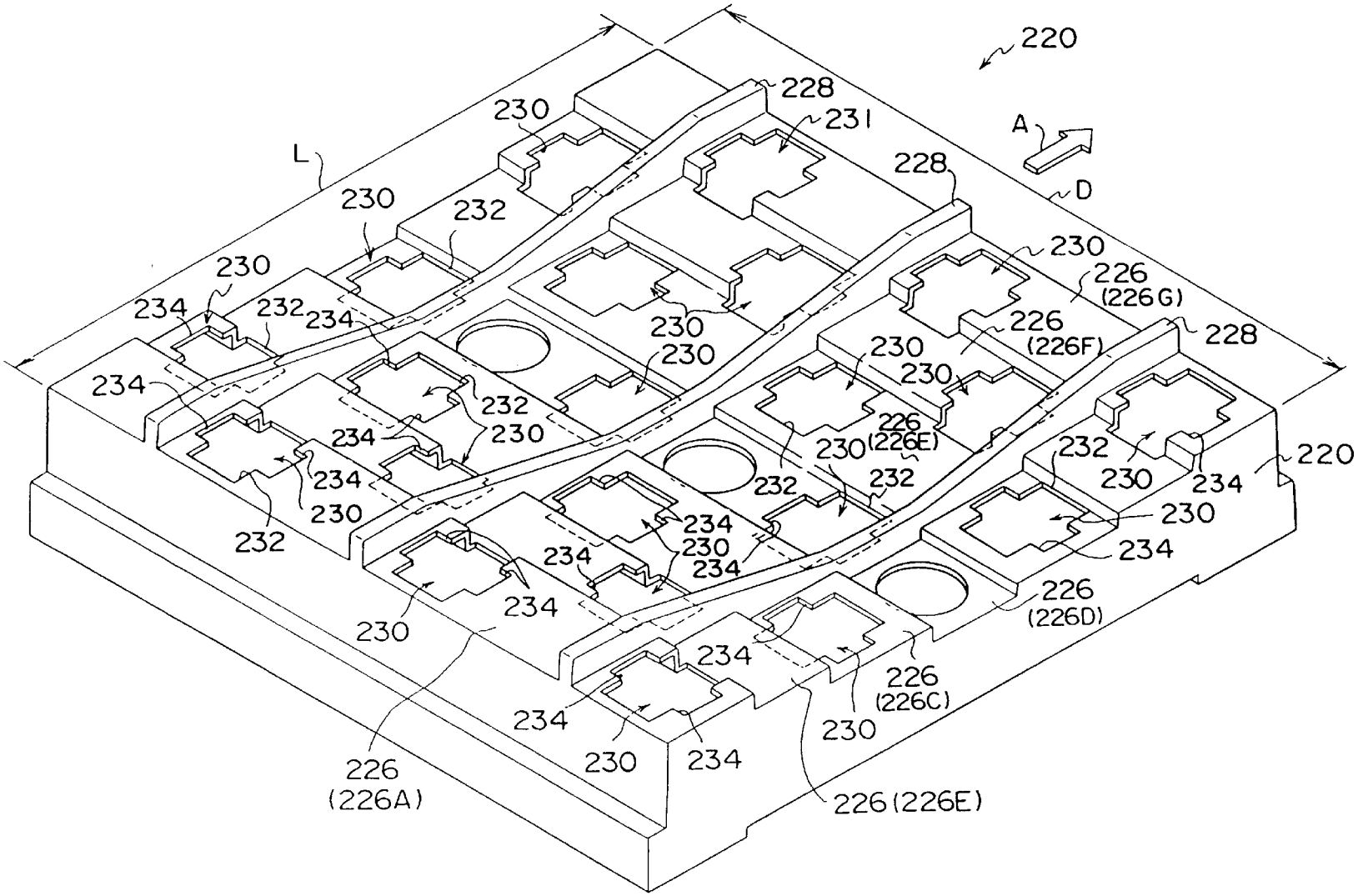
FIG. 6 is a perspective view showing an example of a guide plate in which the present invention is applied.
Figure 7:
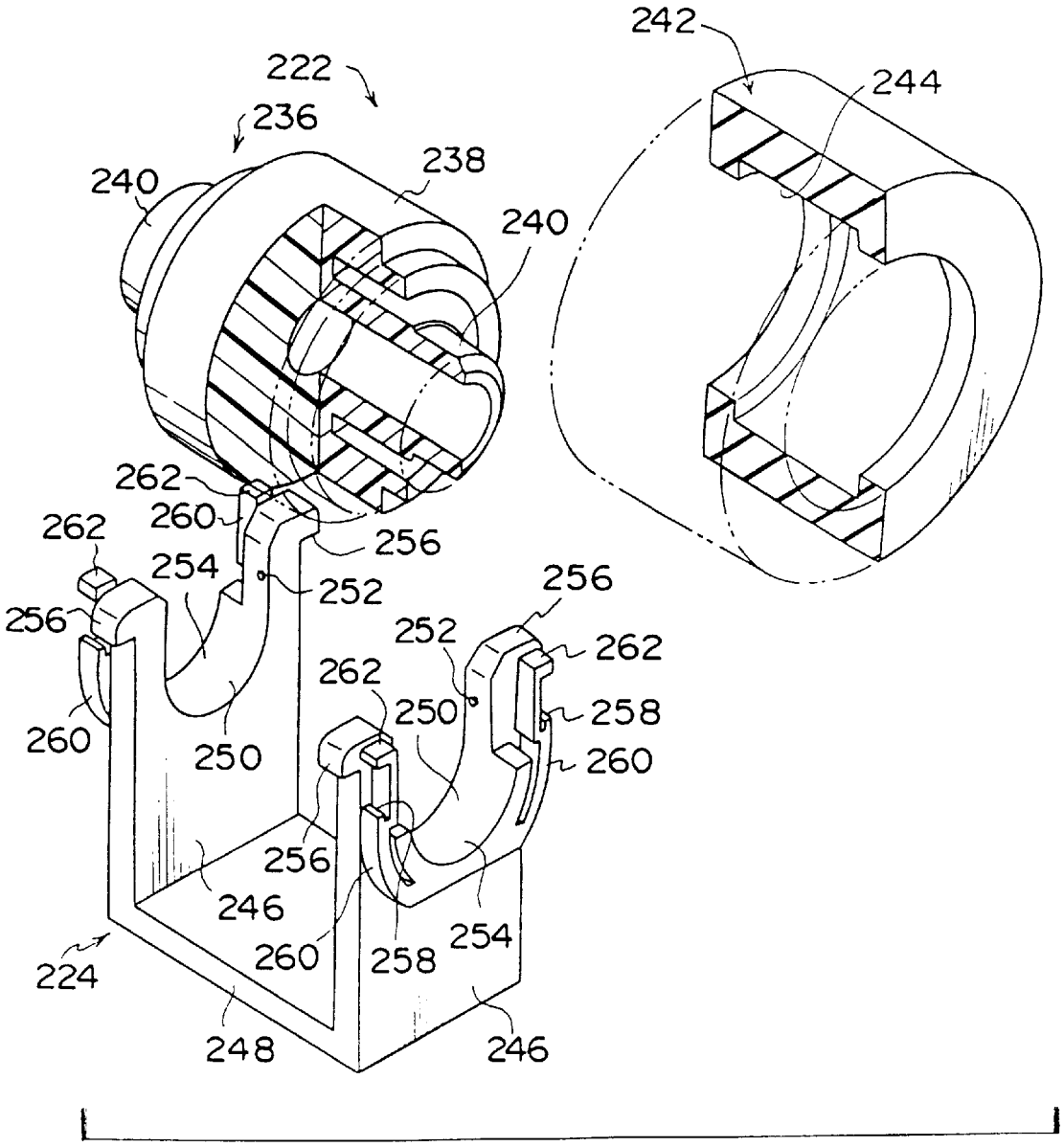
FIG. 7 is a perspective view showing an example of a roller and adapter for loading in the guide plate.

The embodiments of the guide structure of the present invention will now be described with reference made top the drawings. In FIG. 6, a guide plate 220 used in the present embodiment is shown. In FIG. 7, a roller 242 capable of being mounted on the guide plate 220 and an adaptor 224 used to mount the roller 222 are shown.

As is shown in FIG. 6, the guide plate 220 is formed substantially in a box shape having a rectangular planar shape with a hollow interior using a resin such as denatured PPO. The guide plate 220 is positioned such that the top surface thereof (the surface facing upwards from the sheet of paper showing FIG. 6) faces the transporting path of the printing plate (not illustrated).

The length L of the guide plate 220 in the transporting direction of the printing plate (the direction shown by the arrow A in FIG. 6) and the length D of the guide plate 220 in the transverse direction orthogonal to the transporting direction are both 190 mm. By linking together a plurality of guide plates 220, it is possible to form a guide that corresponds to the transporting path and transverse dimensions of the printing plate.

Flat portions 226 are formed in stages on flat plates of a predetermined thickness on the top surface of the guide plate 220. As a result, the top surface of the guide plate 220 is formed with a convex shape facing downwards. Note that the most upstream flat portion 226 in the transporting direction of the printing plate is set as the flat portion 226A; the most downstream portion is set as the flat portion 226G; the bottommost center flat portion 226 is set as the flat portion 226D; and flat portions 226B, 226C, 226E, and 226F are formed between the flat portion 226A and the flat portion 226D and between the flat portion 226D and the flat portion 226G. Note also that, in the description below, when taken together, the flat portions 226A to 226G are referred to as the flat portions 226.

A plurality of guide ribs 228 are formed on the top surface of the guide plate 220. The guide ribs 228 are provided at predetermined intervals in the transverse direction of the guide plate 220 and each guide rib 228 extends across the length of the flat portions 226 in the transporting direction of the printing plate. Moreover, when looked at from the transverse direction, the top edges of the guide ribs 228 are curved in a concave shape (i.e. a downward facing convex shape) so as to follow the flat portions 226 of the guide plate 220.

As a result, when the guide plate 220 faces the transporting plate of the printing plate, the guide ribs 228 are able to guide the printing plate in a curve while supporting the printing plate. At this time, by projecting the top edges of the guide ribs 228 above each of the flat portions 226A to 226G, the printing plate can be supported while being prevented from coming into contact with the flat portions 226.

A plurality of aperture portions 230 are formed as mounting portions in each of the flat portions 226 of the guide plate 220. Each of the aperture portions 230 is formed having a substantially cruciform planar configuration comprising a rectangular hole 232 whose longitudinal direction is in the transporting direction of the printing plate and rectangular shaped cutout portions 234 extending in the transverse direction from the central portion in the longitudinal direction of the rectangular holes 232.

The aperture portions 230 are aligned at predetermined intervals in the transverse direction on the right hand side of the guide ribs 228 when looked at from the upstream side in the transporting direction, and are also aligned in the transporting direction of the printing plate, on the flat portions 226A, 226C, 226E, and 226G.

The aperture portions 230 are formed aligned in the transverse direction and transporting direction on the left hand side of the guide ribs 228 on the flat portions 226B, 226D, and 226F. As a result, when looked at in plan view, the aperture portions 230 are formed in a zigzag pattern in the top surface of the guide plate 220. Note that the rectangular holes 232 of the aperture portions 230 formed in the flat portions 226A, 226B, 226F, and 226G are formed so as to be opened extending down into the respective flat portions 226B, 226C, 226E, and 226F below each rectangular hole 232.

Rollers 222 are able to be mounted in each of the aperture portions 230 arranged in this way. As is shown in FIG. 7, the rollers 22 are provided with barrels 236 formed from resin having a high chemical resistance and high abrasion resistance such as, for example, 6 nylon, or the like. An enlarged diameter portion 238 is formed in the central portion in the axial direction of the barrel 236, and a rotation shaft 240 is shaped protruding from the enlarged diameter portion 238. Note that the axial central portion of the barrel 236 is hollow.

The enlarged diameter portion 238 of the barrel 236 is covered by a covering member 242 formed from a resin rubber such as silicon rubber or the like. The covering member 242 is formed substantially in a cylindrical shape and has an enlarged width portion formed inside it to match the enlarged diameter portion 238 of the barrel 236. The roller 222 is formed so that, by elastically deforming the covering member 242, the enlarged diameter portion 238 of the barrel 236 can be fitted inside the enlarged width portion 244 of the covering member 242.

The adaptor 224 into which the roller 22 is loaded is formed from resin having a high chemical resistance and high abrasion resistance such as, for example, 12 nylon, or the like. The adaptor 224 is formed substantially in a U shape in which a pair of leg portions 246 are connected by a bottom plate 248. A bearing portion 250 is formed in each of the pair of leg portions 246. The bearing portions 250 are formed by cutting a substantially U shaped notch from the top edge (the edge portion at the top side of the sheet of paper depicting FIG. 2) of each leg portion 246. The bottom portion of the bearing portions are formed in an arc shape having substantially the same diameter as that of the rotation shaft 240. By inserting both ends of the rotation shaft 240 in the bearing portions 250, the roller 222 is rotatably supported in a state of suspension between the leg portions 246.

Note that protruding portions 252 are formed at predetermined positions on the inner surface of the bearing portions 250. These protruding portions 252 prevent the rotation shaft 240 of the roller 222 from inadvertently jumping out from the bearing portion 250.

Semicircular cylindrically shaped receiving portions 254 open at the top side thereof are formed in each leg portion 246 extending outwards from the bearing portions 250 in the axial direction of the roller 222. The internal diameter of these receiving portions 254 is the same as the internal diameter of the bottom portion of the bearing portions 250, and the receiving portions 254 extend from the leg portions 246 coaxially with the bearing portions 250. The rotation shaft 240 of the roller 222 is supported by being placed on the respective bearing portions 250 and receiving portions 254.

Claw portions 256 are formed on the top end of the leg portions 246 in the adaptor 224. These claw portions 256 project outwards in a direction orthogonal to the axial direction of the roller 222.

Figure 8A:
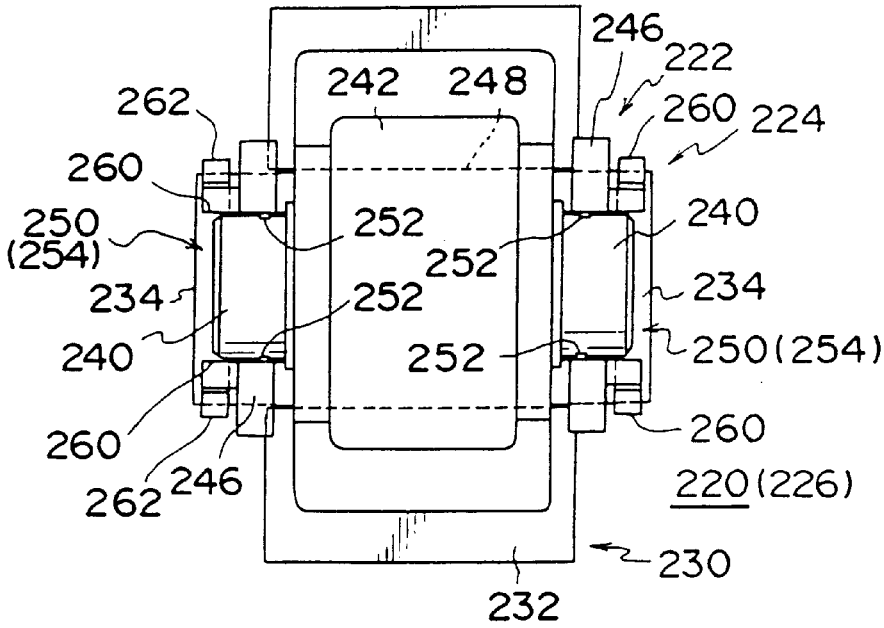
FIGS. 8A and 8B show states when the roller and adaptor are loaded in the guide plate.
Figure 8B:
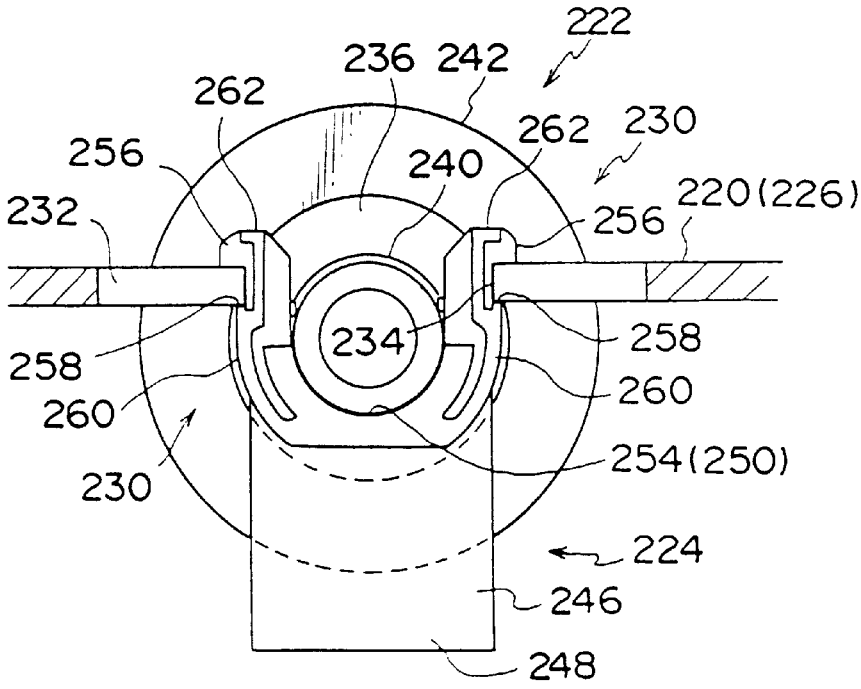

As is shown in FIGS. 8A and 8B, when a roller 222 is mounted in the guide plate 220, the leg portions 246 of the adaptor 224 are inserted in a cutout portion 234. As a result, the roller 222 is placed inside the aperture portion 230 and the claw portions 256 abut against the peripheral edge portions of the rectangular holes 232.

As is shown in FIG. 7 and FIG. 8B, a claw portion 258 is provided in the adaptor 224 below the claw portion 256 and facing the claw portion 256. This claw portion 258 is formed in the central portion of an arm portion 260 extending in a circular arc along the peripheral surface of the receiving portion 254 from the bottom side of the receiving portion 254.

As a result, when the adaptor 224 is inserted in an aperture portion 230, the adaptor 224 nips the peripheral edge portion of the aperture portion 230 between the claw portion 256 of the leg portion 246 and the claw portion 258 of the arm portion 260, and is fixed to the guide plate 220 with the roller 222 in an axially supported state.

The arm portion 260 extends upwards from the receiving portion 254 side of the claw portion 258, and a clip portion 262 is provided at the top end thereof. As is shown in FIG. 8B, when the adaptor 224 is inserted into the aperture portion 230, the clip portion 262 protrudes, together with the claw portion 256 of the leg portion 262, to the top surface side of the flat portion 226. Moreover, by swinging the pair of arm portions 260 in a direction in which both clip portions 262 approach each other, the claw portions 258 provided in the central portion are moved from the peripheral edge portion of the aperture portion 230 to the inside of the aperture portion 230, and are withdrawn from a position facing the claw portions 256.

The adaptor 224 is able to be pulled out from the aperture portion 230 by this withdrawal of the claw portion 258.

In the guide plate 220, the roller 222, and the adaptor 224 having the above described structures, when the adaptor 224 in which the roller 222 has been loaded is mounted in the aperture portion 230, the outer peripheral portion of the roller 222 protrudes above the top edge of the guide ribs 228. As a result, by mounting the roller 222 in the guide plate 220, the printing plate is able to be transported while being supported in contact with the roller 222.

Moreover, because the guide plate 220 is formed with the plurality of flat portions 226, in which the aperture portions 230 are formed, forming a series of steps protruding downwards, when the rollers 222 are mounted in the transporting direction of the printing plate, it is possible to form a substantially U shaped transporting path due to the rollers 222 protruding above the top edge of the guide ribs 228.

Figure 9A:
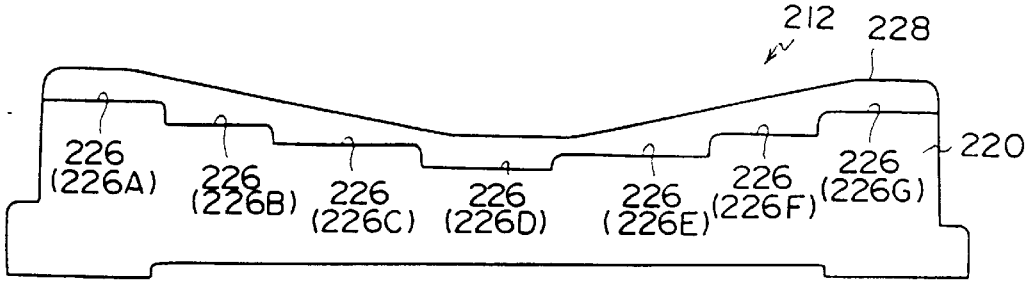
FIGS. 9A to 9D are schematic views showing examples of the application of guide formed using a guide plate or a guide plate and rollers.

In this way, as is shown in FIG. 9A, when no rollers 222 are mounted, the guide plate 220 can be used as a guide 212 capable of forming a transporting path for a printing plate due to the guide ribs 228. Moreover, in the guide plate 220, by mounting rollers 222 in the aperture portions 230 in the flat portions 226 formed in steps, a transporting path for guiding a printing plate can be formed using the rollers 222 or the rollers 222 and the guide ribs 228.

Figure 9B:
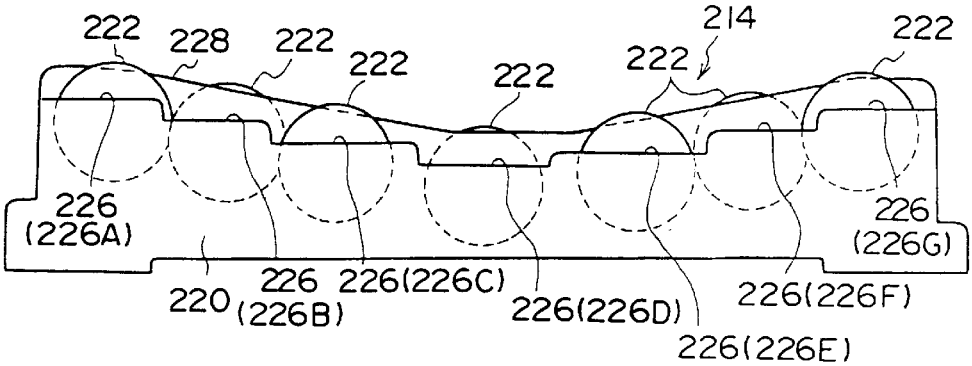
Figure 9C:
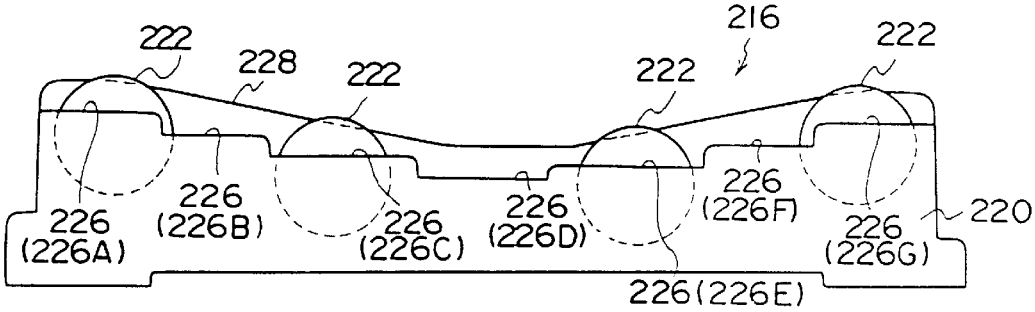
Figure 9D:
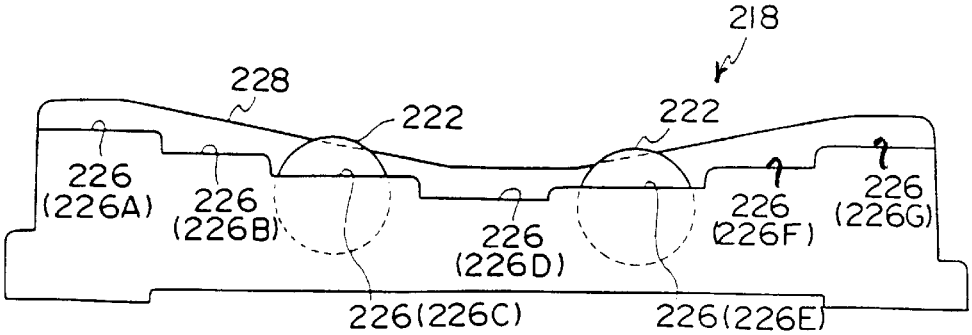

Namely, as is shown in FIGS. 9B, 9C, and 9D, by mounting rollers 222 in optionally positioned aperture portions 230 from among the aperture portions 230 arranged in the transporting direction of the printing plate and in a zigzag pattern at predetermined intervals in the transporting direction in the guide plate 220, it is possible to selectively form guides 214 and 216 for transporting and guiding a printing plate using the rollers 222 (FIGS. 9B and 9C) and a guide 218 for guiding a printing plate using the rollers 222 and the guide ribs 228 (FIG. 9D).

Furthermore, in the adaptor 224 for mounting a roller 222 in the guide plate 220, not only can the roller 222 be installed and removed, but, by swinging the arm portions 260 so as to pinch together the clip portions 262, the state in which the adaptor 224 is fixed to the peripheral edge portion of the aperture portion 230 is released and the adaptor 224 can be pulled out from the aperture portion 230. As a result, if, for example, the claw portions 256 or 258, or the arm portions 260 or leg portion 246 of the adaptor 224 are damaged by being broken or the like, it is possible to replace only the adaptor 224 without having to replace the guide plate 220, thereby simplifying the maintenance of the guides forming the printing plate transporting path.

An applied example of a photosensitive material processing device that forms a printing plate transporting path using the guide plate 220 or rollers 222 will be described below.

GUIDE STRUCTURE APPLIED EXAMPLE 1

Figure 10:
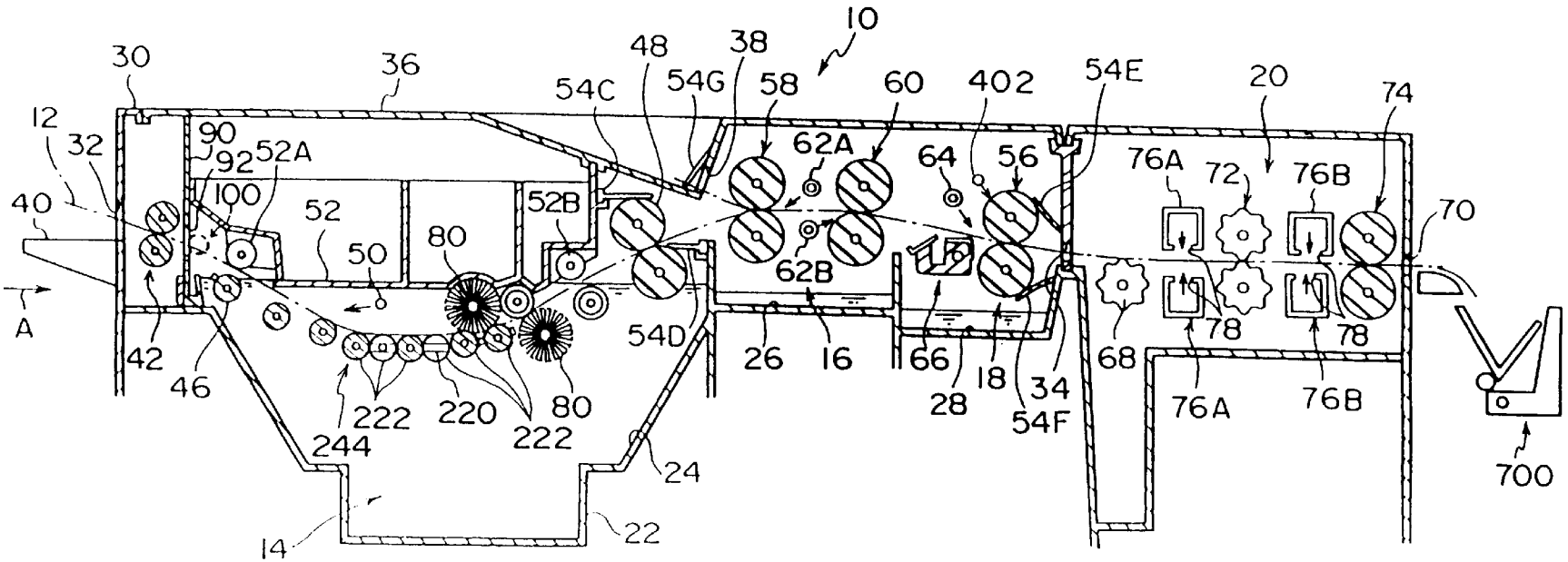
FIG. 10 is a schematic structural view of an automatic developing device according to applied example 1 of the guide structure.

The schematic structure of an automatic developing device 210 which is a photosensitive material processing device according to applied example 1 is shown in FIG. 10.

In the automatic developing device 210, those members that are the same as in the automatic developing device 10 shown in FIG. 1 are given the same descriptive symbols and a description thereof is omitted.

A guide 244 is provided at the bottom side of the transporting path of the PS plates 12 in the developing tank 24 of the automatic developing device 210 having the above structure. The guide 244 is formed with rollers 222 mounted in a guide plate 220. The number of guide plates 220 corresponds to the transverse dimensions of the PS plate 12 being processed in the automatic developing device 210 and the guide plates 220 are arranged in line in a direction orthogonal to the transporting path (omitted from the illustrations).

Namely, the guide 244 provided in the developing tank 24 is formed from rollers 222 mounted in respective aperture portions 230 formed in the flat portions 226A to 226G of the guide plate 220 (FIG. 9B).

As a result, the PS plate 12 is transported in a state where it does not make contact with the surface of the guide plate 220 so that, for example, even if the PS plate 12 has photosensitive layers formed on both front and rear surfaces thereof, damage caused by the photosensitive layer making contact with the front surface of the guide plate 220 can be prevented.

GUIDE STRUCTURE APPLIED EXAMPLE 2

Figure 11:
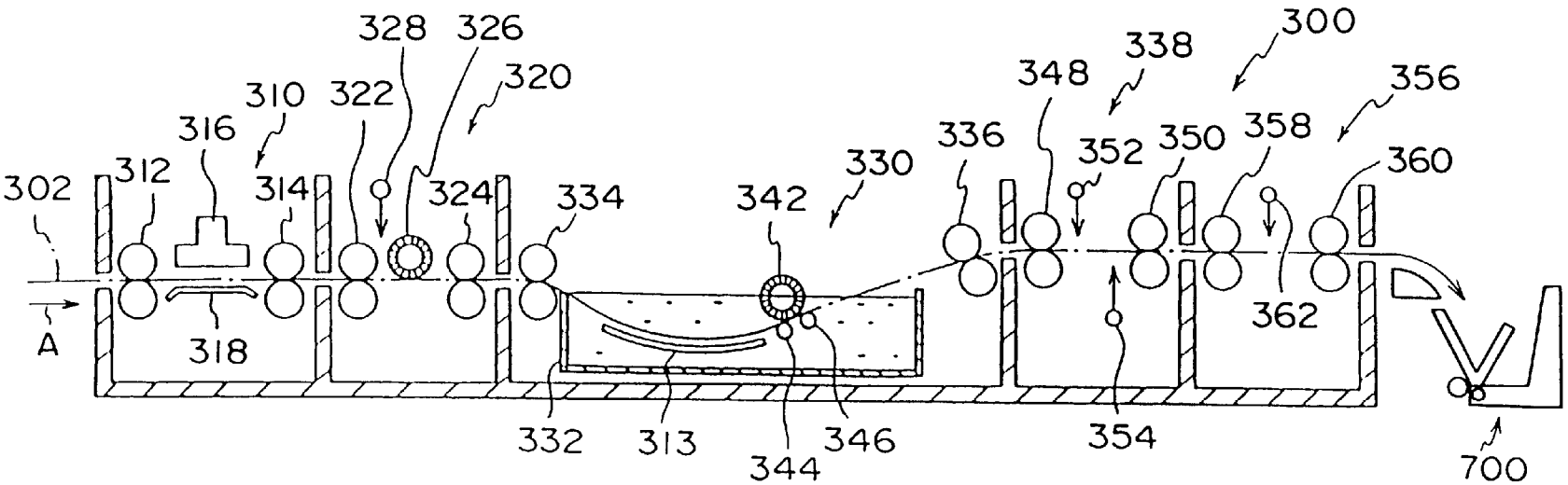
FIG. 11 is a schematic structural view of an automatic developing device according to applied example 2 of the guide structure.

Next, the schematic structure of an automatic developing device 300 according to Applied Example 2 is shown in FIG. 11 as Applied Example 2 of the guide structure. In this automatic developing device 300, a photopolymer plate 302 is processed as the printing plate.

In the photopolymer plate 302, a photosensitive layer is formed by superposing a photo bonding layer, a photopolymer layer, and an overcoat layer on a substrate formed from aluminum plate.

The photopolymer plate 302 on which an image has been exposed is fed to a preheating section 310 positioned at the left hand side in FIG. 11. Two pairs of transporting rollers 312 and 314 for transporting the photopolymer plate 302 while holding it horizontal are provided in the preheating section 310, with a heater unit 316 provided between the two pairs of rollers. A guide plate 318 is provided below the transporting path of the photo polymer plate 302 opposite the heater unit 316 and maintains a constant distance between the heating surface of the heater unit 316 and the photopolymer plate 302. When the photopolymer plate 302 is heated by the heater unit 316, the degree of the polymerization of the light receiving portion of the photopolymer layer is increased and an improvement in the printing durability is achieved.

A prewashing section 320 is provided downstream of the preheating section 310. When the photopolymer plate 302 has finished the preheating process, it is fed horizontally to the prewashing section 320.

Two pairs of transporting rollers 322 and 324 for transporting the photopolymer plate 302 while holding it horizontal are provide in the prewashing section 320, and a brush roller 326 is provided above the transporting path between the two pair of rollers. Moreover, a spray pipe 328 for spraying water at the transporting path of the photopolymer plate 302 is provided slightly upstream of the brush roller 326. Here, when water is sprayed from the spray pipe 328 and photopolymer plate 302 is transported while the brush roller 326 is rotating (in the counter clockwise direction in FIG. 11), the topmost layer which is the overcoat layer of the photopolymer plate 302 is moistened and removed by the brush roller 316.

A developing section 330 is provided downstream from the prewashing section 320. A storage tank 332 in which developing solution is stored is provided in the developing section 330. By immersing the photopolymer plate 302 in this developing solution, the non-light receiving areas of the photopolymer layer are swelled. The non-light receiving areas are then removed.

Pairs of transporting rollers 334 and 336 are provided in the vicinity of the insertion aperture and the discharge aperture respectively of the developing tank 330. The transporting roller pair 334 guides the photopolymer plate 302 to the storage tank 332, while the transporting roller pair 336 guides the photopolymer plate 302 to the rinse section 338 of the next step.

A brush roller 342 is provided above the transportation path of the photopolymer plate 302 in the storage tank 332. A pair of receiving rollers 344 and 346 are provided below the transporting path opposite the brush roller 342. The photopolymer plate 302, which is transported through the storage tank 332, is nipped between the brush roller 342 and the receiving rollers 344 and 346 such that the brush roller 342 touches the photopolymer layer with a predetermined pressure, thereby removing the non-light receiving areas (i.e. the unexposed areas) of the photopolymer layer by brushing. Specifically, the unnecessary non-light receiving portions in the boundary areas between light receiving areas and non-light receiving areas are reliably removed by the brush roller 342.

Two pairs of transporting rollers 348 and 350 for transporting the photopolymer plate 302 while holding it horizontal are provided in the rinse section 338. Spray pipes 352 and 354 are provided respectively above and below the transporting path between the pairs of transporting rollers 348 and 350. Washing water is sprayed from the spray pipes 352 and 354.

When the photopolymer plate 302 that has been discharged from the developing section 330 passes through the rinse section 338, the front and rear surfaces thereof are washed by water sprayed from the spray pipes 352 and 354, and the photopolymer plate 302 is fed to the finisher section 306 which is the next step.

Two pairs of transporting rollers 358 and 360 for transporting the photopolymer plate 302 while holding it horizontal are provided in the finisher section 356. A spray pipe 362 is provided above the transporting path between the pairs of transporting rollers 358 and 360. Finisher solution (desensitizing solution) is sprayed from the spray pipe 362 onto the photopolymer plate 302 as it is being transported by the pair of transporting rollers 358 and 360. As a result, the image forming surface of the photopolymer plate 302 is coated with finisher solution.

In the automatic processing device 300 having the above described structure, a guide 313 that uses the guide plate 220 is provided in the storage tank 332. As is shown in FIG. 9A, this guide 313 is used in a state in which the rollers 222 are not mounted in the guide plate 220.

As a result, the photopolymer plate 302 transported into the storage tank 332 is transported along a shallow arc shaped path through the developing solution while being supported by the guide ribs 228 formed in the guide plate 220, and is guided between the brush roller 342 and the receiving rollers 344 and 346.

In this way, rollers 222 can be mounted at optional positions in the guide plate 220 in which the present invention has been applied and, at the same time, because the guide ribs 228 have been provided, it is possible to form a transporting path for the printing plate without using the rollers 222.

As a result, a single structure can be used for variously configured automatic developing devices including the automatic developing devices 210 and 300, and it becomes possible to lower the cost of the guide provided in the automatic developing device.

Further, the adaptor 224 used when mounting a roller 222 in the guide plate 220 can be mounted in or removed from the guide plate 220 together with the roller 222, and the roller 222 can also be removed from the adaptor 224. Therefore, if the adaptor 224 is damaged, it is possible to replace only the damaged adaptor, therefore, not only is maintenance simplified, but a reduction in the maintenance costs can be achieved.

Specifically, if the roller 222 is mounted directly in the guide plate 220, then if the bearing of the roller 222 provided in the guide plate is damaged, either the guide plate needs to be removed and the damaged portion repaired, or the guide plate needs to be replaced. In the guide structure of the present invention, because the adaptor 224 can be mounted in or removed from the guide plate 220, it is sufficient to simply remove the adaptor 224 from the guide plate 220 and perform the replacement.

Note that, the embodiment of the guide structure described above does not limit the structure of the present invention. In the present embodiment of the guide structure, a description was given of an example of an automatic developing device for processing a printing plate such as the PS plate 12 and the photopolymer plate 302, however, the present invention is not limited to a printing plate and can be applied to a guide used in a photosensitive material processing device for processing other photosensitive materials such as films or printing paper for guiding the photosensitive material along a predetermined transporting path.

A description will now be given of the brush rollers 126 and 142 provided in the automatic developing device 300 shown in FIG. 11. Note that, because the basic brush roller is the brush roller 342 used in the developing section 330, the brush roller 342 for the developing section 330 will be described in the example.

Figure 12:
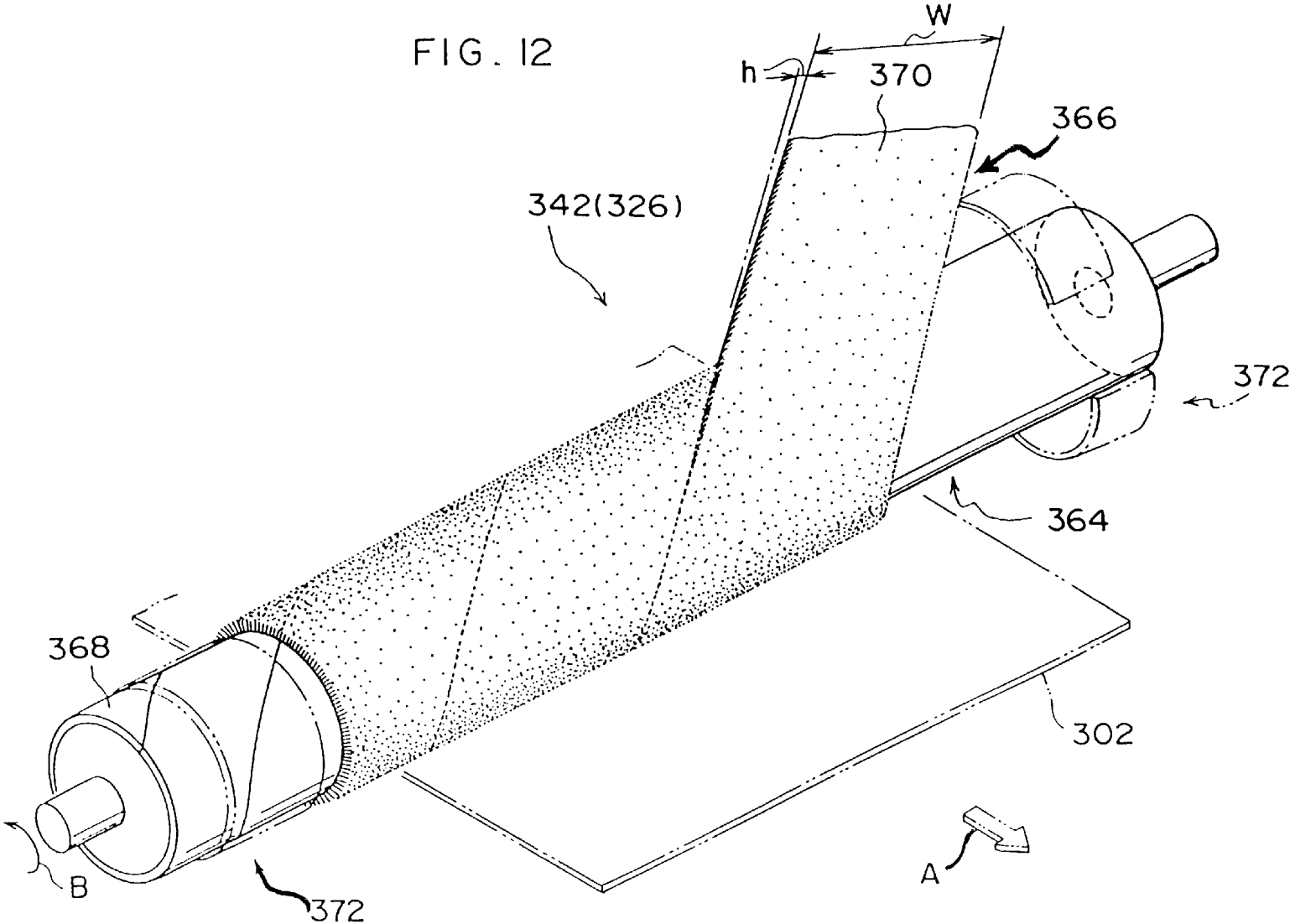
FIG. 12 is a schematic perspective view showing a brush roller used in the embodiment shown in FIG. 1.

As is shown in FIG. 12, the brush roller 342 is formed from a roller body 364 that serves as a core material and a belt shaped belt body 366 (referred to below simply as the belt body 366) used for brushing that is wound around the outer peripheral portions of the roller body 364.

Figure 13A:
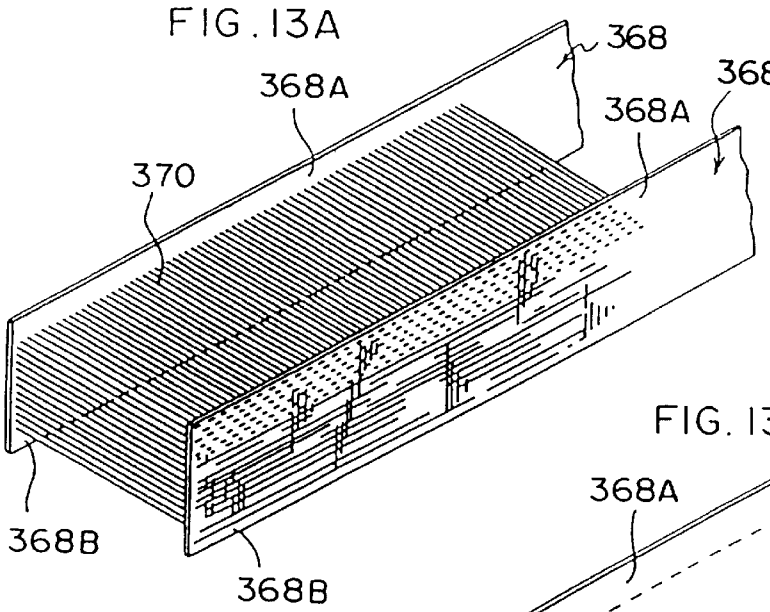
FIGS. 13A to 13D are flow diagrams showing an example of the manufacturing process of a belt body used in the present embodiment.
Figure 13B:
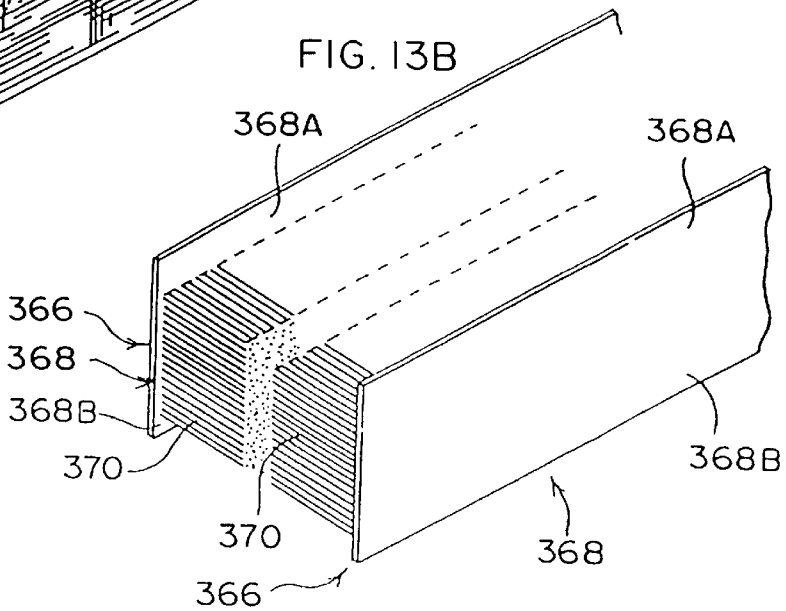
Figure 13D:
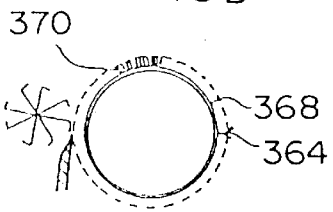
Figure 13C:
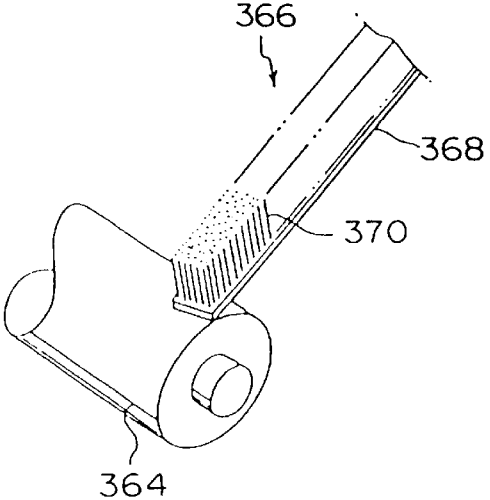

As is shown in FIG. 13A, in the belt body 366, firstly, a pair of fabric materials 368 that function as sheet shaped base materials are held facing each other. A brush hair material 370 is then interwoven therebetween so as to be suspended between the fabric materials 368.

A pile serving as, for example, a natural fiber or an artificial fiber is used for the brush hair material 370. Note that, provided it has a suitable thinness, the brush hair material 370 may also be formed from a metal. In addition, the fabric materials 368 are not limited to natural fibers or artificial fibers, but may also be formed from thin metal. Namely, as the material used for the brush hair material 370, natural fibers such as plant fibers and animal fibers, artificial fibers such as polyamide systems such as nylon 6, nylon 66, nylon 6•10, polyester systems such as polyethylene terephthalate and polybutylene terephthalate, polyacrylic systems such as polyacrylonitrile, polyalkyl acrylate, polypropylene, and polystyrene, and metallic fibers such as stainless steel and brass may be applied.

After the brush hair material 370 has been interwoven under tension with the fabric material 368, the brush hair material 370 is cut in the central portion thereof, thereby providing the belt body 366 (FIG. 13B) used in the present embodiment. After this belt body 366 has been wound in a spiral around the peripheral surface of the roller 364 (FIG. 13C), a shirring process is then carried out so that the length of the brush hair material is made uniform (FIG. 13D), thereby providing the brush roller 342.

As is shown in FIG. 12, by winding a fastening band 372 around both end portions of the roller body 364, the fabric material 368, which is the base material of the belt body 366 is fixed at both end portions of the roller body 364.

Note that, when fixing the belt body 366 to the roller body 364 by the fastening band 372, it is possible to fix the belt body 366 by fastening it using the fastening band 372 with the brush hair material 370 in its woven state. Alternatively, it is possible to trim the brush hair material 370 in a predetermined area at both end portions opposite the fastening band 372 by shirring or the like. Moreover, it is also possible to form the belt body 366 without weaving in advance the brush hair material 370 in those areas opposite both end portions of the roller body 364 (FIG. 12).

Furthermore, when fixing the belt body 366 to the end portions of the roller body 364 using the fastening band 372, it is preferable if the fabric material 368 is temporarily tacked by coating a slight amount of an adhesive agent to the rear surface side of the fabric material 368 that is opposite the peripheral surface of the shaft end portions of the roller body 364.

It should be noted also that, because no small number of gaps are formed between the fabric material 368 wound around the roller body 364 even when the photopolymer plate 302 is brushed using the brush rollers 342 and 326 formed as described above, sometimes the rubbing of the surface of the photopolymer plate 302 is uneven.

Therefore, in the automatic developing device 300, with the brush roller 342 provided in the developing section 330 as an example, by selecting various alterable parameters relating to brush roller 342 and the photopolymer plate 302, and setting those parameters in a suitable range, it is possible to suppress the unevenness in the rubbing of the photopolymer plate 302 from occurring.

Figure 14:
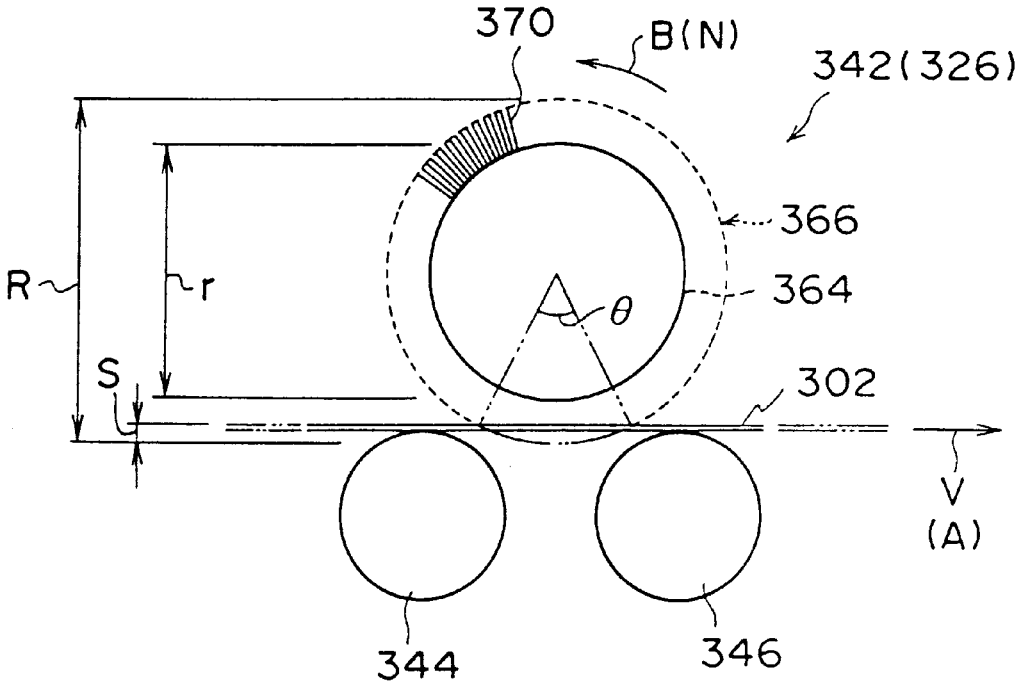
FIG. 14 is a schematic view showing the brushing of a photopolymer plate using a brush roller.

As is shown in FIG. 14, when a predetermined position of the photopolymer plate 302 is rubbed by the brush roller 342, the brush hair material 370 of the brush roller 342 makes contact within the angle range 0. At this time, in order to suppress the rubbing unevenness caused by gaps between the fabric material 368 wound around the roller body 364 from standing out as winding marks on the surface of the photopolymer plate 302, the gaps between the fabric material 368 should be narrow.

From this, the parameters that affect the rubbing unevenness comprise the following: (i) the transporting speed V (mm/sec) of the photopolymer plate 302; (ii) the number of revolutions N (r/sec) of the brush roller 342; (iii) the size of the outer diameter R (mm) of the brush roller 342; (iv) the size of the shaft diameter r (mm) which is the size of the outer diameter of the roller body 364; and (v) the pressing amount S (mm) of the brush hair material 370, which is the size of the bending of the brush hair material 370 when the brush roller is pushed from a state of being in contact with the photopolymer plate 302 to a state in which it is brushing the photopolymer plate 302.

Figure 16A:
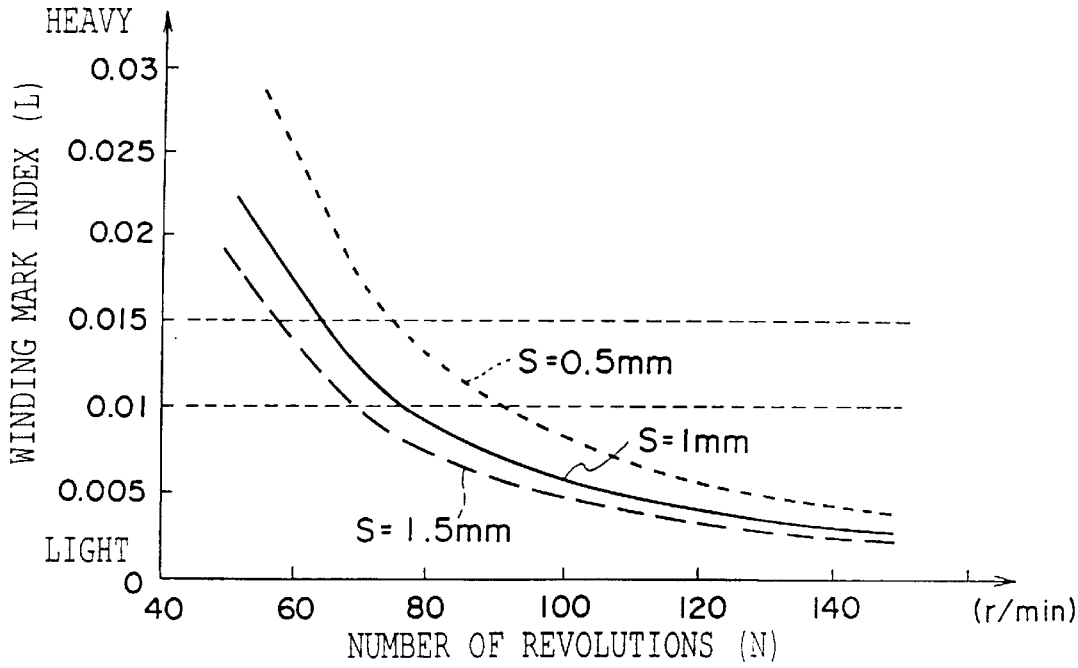
FIGS. 16A and 16B are line graphs showing a winding mark index relative to the number of revolutions with the respective indentation amount as references.

Here, if the extent of the rubbing unevenness generated as winding marks on the surface of the photopolymer plate 302 when the photopolymer plate 302 is brushed is set as a winding mark index L, then, for example, the width W of the belt shaped member 366 is set at 50 mm, the interval h between the belt shaped member 366 is set at 2 mm, the size of the outer diameter R of the brush roller 342 is set at 40 mm, the size of the shaft diameter r of the roller body 364 is set at 29 mm, and the transporting speed V of the photopolymer plate 302 is set at 1120 mm/sec. Under these conditions, if the pressing amount S is set at the three conditions of 0.5 mm, 1.0 mm, and 1.5 mm, then, under these respective condition, if the number of revolutions N (15 r/sec) of the brush roller 342 is changed within a predetermined range (for example, a range from 40 (r/min) to 160 (r/min), wherein 1 r/min=60 r/sec), the results shown in FIG. 16A are obtained. Note that, in FIG. 16A, the number of revolutions N is shown as the number of revolutions per minute.

Namely, the winding mark index L gradually increases as the number of revolutions N decreases. Moreover, the larger pressing amounts S enable the winding mark index L to be reduced compared with when the pressing amount S is small.

Figure 16B:
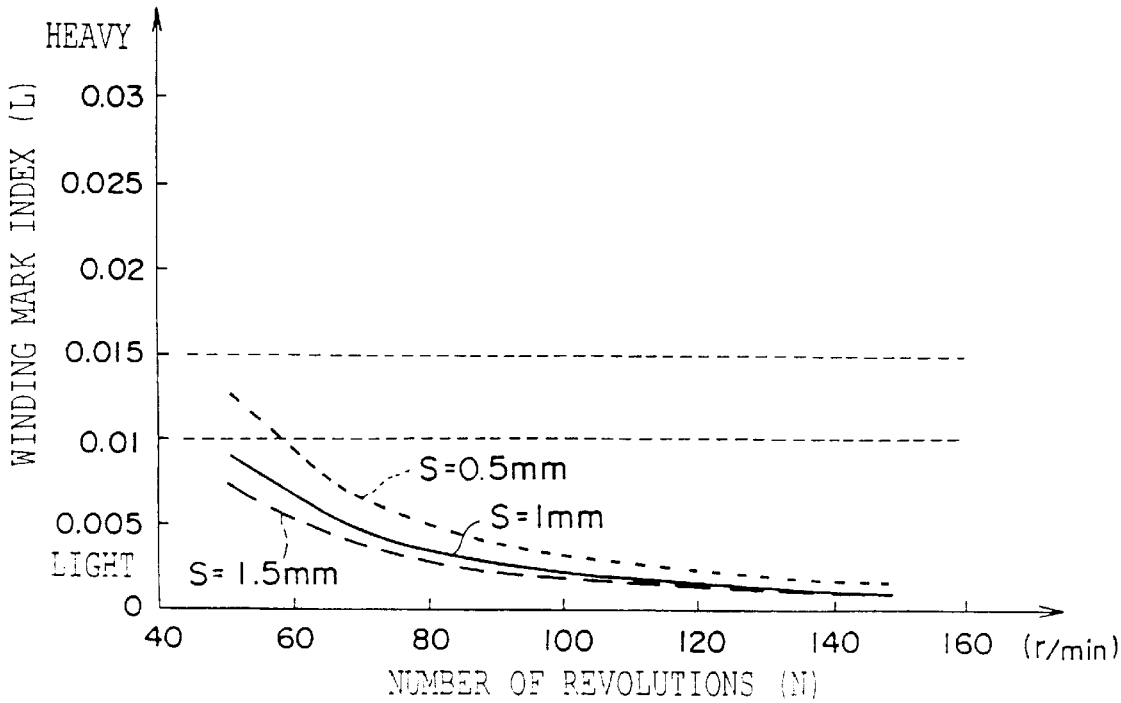

Further, the interval h between the belt shaped member 366 is set at 2 mm, the size of the outer diameter R of the brush roller 342 is set at 40 mm, the size of the shaft diameter r of the roller body 364 is set at 29 mm, and the transporting speed V of the photopolymer plate 302 is set at 1120 mm/sec, which are the same as in the above example. Next, under conditions in which the width W of the belt shaped member 366 has been changed to 70 mm, the pressing amount S is set at the three conditions of 0.5 mm, 1.0 mm, and 1.5 mm. Under these respective conditions, by changing the number of revolutions N (r/sec) of the brush roller 342 within a predetermined range (for example, a range from 40 (r/min) to 160 (r/min)), the results shown in FIG. 16B are obtained.

As was shown in the previous FIG. 16A, in this case too, the winding mark index L gradually decreases as the number of revolutions N increases. Moreover, by increasing the pressing amount S, the winding mark index L can be reduced. Furthermore, by increasing the width of the belt shaped member 366, the entire winding mark index L is decreased.

In this way, on the basis of the results of experiments when the photopolymer plate 302 is brushed while each of the above parameters is appropriately changed, the result is obtained that it is possible to represent the winding mark index L by the formula shown below using the above parameters.

$$L = \frac{180 \cdot h \cdot V \cdot \sqrt{(\pi r)^2 - (W+h)^2}}{\pi R(W+h)N \cdot \cos^{-1}(1-2s/R) \cdot \sqrt{[\pi r(W+h)N]^2 + V^2[(\pi r)^2 - (W+h)^2]}}$$

Figure 15:
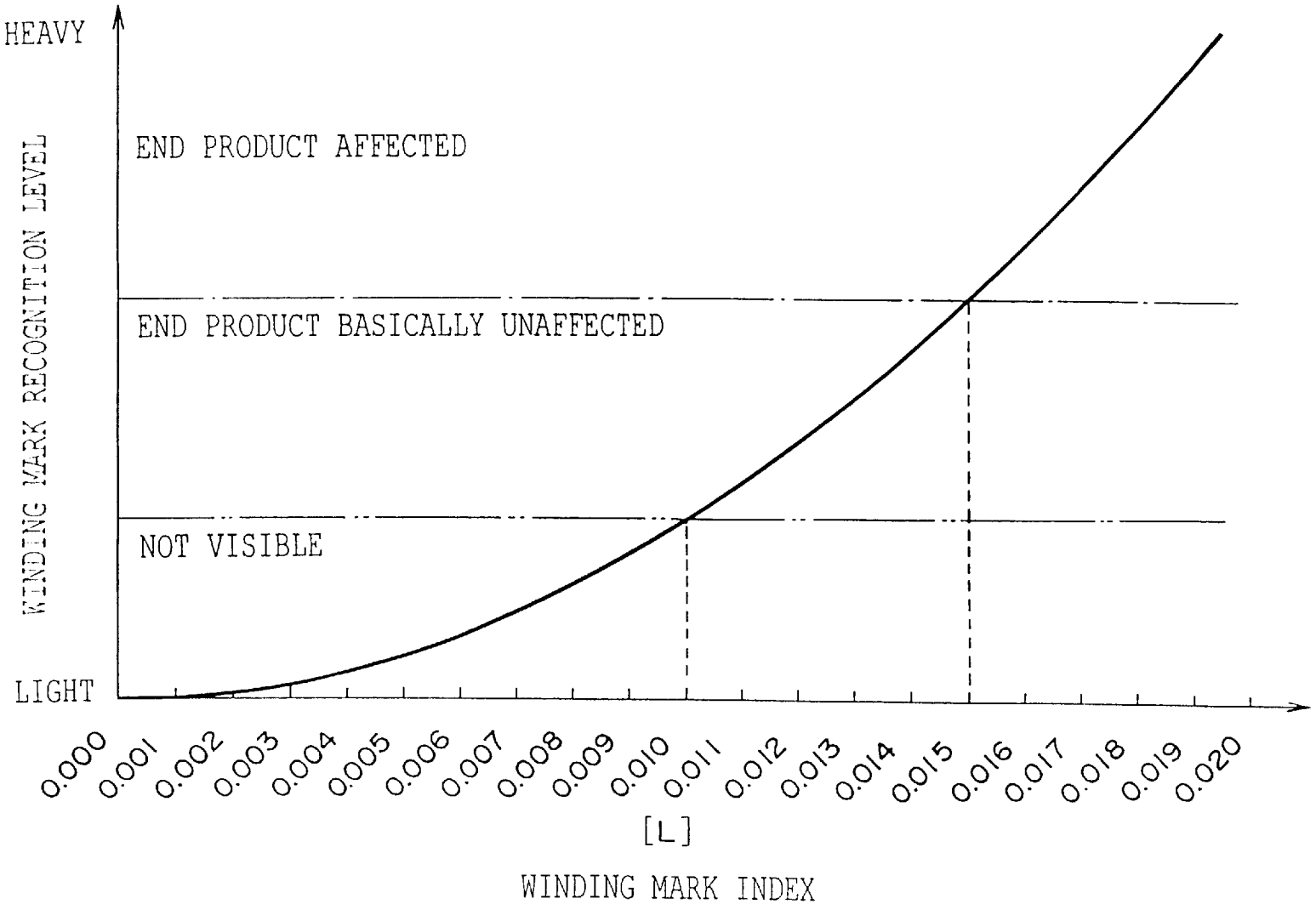
FIG. 15 is a line graph showing the relationship between winding marks and a winding mark index.

A result is also obtained in which the winding mark index L obtained by the above formula is associated with the winding mark visibility level (FIG. 15).

Namely, the winding marks (rubbing unevenness) occur in no small number as long as there are gaps h present in the fabric material 368 (i.e. 0>h), however, whether or not these winding marks can be confirmed on the photopolymer plate 302 depends on the extent of the winding marks. It is possible to divide the extent of the winding marks into three ranges, namely, a range in which the winding marks are not visible and it can be considered that, for practical purposes, there are no winding marks, a range in which the winding marks are visible, however, it can be considered that, for practical purposes, there is no effect on the completed photopolymer plate 302, and a range in which the winding marks end up marring the product quality of the photopolymer plate 302.

In this case, what is necessary in the automatic developing device 300 is at least the fact that the winding marks do not have an effect on the product quality of the photopolymer plate 302, and more preferably, that the winding marks can be suppressed to the extent where they cannot be confirmed (are not visible) on the photopolymer plate 302.

As is shown in FIG. 15, when the winding mark index L is equal to or less than 0.01, the winding marks are not visible. When the winding mark index L exceeds 0.01, the winding marks become visible, however, as long as the winding mark index is equal to or less than 0.015, for practical purposes, there is no effect on the product quality of the photopolymer plate 302.

Accordingly, it is preferable that the winding mark index L is $0<L\leqq 0.015$, and more preferable that the winding mark index L is $0<L\leqq 0.010$. In the automatic developing device 300, the winding mark index L is set so as to fall within the above range.

Examples of the settings of the respective parameters based on the winding mark index L are described below.

EXAMPLE 1

The processing time of the photopolymer plate 302 in the automatic developing device 300 is determined by the structure of each processing step, the processing capabilities of the developing solution and the like, and so on. The transporting speed V is determined when the processing time is determined. In this case, the transporting speed V of the photopolymer plate 302 is set at V=23.3 (mm/sec).

The width W of the belt shaped member 366 is then set at 70 mm, the interval h is set at 2 mm, the external diameter R of the brush roller 222 is set at 40 mm, and the shaft diameter r is set at 29 mm. The pressing amount S is able to be set at an arbitrary value within a predetermined range (for example, 0.5 mm to 2.0 mm).

In a case such as this, because the worst conditions are when the pressing amount S is the smallest (S=0.5 mm), it is preferable if the number of revolutions N (r/min) is equal to or more than 58.2 r/min (i.e. when $0<L\leqq 0.015$, then $N\geqq 58.2$ r/min), and more preferable if the number of revolutions N (r/min) is equal to or more than 71.5 r/min (i.e. when $0<L\leqq 0.01$, then $N\geqq 71.5$ r/min).

BRUSH EXAMPLE 2

In the first brush example, when considering the dispersion of the respective parameters, in order to lower the winding mark index L, it is desirable that the width W is large and that the gap h is small. It is also preferable that the outer diameter R is large and that the shaft diameter r is small. It is also desirable that the transporting speed V is slow.

On order, here, to guarantee stability, the respective parameters are worsened by 10% (so that W=63 mm, h=2.2 mm, R=36 mm, r=31.9 mm, and V=1540 mm/min (26.6 mm/sec)), and because it is also desirable if the number of revolutions N is higher, when a 10% leeway is given to the number of revolutions N, it is preferable if the number of revolutions N (r/min) is equal to or more than 84.6 r/min (i.e., when $0<L\leqq 0.015$, then $N\geqq 84.6$ r/min), and more preferable if the number of revolutions N (r/min) is equal to or more than 104 r/min (i.e. when $0<L\leqq 0.01$, then $N\geqq 104$ r/min).

BRUSH EXAMPLE 3

When the range of error of the parameters is set (for example, as a tolerance) in the first brush example, then when the number of revolutions N is set, the number of revolutions N may be set in the worst conditions in each of the parameters.

For example, when making the following settings, namely, when W=70±2 mm, then W=68 mm; when h=2±1 mm, then h=3 mm; when R=40±1 mm, then R=39 mm; when r=29±0.5 mm, then R=29.5 mm; when V=1400±70 mm/min (5%), then V=1470 mm/min, then it is preferable if the number of revolutions N (r/min) is equal to or more than 78.4 r/min (i.e., when $0<L\leqq 0.015$, then $N\geqq 78.4$ r/min), and more preferable if the number of revolutions N (r/min) is equal to or more than 96.2 r/min (i.e. when $0<L\leqq 0.01$, then $N\geqq 96.2$ r/min).

BRUSH EXAMPLE 4

When the conditions on the automatic developing device 300 side and the conditions of the brush roller 342 are decided, the parameters that can be adjusted are the width W of the belt shaped member 366 and the interval h when it is wound on.

In this case, for example, the settings are taken as the outer diameter R=40±1 mm, the shaft diameter r=29±0.5 mm, the transporting speed V=1400±70 mm/min, the number of revolutions N=90±5 r/min, and the pressing amount $S=0.5\text{ mm}\leqq S\leqq 2.0\text{ mm}$.

At this time, if the interval h=1±0.5 mm, then it is preferable if the width W is equal to or more than 50.5 mm (i.e. when $0<L\leqq 0.015$, then $W\geqq 50.5$ mm), and more preferable if the width W is equal to or more than 56.6 mm (i.e. when $0<L\leqq 0.01$, then $W\geqq 56.6$ mm).

If the interval h=2±1 mm, then it is preferable if the width W is equal to or more than 64.6 mm (i.e. when $0<L\leqq 0.015$, then $W\geqq 64.6$ mm), and more preferable if the width W is equal to or more than 73 mm (i.e. when $0<L\leqq 0.01$, then $W\geqq 73$ mm).

Furthermore, if the width W=50±1 mm, then it is preferable if the interval h is $0\text{ mm}<h\leqq 1.3\text{ mm}$ ($0<L\leqq 0.015$), and more preferable if the interval h is $0\text{ mm}<h\leqq 0.9\text{ mm}$ ($0<L\leqq 0.01$).

If the width W=78±1 mm, then it is preferable if the interval h is $0\text{mm}<h\leqq 8.2\text{ mm}$ ($0<L\leqq 0.015$), and more preferable if the interval h is $0\text{ mm}<h\leqq 4\text{ mm}$ ($0<L\leqq 0.01$).

By forming the structure in this way, it is possible to reliably prevent a reduction in the product quality of the photopolymer plate 302, which is undergoing a brushing process using the brush roller 342, being generated by rubbing unevenness caused by gaps in the belt shaped member 366.

Note that, in the present embodiment, a description is given of an example of the brush roller 342 in which a single belt shaped member 366 is wound in a spiral around the roller body 364, however, it is also possible to wind a plurality of belt shaped members in a spiral around the roller body 364. In this case, for example, using f number of belt shaped members having a width w, the width W when these are wound in a spiral having a gap h can be set as $W=w\cdot f+h\cdot(f-1)$.

Note also that the present embodiment according to the above described brush does not limit the structure of the present invention. The present invention is not limited to the brush roller 342 provided in the developing section 330, and may also be applied to the brush roller 326 provided in the pre-washing section 320. Moreover, the present invention can also be applied to a brush roller provided in processing steps other than these.

Further, in the present embodiment according to this brush, a belt body 366, which is a belt shaped member manufactured by interweaving the brush hairs 370 into a fabric material 368, which is a belt shaped substrate, is used, however, the present invention is not limited to this. For example, another belt shaped member having a brush hair material provided on the surface thereof, such as a belt shaped member on which brush hairs have been flocked on an adhesive by coating an adhesive on a belt shaped substrate and then electrostatically flocking the brush hair material thereon, may be used.

Further, in the present embodiment according to this brush, a description is given of when an automatic developing device 300 for processing photopolymer plates 302 is used, however, the present invention is not limited to photopolymer plates 302, and may be applied to the processing of conventionally known photosensitive planographic printing plates such as thermal plates, waterless planographic printing plates, and the like. Moreover, the present invention is not limited to photosensitive planographic printing plates and can also be applied when using brush rollers in a photosensitive material processing device for processing other photosensitive materials such as X-ray film, normal black and white film, color film, black and white printing paper, color printing paper, and the like. At this time, it is possible to set the determination level of the suitability of the winding mark index L to correspond with the respective photosensitive materials.

(Finisher Solution Control System)

Figure 17:
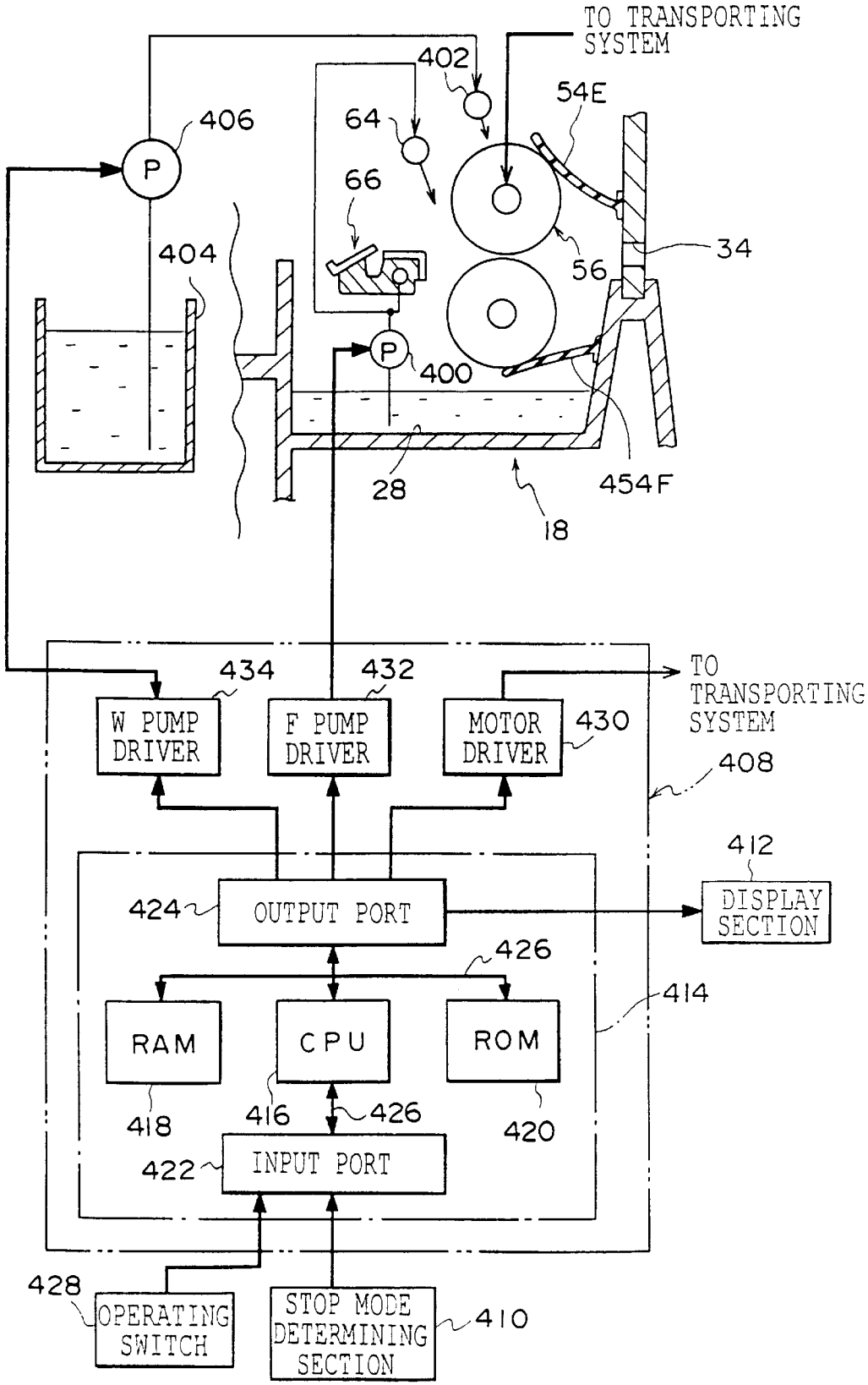
FIG. 17 is a typical view associating an enlarged view of the finisher section of the embodiment shown in FIG. 1 with a block diagram of the finisher solution control device control.

FIG. 17 shows the finisher solution control system in the finisher solution control section 18 (FIG. 1) according to the present embodiment. In this finisher solution control device 408, control of the concentration of the finisher solution and control of the washing of the transporting roller pair 56 is performed.

Because the drying section 20 is located adjacent to the finisher section, a thickening in the concentration of the finisher solution occurs due to evaporation caused by heat from drying section 20 as well as natural evaporation corresponding to the environmental temperature and humidity. In the control of the concentration of the finisher solution, this type of phenomenon is suppressed by supplying dilution water so as to keep the finisher solution constantly at a fixed concentration.

The control of the roller washing is intended to wash the transporting roller pair 56 and remove the finisher solution when the device is stopped so as to prevent finisher solution adhered to the transporting roller pair 56 from drying and hardening due to being exposed to the air for a long period of time and the like and the two rollers of the transporting roller pair 56 consequently sticking to each other, and to prevent finisher solution from becoming a precipitate and adhering to the peripheral surface of the transporting roller pair.

Here, the control of the concentration of the finisher solution and the control of the roller washing are linked by using dilution water for the finisher solution in the roller washing.

As is shown in FIG. 17, a signal from a stop mode determining section 410 is input into the finisher solution control device 408. In this stop mode determining section 410, a mode state, which is set on the basis of display contents displayed in a display section 412 connected to the finisher solution control device 408, is determined. The mode may either be a temporary stop mode for temporarily stopping the operation of the device, or a complete stop mode for completely stopping the operation of the device, and the mode is set by the user. Note that the stopped state of the device is the same in either mode.

The finisher solution control device 408 is provided with a microcomputer 414. The microcomputer 414 is formed from a CPU 416, RAM 418, ROM 420, an input port 422, an output port 424, and buses such as a data bus and control bus or the like connecting the above components together.

Signal wires from the stop mode determining section 410 and an operating switch 428 are connected to the input port 422.

The display section 412 is connected to the output port 424. In addition, signal wires for outputting signals to the transporting system via a motor driver 430 is also connected to the output port 424. Namely, it is possible to rotate a motor for the transporting roller pair 56 by a signal from the finisher solution control device 408 (other rollers rotated by a common drive device are also rotated).

A pump 400 for pumping up finisher solution is also connected to the output port 424 via a finisher (F) pump driver 432. A pump 406 for pumping up dilution water from a water tank 404 via a dilution water (W) pump driver 434 is also connected to the output port 424.

In the finisher solution control device 408, when the operation of the device is stopped, the timing at which the washing of the transporting roller pair 56 is performed is controlled on the basis of the stop mode determined by the stop mode determining section 410.

Namely, because dilution water that is replenished on the basis of the water component evaporated from the finisher solution is used for the water for washing the transporting roller pair 56, there is a limit on the amount that can be used. Therefore, if it is known that the device will be stopped for a long period of time (for example, when the days work has ended and the device will not be operated until the next day), the complete stop mode is selected. In this case, the washing of the transporting roller pair 56 is performed immediately after the operation of the device is stopped. As a result, it is possible to wash the transporting roller pair 56 using an amount of dilution water that corresponds to the amount of the water component that has evaporated during the day, and to replenish the finisher solution with the appropriate amount of dilution water.

If, however, the device is only intended to be stopped for a short length of time (for example, when the device is to be restarted after a stop of approximately one hour for a lunch break), the temporary stop mode is selected. In this case, because the interval until restarting is short, it is determined that there is no need to wash the transporting roller pair 56. Therefore, the washing is not performed at the restart and the consumption of the dilution water is controlled.

It should be noted that, regardless if the intention was only to stop the device for a short time, if the stopped state continues for any reason for a predetermined time (for example, one day 24 hours)), the washing is performed upon restarting. Moreover, after the predetermined time has passed, if the restart is not performed within another predetermined time (for example, 24 hours) (i.e. a total of 48 hours after the stoppage of operation), the washing is performed upon restarting and an alarm message (characters displaying "finishing rollers stuck", for example) is displayed on the display section 412.

The operation of the present embodiment according to the finisher section will now be described.

Figure 18:
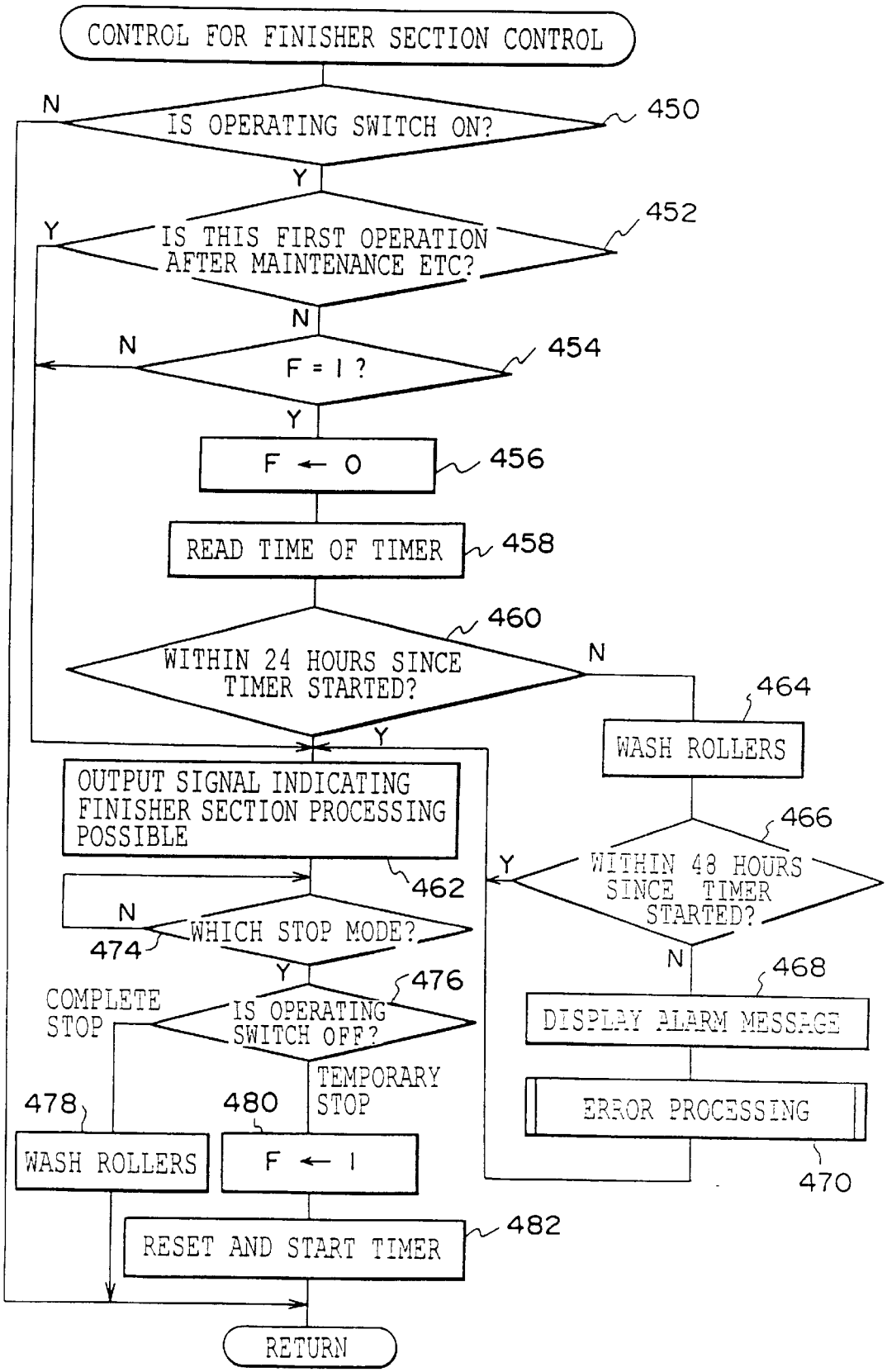
FIG. 18 is a flow chart showing a control routine for the finisher section control.

The washing control (as well as the dilution water supply control) for the transporting roller pair 56 in the finisher section 18 will now be described in accordance with the flow chart in FIG. 18.

Firstly, in step 450, a determination is made as to whether or not the operating switch 428 has changed to ON. If the determination is negative, as the processing of this routine is not necessary, the routine is ended (i.e. proceeds to RETURN). If, however, the determination in step 450 is affirmative, the routine proceeds to step 452. In step 452, a determination is made as to whether or not this is the first operation of the device from a state in which it can be thought that the transporting roller pair 56 has undergone washing, or after maintenance or trouble shooting. If the determination in step 452 is negative, the processing differs depending on the previous stop state. Subsequently, in step 454, the state of the flag F set at the previous operation stoppage is confirmed. Note that, if the flag F is set (i.e. is 1) the stop mode is the temporary stop mode, if the flag F has been reset (i.e. is 0), the stop mode is the complete stop mode.

If, however, the determination in step 454 is affirmative, it is determined that the previous stop mode was the temporary stop mode, and the routine proceeds to step 456. In step 456, after the flag F has been reset, the routine proceeds to step 458 in which the time measured by a timer is read. This timer is started when the operation is stopped in the temporary stop mode.

In the next step 460, a determination is made as to whether or not the current time is within 24 hours since the timer was started. If this determination is affirmative, it is determined that the finisher solution hardened on the transporting roller pair 56 is not precipitated, and the routine proceeds to step 462 where a signal indicating that processing is possible in the finisher section is output to the transporting system and the like. As a result, it is possible to begin the operation of the device. Note that, if the determination in the above step 452 is affirmative (i.e. as to first operation), and the flag F is reset in step 454 (indicating that the previous stoppage was the complete stop mode), the routine proceeds to this step 462.

If it is determined in step 460 that more than 24 hours have passed since the timer was started, a determination is made that finisher solution has hardened and adhered to the transporting roller pair 56, and the routine proceeds to step 464 where washing of the roller is implemented. Next, in step 466, a determination is made as to whether or not the roller washing timing has progressed for another 24 hours after 24 hours since the timer was started (namely, whether or not less than 48 hours have elapsed since the timer was started). If this determination is affirmative, it is determined that, in the above roller washing, the washing of the transporting roller pair 56 was able to be reliably performed, and the routine proceeds to step 462 in which a signal indicating the finisher section is capable of processing is output.

If, however, the determination in step 466 is negative, namely, if it is determined that the roller washing timing has exceeded 48 hours since the timer was started, because it is not possible to say that the washing of the transporting roller pair 56 has been reliably performed in the above roller washing, the routine proceeds to step 468 in which an alarm message is displayed on the display section 412. Note that, at this time, it is possible to stop the transport system and operate the temperature adjustment system.

After error processing (for example, confirmation by the user of the transporting roller pair 56, as well as the manual output of an error processing completion signal) has been performed in the next step 470 based on the error display, the routine returns to step 462 and a signal indicating that the finisher section is capable of processing is output.

When the signal indicating that the finisher section is capable of processing is output in step 462, the operation of the device is begun (or restarted) on condition that each of the other sections is capable of processing.

After the device has begun operating (or been restarted), a determination is made, in step 474, as to whether or not the operating switch has changed to OFF. If this determination is affirmative, in step 476, the stop mode when the operating switch changed to OFF is determined.

If it is determined in this step 476 that the stoppage was a complete stop, the routine proceeds to step 478 in which the washing of the rollers is performed. After this, this routine is ended.

If, however, it is determined in step 476 that the stoppage was a temporary stop, the routine proceeds to step 480 where, after the flag F has been set, the routine proceeds to step 482 where the reset of the timer is started and the current routine is ended.

According to the present embodiment according to the finishing solution control system, when the operation of the automatic developing device 10 is stopped, a determination is made by the user as to whether the stoppage is to be in temporary stop mode or in complete stop mode. If the stoppage is in temporary stop mode, it is predicted that the device will be restarted in a comparatively short time (for example within 24 hours), and the rollers are not washed thereby controlling the consumption of dilution water. If the stoppage is in complete stop mode, it is determined that the operation will be stopped for at least one day and the rollers are washed. At this time, because the amount of dilution water used for the washing is restricted by the entering into the calculation of the amount of evaporation that has taken place when the operation is stopped, the washing of the rollers and the supply of dilution water are performed at the same time.

Note that, in temporary stop mode, when the device is restarted after an unforeseen long period of time (more than 24 hours) has passed, the rollers are washed when the device is restarted. Moreover, if this restart is 48 hours or more since the operation was stopped, as well as the rollers being washed, an alarm is output (i.e. a message is displayed on the display section 112 and the transporting system is halted). Therefore, it is possible to encourage the confirmation of the transporting roller pair 56 necessary because the operation was stopped without the rollers being washed.

Note that, in the above described embodiments, the time limits in temporary stop mode (i.e. 24 hours or 48 hours) are just examples, and the time limits may be set in accordance with the environment in which the device is placed. The settings may also be made alterable in accordance with the processing conditions.

Moreover, in the above embodiment, a description was given of when finisher solution was used, however, the present invention can also be applied when other processing solutions that harden with the passage of time are used.

(Processing Device Water Supply Tank)

Figure 19:
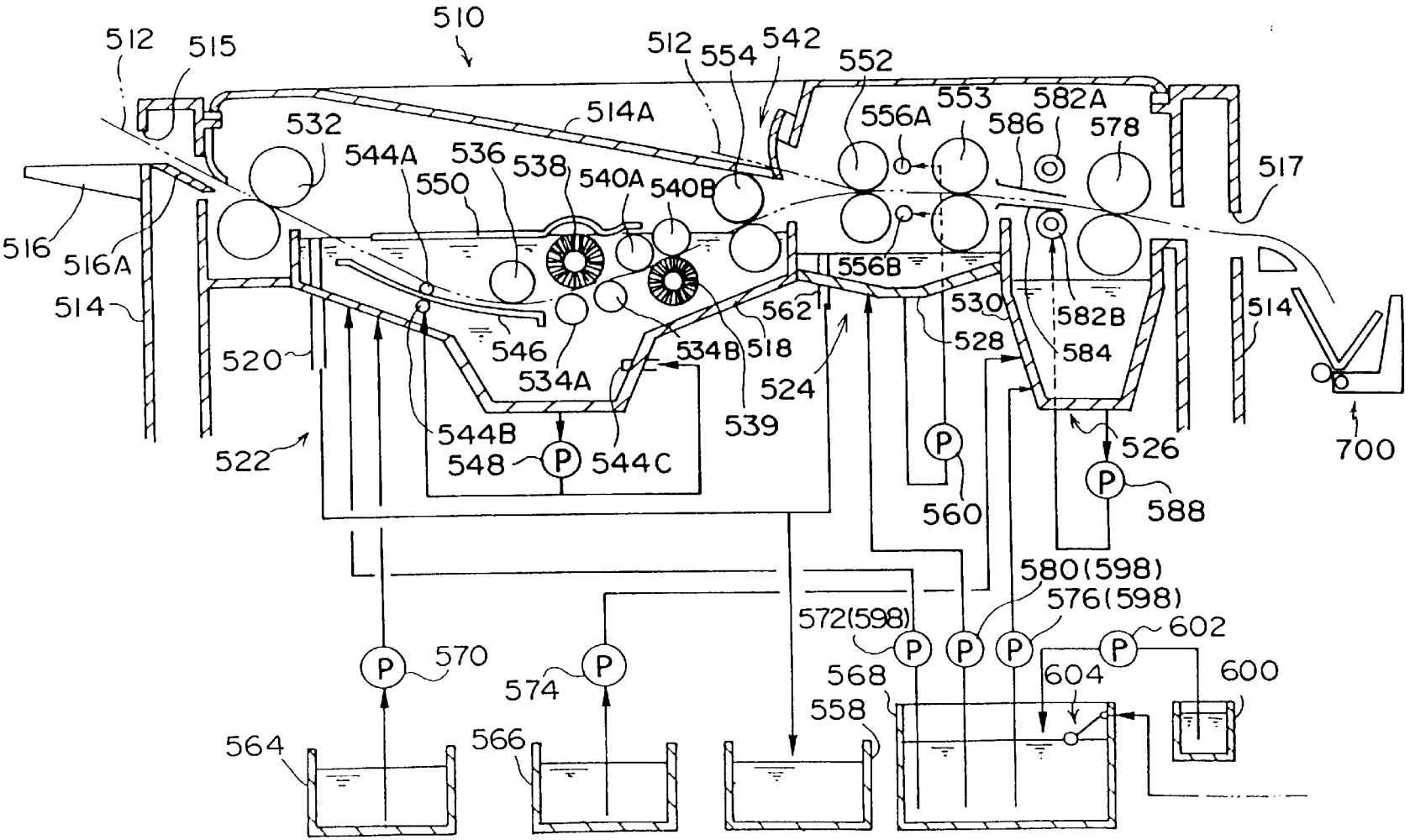
FIG. 19 is a schematic structural view of a PS plate processor used in the present embodiments.

FIG. 19 shows a photosensitive planographic printing plate processing device (referred to below as the PS plate processor 510) used as an example of the photosensitive material processing device according to the present invention. The PS plate processor 510 performs developing processing on a photosensitive material, namely, a photosensitive planographic printing plate (referred to below as the PS plate 512) on which an image has been printed by a printing device (not shown in the drawings).

The PS plate processor 510 is provided with a developing section 522 that is provided with: a developing tank 518 for performing developing processing on the PS plate 512 and an overflow pipe for collecting the developing solution that has overflowed from the developing tank 518: a washing section 524 for performing washing processing on the developing solution that has adhered to the PS plate 512; and a finisher section 526 for performing desensitizing processing on the washed PS plate 512 by coating it with gum solution. Note that the washing section 524 is provided with a washing tank 528, and the finisher section 526 is provided with a gum solution tank 530.

A slit shaped insertion aperture 515 and discharge aperture 517 are both provided in an outer plate panel 514. A loading stand 516 is attached near the insertion aperture 515.

A reentry insertion aperture (i.e. a sub-insertion aperture) 542 for inserting PS plates 512 between the developing section 522 and the washing section 524 is provided in a cover 514A covering the developing section 522 and the washing section 524. This reentry insertion aperture 542 is the insertion aperture for PS plates 512 that undergo processing in the PS plate processor 510 other than the developing processing performed in the developing section 522.

A pair of rubber transporting rollers 532 are provided on the side of the developing section 522 at which the PS plates 512 are inserted into the developing tank 518. After an image has been printed thereon, the PS plate 512 inserted via the insertion aperture 515 is guided to the transporting roller pair 532 by a guide 516A. The pair of transporting rollers 532 feed the PS plate 512 to the developing tank 518 at an angle within a range of 15° to 31° to horizontal.

The developing tank 518 is formed with an open top and with the bottom central portion thereof protruding downwards so as to pool the developing solution for performing the developing processing of the PS plate 512. Inside the developing tank 518 are provided, in order from the upstream side in the transporting direction of the PS plate 512, a guide plate 546, rotating brush rollers 538 and 539, and a roller pair 554. The rotating brush rollers 538 are positioned so as to correspond to the top surface side of the PS plate 512, while the guide plate 546 and the rotating brush rollers 539 are positioned so as to correspond to the bottom surface side of the PS plate 512. Backup rollers 534A and 534B and backup rollers 540A and 540B are provided opposite the rotating brush rollers 538 and 539 respectively.

The guide plate 546 extends from the vicinity of the transporting roller pair 532 to the central portion of the developing tank 538 and the distal end thereof reaches as far as the vicinity of the rotating brush roller 538 and the backup roller 534A. A guide roller 536 is provided above the end portion on the downstream side of the guide plate 546.

A drive force from a driving device (not shown in the drawings) is transmitted to the rotating brush rollers 538 and 539 and to the roller pair 554 so that they are rotated in the transporting direction of the PS plate 512. The guide roller 536 and the backup rollers 534A and 534B and the backup rollers 540A and 540B are feely rotatable and are rotated in response to the transporting of the PS plate 512 and by the rotation action of the rotating brush rollers 538 and 539.

As a result, the PS plate 512 fed into the developing tank 518 is transported while being guided through the developing solution by the guide plate 546 and the guide rollers 536, the rotating brush roller 538 and the backup rollers 534A and 534B, and the rotating brush roller 539 and the backup rollers 540A and 540B.

The developing tank 518 is connected to a circulating pump 548. The circulating pump 548 is connected to discharge apertures 544A and 544B formed in the side walls above and below the guide plate 546 and to a discharge aperture 544C formed in the wall surface on the bottom portion on the downstream side of the developing tank 518. Therefore, developing solution inside the developing tank 518 is pumped up by the operation of the circulating pump 548 and discharged into the developing tank 518 from the discharge apertures 544A, 544B, and 544C, thereby circulating and mixing the developing solution.

Note that surplus developing solution in the developing tank 518 flows through the overflow pipe 520, thereby allowing this developing solution to be discharged to a waste solution tank 558. In addition, a solution surface lid 550 that has been placed so as to float on the surface of the developing solution in the developing tank 518 is raised and lowered in accordance with increases and decreases in the amount of the developing solution so as to minimize the surface area of the developing solution that makes contact with the air. As a result, evaporation of the water component in the developing solution and deterioration of the developing solution caused by carbon dioxide in the air is prevented.

In the washing section 524, two pairs of transporting rollers 552 and 553 are provided above the washing tank 528 for storing washing water. These pairs of transporting rollers 552 and 553 are rotated by a drive force transmitted from a drive device (not shown in the drawings) and nip and transport the PS plate 512 that has been fed from the developing section 522 by the roller pair 554.

A pair of spray pipes 556A and 556B are provided on either side of the transporting path of the PS plate 512 between the pairs of transporting rollers 552 and 553. Discharge apertures (not shown in the drawings) are formed in the spray pipes 556A and 556B facing the transporting path of the PS plate 512. By supplying washing waster which is pumped up from the washing tank 528 by the circulation pump 560, washing water is sprayed onto the PS plate 512 from these discharge apertures and the front and rear surfaces of the PS plate 512 are washed. In addition, after the washing, the washing water is squeezed off from the PS plate 512 by the transporting roller pair 553 and is collected in the washing tank 528.

Note that, an overflow pipe 562 is provided in the washing tank 528. Surplus washing water in the washing tank 528 flows into this overflow pipe 562 and is thereby discharged into the waste solution tank 558.

A pair of transporting rollers 578 are provided above the gum solution tank 530 in the finisher section 526. The PS plate 512 that has been fed out by the transporting roller pair 553 is transported through the finisher section 526 by the transporting roller pair 578 and is discharged via the discharge aperture 517. Note that guide plates 584 and 586 are provided downstream of the transporting roller pair 553, and the PS plate 512 is guided to the transporting roller pair 578 by the guide plates 584 and 586.

A pair of spray pipes 582A and 582B are provided upstream from the transporting roller pair 578 on either side of the transporting path of the PS plate 512. When gum solution in the gum solution tank 530 that has been pumped up by the circulation pump 588 is supplied thereto, the spray pipes 582A and 582B spray this gum solution at the PS plate 512, thereby coating the front and rear surfaces of the PS plate 512. Moreover, surplus gum solution is squeezed off the PS plate 512 on which the gum solution has been coated when the PS plate 512 is gripped by the transporting roller pair 578 thereby forming a thin film of gum solution which functions as a protective layer.

A water supply tank 568 is provided in the PS plate processor 510 in addition to the gum stock solution tank 566 for storing stock solution for the gum replenishing solution and the developing stock solution tank 564 for storing stock solution for the developing replenishing solution.

Stock solution for the developing replenishing solution is supplied from the developing stock solution tank 564 to the developing tank 518 by the operation of the replenishing pump 570, and water for diluting this developing replenishing solution stock solution to a predetermined ratio is supplied from the water supply tank 568 by the operation of the water supply pump 572. As a result, the developing tank 518 is replenished with developing replenishing solution.

Stock solution for the gum solution is supplied from the gum stock solution tank 566 to the gum solution tank 530 by the operation of the replenishing pump 574, and water for diluting this gum solution to a predetermined ratio is supplied from the water supply tank 568 by the operation of the water supply pump 576. As a result, the gum solution tank 530 is replenished with gum solution.

Water used as washing water is supplied from the water supply tank 568 to the washing tank 528 by the operation of the supply pump 580.

A ball valve 604 is provided in the water supply tank 568. Unillustrated piping for tap water is connected to the ball valve 604. As a result, when the surface of the liquid is lowered by water from the water supply tank being pumped out by the operation of the water supply pumps 572, 576, and 580, tap water is supplied to the water supply tank 568, thereby keeping the amount of water in the water supply tank at a predetermined constant level.

Figure 20:
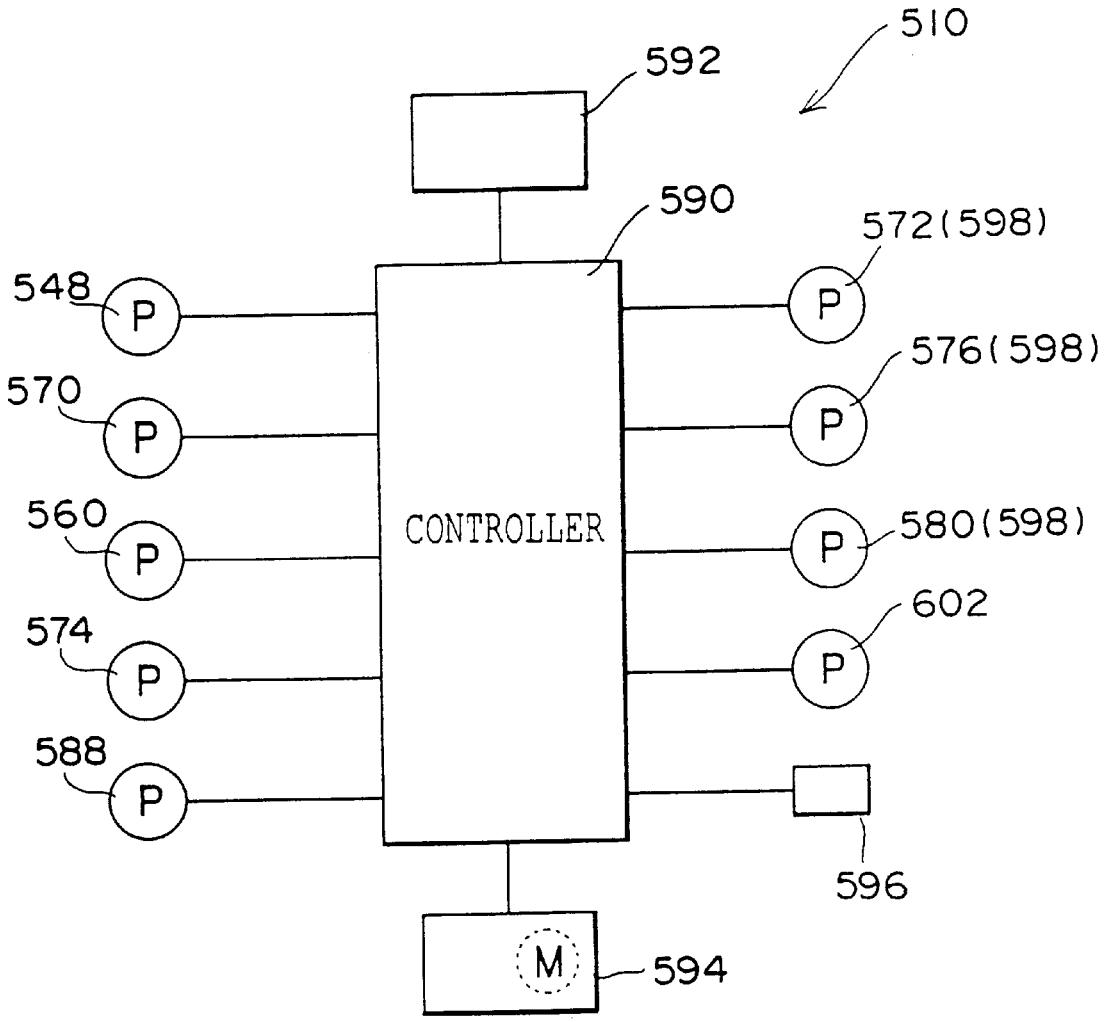
FIG. 20 is a schematic structural view of the control section of the PPPS plate processor shown in FIG. 19.

As is shown in FIG. 20, the circulation pumps 548, 560, and 588 as well as the replenishing pumps 570 and 574 and the water supply pumps 572, 576, and 580 are connected to a controller 590 for controlling the operation of the PS plate processor 510. In addition, an operating panel 592 for performing operations such as the turning on and off of the PS plate processor 510, a drive section 594 for driving the rollers and the like forming the transporting path of the PS plate 512 such as the transporting roller pair 532, and an insertion sensor 596 (not illustrated in FIG. 19) positioned inside the insertion aperture 515 for detecting the passage of the PS plate 512 are provided in the controller 590.

The controller 590 operates the drive section 594 and the circulation pumps 548, 560, and 588 and the like to match the timing of the insertion of the PS plate 512 detected by the insertion sensor 596. In addition, the controller 590 operates the replenishing pumps 570 and 574 and the water supply pumps 572, 576, and 580 in accordance with the amount of PS plates 512 processed as detected by the insertion sensor 596, and at regular intervals, thereby replenishing the respective tanks with developing replenishing solution, washing water, and gum solution. Note that these controls can use a conventional commonly known structure and a detailed description thereof has been omitted from the present embodiment.

It should also be noted that, as is shown in FIG. 19, a chemical agent tank 600 is provided in the PS processor 510. Anti-mold agent (referred to below as "chemical agent") is stored in this chemical agent tank 600. By adding these chemical agents to water such that the concentration falls within a predetermined range, it is possible to prevent the growth of mold or the like.

The chemical agent in the chemical agent tank 600 is added to the water supply tank 568 by the operation of the chemical agent pump 602.

As is shown in FIG. 20, the chemical agent pump 602 is connected to the controller 590, and the controller 590 adds a predetermined amount of chemical agent to the water supply tank 568 by operating the chemical agent pump 602.

A bellows pump is used for each of the water supply pumps 572, 576, and 580. Consequently, the controller 590 pumps water from the water supply tank 568 by the sequence control of the water supply pumps 572, 576, and 580 and supplies it in the necessary amount to each of the developing tank 518, the washing tank 528, and the gum solution tank 530.

The controller 590 also performs the calculation and addition of the amount of water pumped from the water supply tank 568 based on the number of operations and the length of operation of the water supply pumps 572, 576, and 580. Each time the value of this addition reaches a predetermined amount, the controller 590 operates the chemical agent pump 602 so that chemical agent is added to the water supply tank 568. At this time, the amount of chemical agent added is set so as to correspond to the addition value of the amount of water that has been supplied. As a result, the concentration of the chemical agent in the water stored in the water supply tank 568 is within a predetermined range. Note that, in the present embodiment, as an example, each time the addition value reaches 60 liters, 30 ml of chemical agent are added.

Figure 23:
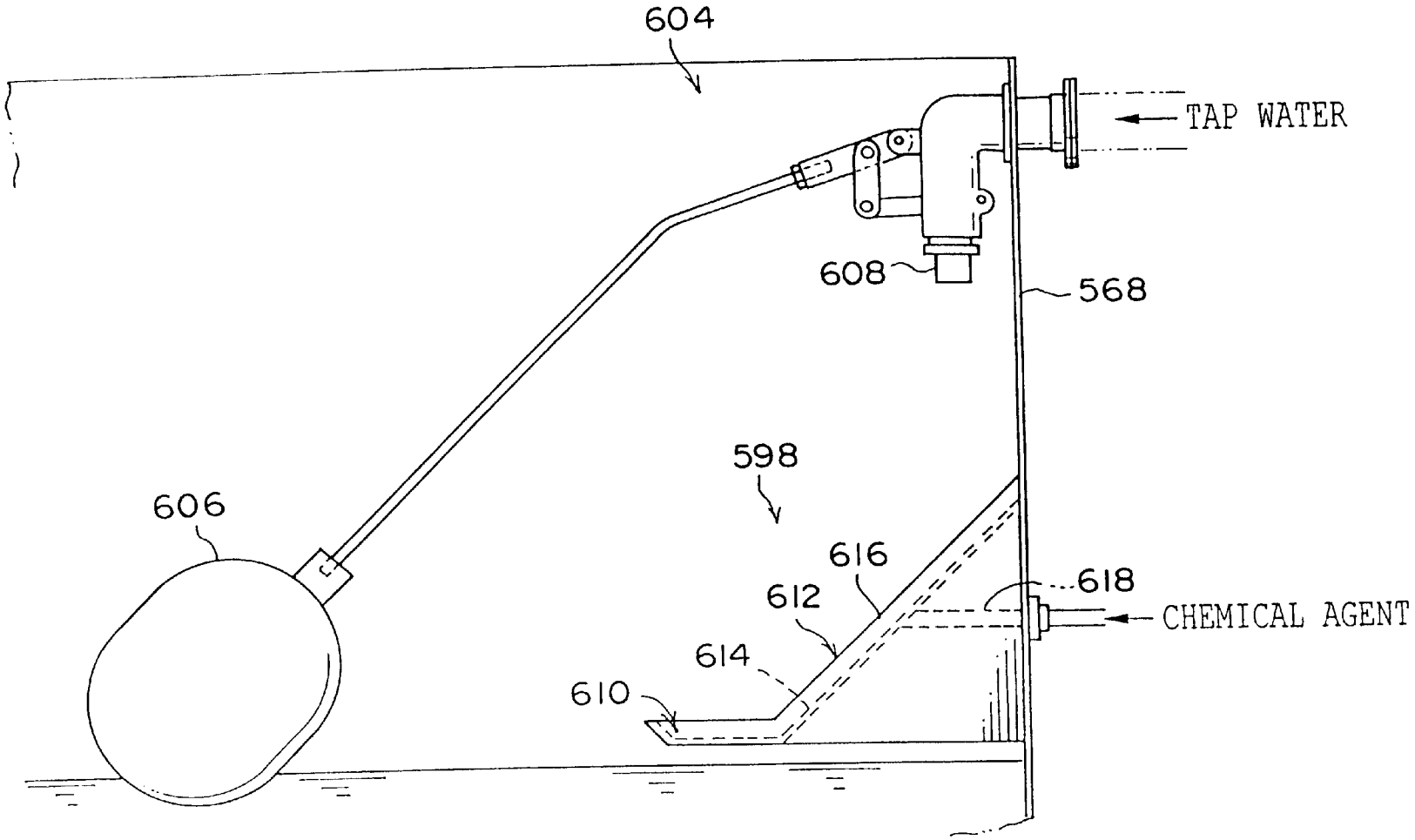
FIG. 23 is a schematic structural diagram showing the main portions of a water supply tank to which the present invention is applied in the PS plate processor according to the embodiment shown in FIG. 19.

Next, as is shown in FIG. 23, the ball valve 604 is closed and opened by the rise and fall of a float 606 brought about by the rise and fall of the surface of the water in the water supply tank 568, thereby supplying water (tap water) from a nozzle 608.

A mixing section 598 for mixing water supplied by the ball valve 604 with chemical agent supplied from the chemical agent tank 600 by the chemical agent pump 602 is provided in the water supply tank 568. The mixing section 598 is formed from a receiving tray 610 and a receiving conduit 612, i.e. a conduit portion.

The receiving tray 610 is positioned below the ball valve 604. When the valve of the ball valve 604 is closed (i.e. when the float 606 is at the top end), the receiving tray 610 is positioned slightly above the surface of the water.

The receiving conduit 612 is connected to the receiving tray 610. The receiving conduit 612 extends upwards on a slant from one end of the receiving tray 610 to the area below the nozzle 608 of the ball valve 604. Note that the angle of the slant of the receiving conduit 612 can be set within a range of between 10° to 80° to horizontal, however, it is preferable if the slant is a gentle one (for example, between 10° and 45°).

Figure 24:
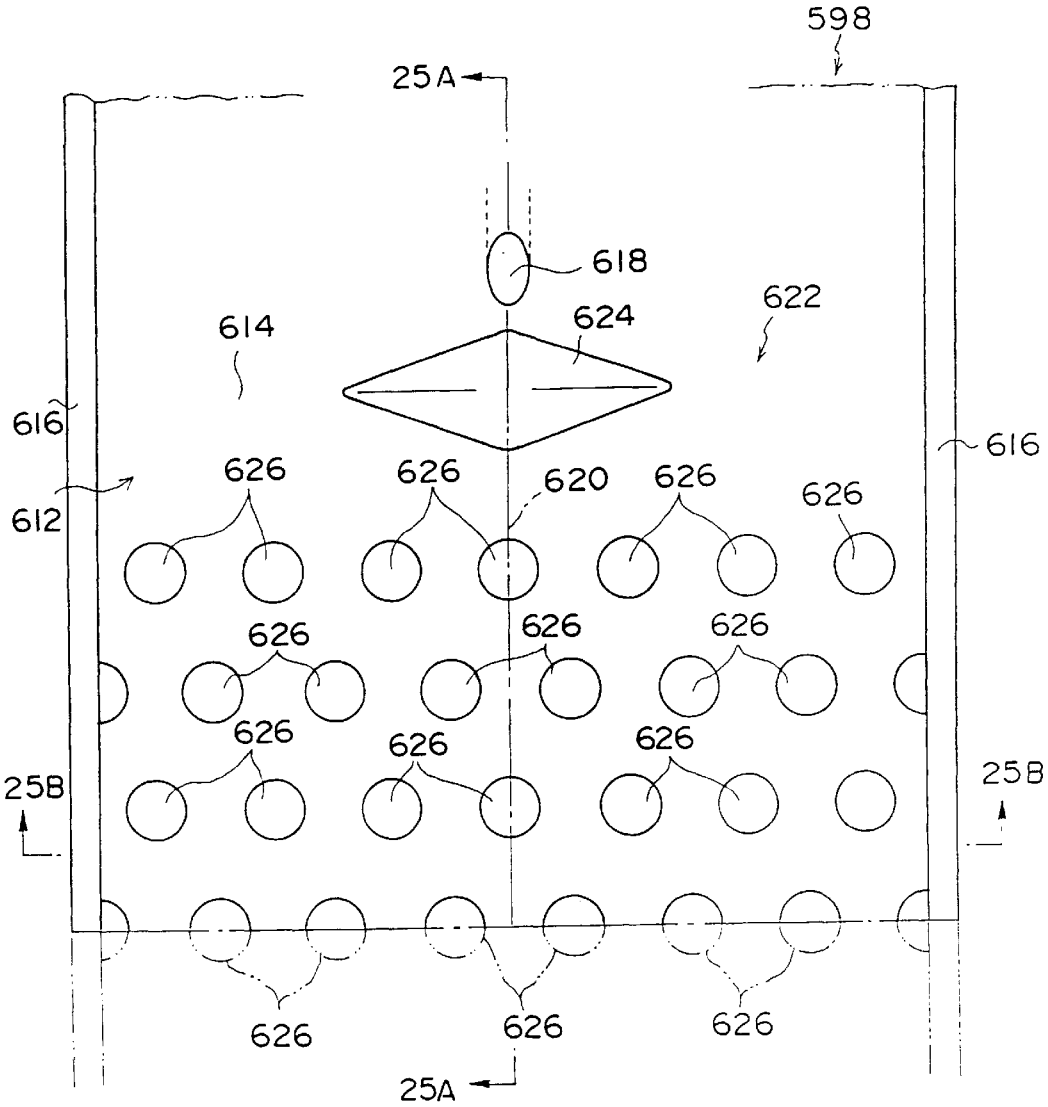
FIG. 24 is a schematic plan view showing the main portions of a receiving trough.
Figure 25A:
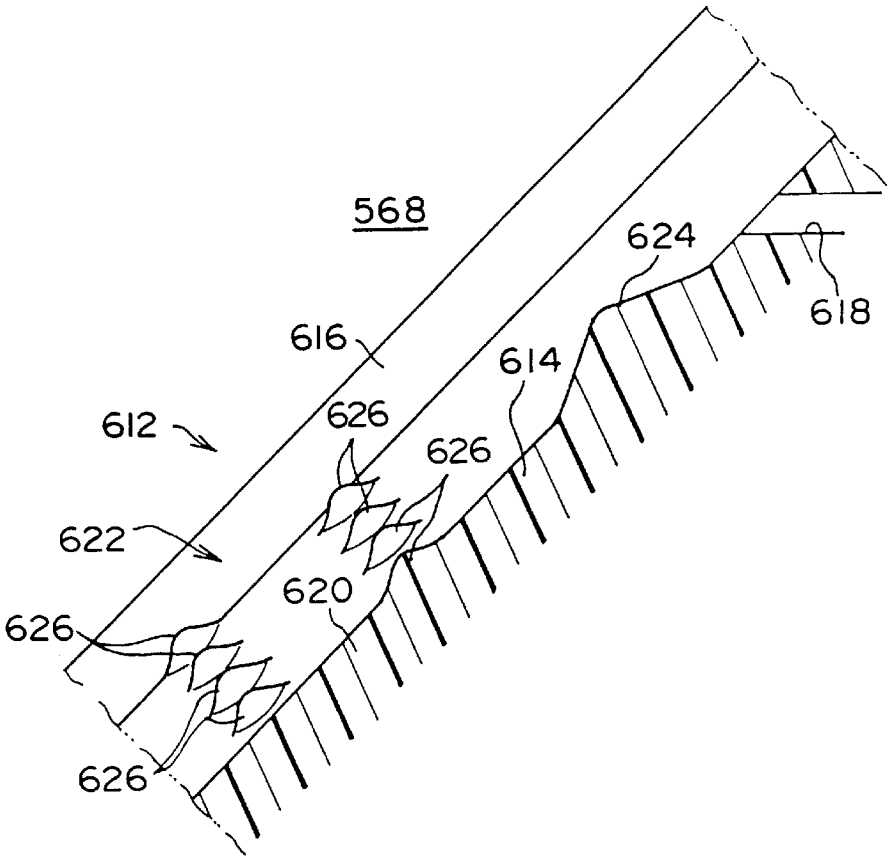
FIG. 25A is a cross-sectional view of the main portions of the receiving trough along the line 25A—25A shown in FIG. 24.

As is shown in FIGS. 23, 24, 25A, and 25B, vertical walls 616 are provided on both sides in the transverse direction of the bottom plate 614 of the receiving conduit 612 (i.e. at the left and right sides of the sheet of paper on which FIGS. 24 and 25A are shown). Water flowing out from the nozzle 608 onto the bottom plate 614 runs towards the receiving plate 610 between the vertical walls 616. Moreover, as is shown in FIG. 23, the receiving tray 610 is formed with a shallow bottom so that the water dropping onto the receiving tray 610 can overflow from the sides of the receiving tray 610 into the water supply tank 568.

As is shown in FIGS. 23, 24, and 25A, a pipe 618 opens onto the bottom plate 614 of the receiving conduit 612. This pump 618 is connected to the output side of the chemical agent pump 602 (see FIG. 19).

The position of the opening of the pipe 618 is in the central portion in the transverse direction of the receiving conduit 612 (see FIG. 24) and slightly nearer to the receiving tray 610 than a position directly beneath the nozzle 608 of the ball valve 604 (see FIG. 23).

As a result, chemical agents are discharged onto the receiving conduit 612 when the chemical agent pump 602 is operated. The chemical agent drps down onto the bottom plate 614 of the receiving conduit 612 and is gathered in the receiving tray 610. Note that, in the present embodiment, the amount of chemical agent added each time is set at approximately 30 ml, and this amount of chemical agent is able to be received by the receiving tray 610. Note also that, in the present embodiment, the pipe 618 is positioned substantially horizontally, however, it is also possible to position the pipe 618 on a slant relative to the horizontal such that the opening is at the lower side, such that the chemical agent is guaranteed to be supplied by the chemical agent pump 602 to the receiving conduit 612 and such that the water that has been dropped from the nozzle 608 onto the receiving conduit 612 is prevented from entering into the pipe 618.

Figure 25B:
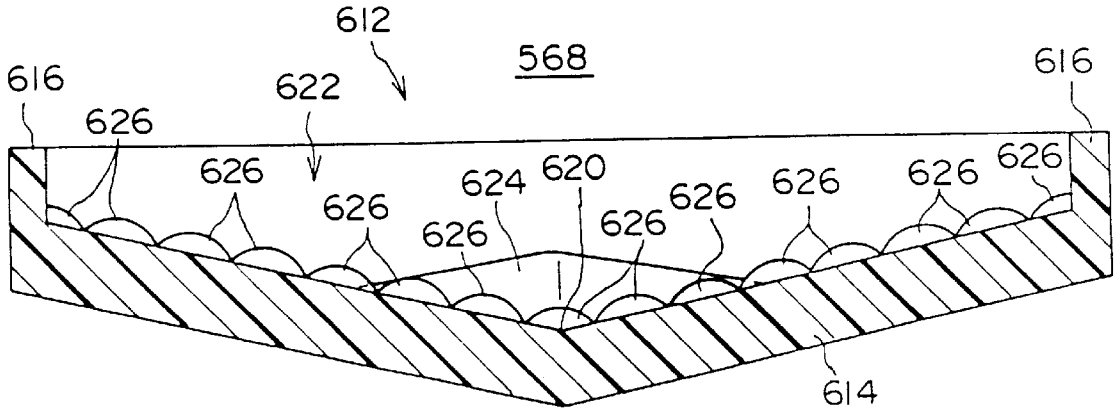
FIG. 25B is a cross-sectional view of the main portions of the receiving trough along the line 25B—25B shown in FIG. 24.

As is shown in FIG. 25B, the bottom plate 614 slants down from the vertical walls 616 such that the central portion in the transverse direction of the bottom plate 614 forms a bottom portion 620. As a result, the water that runs across the top of the bottom plate 614 is prevented from running towards the vertical walls 616. Note that it is also possible to slant the bottom plate 614 such that the central portion in the transverse direction of the bottom plate 614 is raised upwards.

Moreover, as is shown in FIGS. 24 and 25, a dispersing portion 622 is formed in the bottom plate 614 downstream from (i.e. below) the pipe 618. The dispersing portion 622 is formed from a protrusion 624 formed near the opening of the pipe 618 and small protrusions 626 placed in a zigzag pattern across the entire surface of the bottom plate 614 downstream from the from the protrusion 624.

The protrusion 624 protrudes from the bottom plate 614 in the shape of a four-cornered pyramid. Consequently, the chemical agent discharged from the pipe 618 is spread out in the transverse direction of the bottom plate 614.

The small protrusions 626 each protrude from the bottom plate 614 in a substantially semispherical shape. By placing the small protrusions 626 in a zigzag pattern on the bottom plate 614, the chemical agent that has been spread out in the transverse direction of the receiving conduit 612 by the protrusion 624 is dispersed over the bottom plate 614.

The operation of the present embodiment relating to the water supply tank will now be described.

A PS plate 512 on which an image has been printed by a printing device (not shown in the drawings) is placed on the insertion stand 516. It is then fed towards the inner side of the insertion stand 516 so as to reach the insertion aperture 515. It is then inserted inside the PS plate processor 510 via this insertion aperture 515. When the PS plate 512 is detected by the insertion sensor 596, the transporting rollers 532 and the like are driven so that the inserted PS plate 512 is caught by the transporting roller pair 532 and is fed to the developing section 522. Note that, when the leading edge of the PS plate 512 passes through the insertion aperture 515, this is detected by the sensor 608 and the timer is started. This timer measures the timing of the spraying of washing water from the spray pipes 556A and 556B in the washing section 524, and the timing of the supply of gum solution to the spray pipes 582A and 582B.

The PS plate 512 inserted into the developing tank 518 is guided by the guide plate 546 so as to be transported at an angle in a range between 15° to 31° to horizontal while being immersed in the developing solution. The PS plate 512 is guided while the direction thereof is corrected towards a position between the downstream end portions of the guide rollers 536 and the guide plate 546. Thereafter, the PS plate 512 is fed by the guide roller 536 and the guide plate 546 between the backup rollers 534A and 534B and the rotating brush roller 538.

Once the PS plate 512 has been inserted between the backup rollers 534A and 534B and the rotating brush roller 538, development is accelerated by the front surface of the plate being rubbed by the rotating brush roller 538. The PS plate 512 is then sent between the backup rollers 540A and 540B and the rotating brush roller 539, and the rear surface of the PS plate 512 is rubbed by the rotating brush roller 539 so that, when a photosensitive layer is provided on the rear surface of the PS plate 512, the development of the rear surface is accelerated and the unnecessary photosensitive layer is removed efficiently.

Once the PS plate 512 has been rubbed uniformly on both front and rear surfaces thereof and the developing processing has ended, the PS plate 512 is pulled out from the developing tank 518 by the roller pair 554 which also squeezes off the developing solution on the PS plate 512. The PS plate 512 ids then sent to the washing section 524 where it is nipped and transported by the pairs of transporting rollers 552 and 553. At this time, the front and rear surfaces of the PS plate 512 are washed by washing water sprayed from the spray pipes 556A and 556B. When the PS plate 512 is nipped by the transporting roller pair 553, the washing water is squeezed off from the surface thereof.

When PS plate 512 has finished the washing processing, it is sent to the finisher section 526 using the guide plates 584 and 586. In the finisher section 526, the PS plate 512 is guided to the transporting roller pair 578 by the guide plates 584 and 586. At this time, desensitizing processing is performed by spraying gum solution from the spray pipes 582A and 582B so as to coat both front and rear surfaces of the PS plate 512.

When the PS plate 512 which has been coated with the gum solution is nipped by the transporting roller pair 578 and sent to the discharge aperture 517, the surplus gum solution is squeezed off. The PS plate 512 then passes through the discharge aperture 517 and is fed to the drying section (not shown in FIG. 19).

It should be noted that, in the PS plate processor 510, in accordance with the amount of PS plates 512 that have been processed and at regular intervals, the developing tank 518 is replenished with developing replenishing solution, the washing tank 528 is replenished with washing water, and the gum solution tank 530 is replenished with gum solution. At this time, water stored in the water supply tank 568 is pumped by the water supply pumps 572, 576, and 580 and used to dilute the developing replenishing solution stock solution, to dilute the gum solution, and for washing water.

When water is pumped out from the water supply tank 568, water is supplied thereto via the ball valve 604, so that a constant amount of water is always retained in the water supply tank 568. Further, in the PS plate processor 510, the amount of water supplied can be determined, for example, from the amount of water pumped out from the water supply tank 568 by the water supply pumps 572, 576, and 580 and added up to give the amount of water supplied to the water supply tank 568. Each time this addition value reaches a predetermined amount, the chemical agent pump 602 is operated and the chemical agent is added to the water supply tank 568 in an amount corresponding to the amount of water supplied. As a result, the concentration of the chemical agent in the water used in the PS plate processor 510 is kept within a predetermined range.

Figure 21:
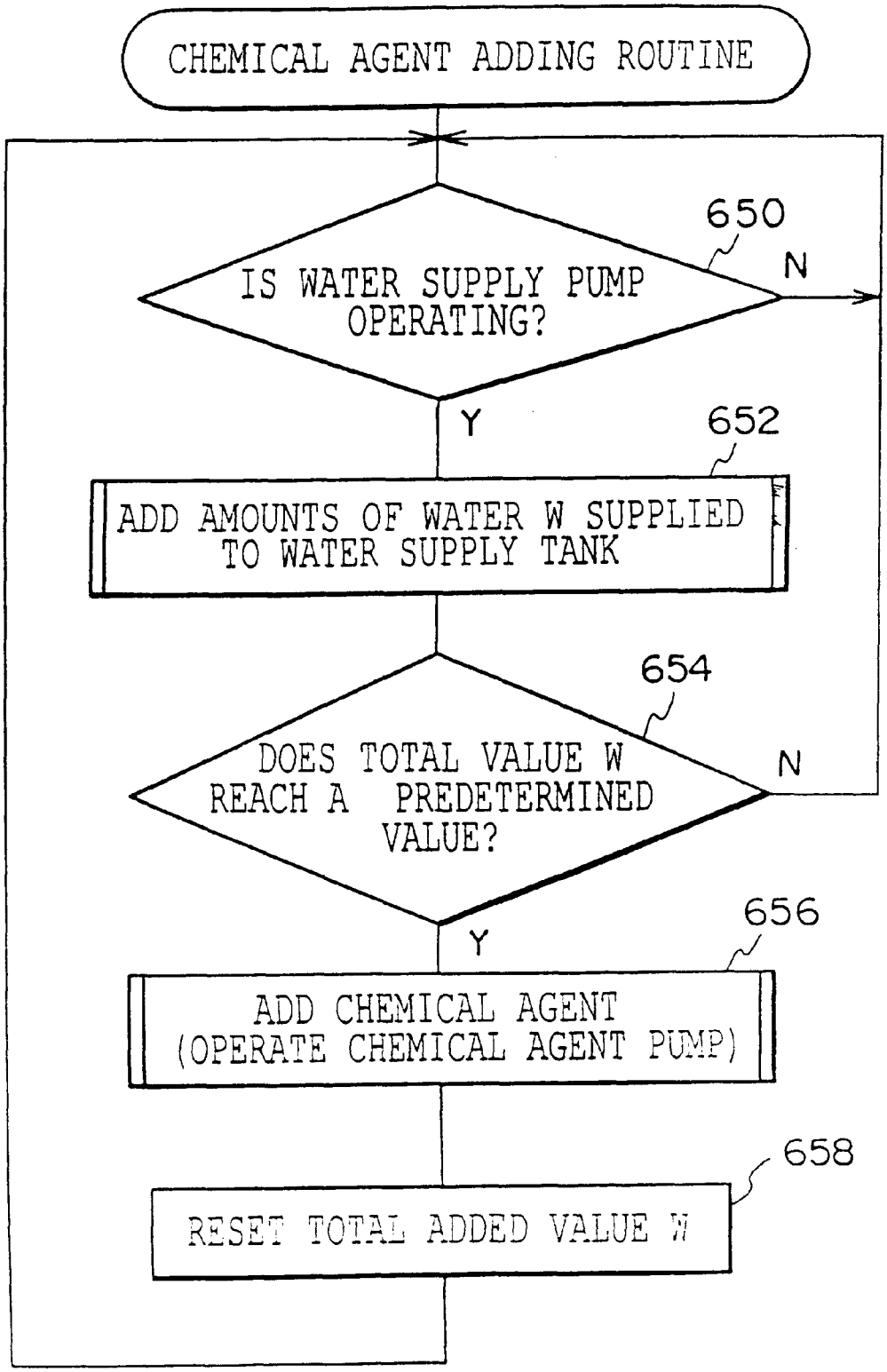
FIG. 21 is a flow chart showing the outline of the chemical adding processing in the PS plate processor shown in FIG. 19.

The flow of the processing for the adding of the chemical agent will now be described with reference to the flow chart in FIG. 21.

Note that, in the PS plate processor 510, when the mother solutions, which are the processing solutions added to the developing tank 518, the washing tank 528, and the gum solution tank 530 when these are empty, are prepared, chemical agent is added in advance by hand or the like to the water for diluting the stock solution of the respective processing solutions. Moreover, when water is supplied to the empty water supply tank 568, chemical agent is added thereto by hand or by operating the chemical agent pump 602 or the like, such that the concentration ρ of the chemical agent in the water supply tank 568 is set at a predetermined concentration ps. The processing of the PS plate 512 in the PS plate processor 510 begins from this state.

The processing to add the chemical agent in the PS plate processor 510 described below is performed when the PS plate processor 510 is started up from the above initial state by the activation of a power switch (not shown in the drawings), and is ended when the PS plate processor 510 is stopped by the deactivation of the power switch. Note that, in the description below, the minimum limit of the concentration ρ for the chemical agent to be able to maintain a predetermined mold preventing capability is taken as ρL.

In the first step of the flow chart, step 650, whether or not any of the water supply pumps 572, 576, and 580 has operated, namely, whether or not water has been pumped out of the water supply tank 568 is confirmed. In the PS plate processor 510, when the replenishing of the developing tank 518 with developing replenishing solution, the supply of washing water to the washing tank 528, and the replenishing of the gum solution tank 530 with gum solution are performed, the water supply pumps 572, 576, and 580 are operated for the length of time dictated by the water supply amount, so that water is pumped from the water supply tank 568, and dilution water for diluting the stock solution of the developing replenishing solution to a predetermined ratio, washing water, and dilution water for diluting the stock solution of the gum solution to a predetermined ratio are supplied to the developing tank 518, the washing tank 528, and the gum solution tank 530.

Here, if any of the water supply pumps 572, 576, and 580 (below, unless a particular specification is made, these will be referred to as the water supply pump 598) are operated in order to perform the replenishing of the developing replenishing solution, the supply of the washing water, or the replenishing of the gum solution, the determination in step 650 is affirmative and the routine proceeds to step 652.

Because chemical agent is contained in a fixed proportion in the water pumped by the water supply pump 598, it is possible to determine the amount of the water only. Therefore, in step 652, the amount of water pumped from the water supply tank is calculated based on the pumping capacity of the water supply pump 598 and the length of time it has been operating, and the amount of water only pumped from the water supply tank by the water supply pump 598 is calculated from the above calculation value giving the calculation value W. Namely, in the water supply tank 568, when water is pumped out and the surface of the water is lowered, the float of the ball valve 604 also lowers causing water to be supplied to the water supply tank 568. The amount of this water that is supplied to the water supply tank is calculated as the calculation value W.

In the next step 654, a determination is made as to whether or not this calculation value W exceeds a predetermined value $W_O$. Note that this predetermined value $W_O$ is a value set on the basis of the amount of water stored in the water supply tank 568, namely, the capacity of the water supply tank, and the lower limit of the concentration range of the chemical agent.

Figure 22:
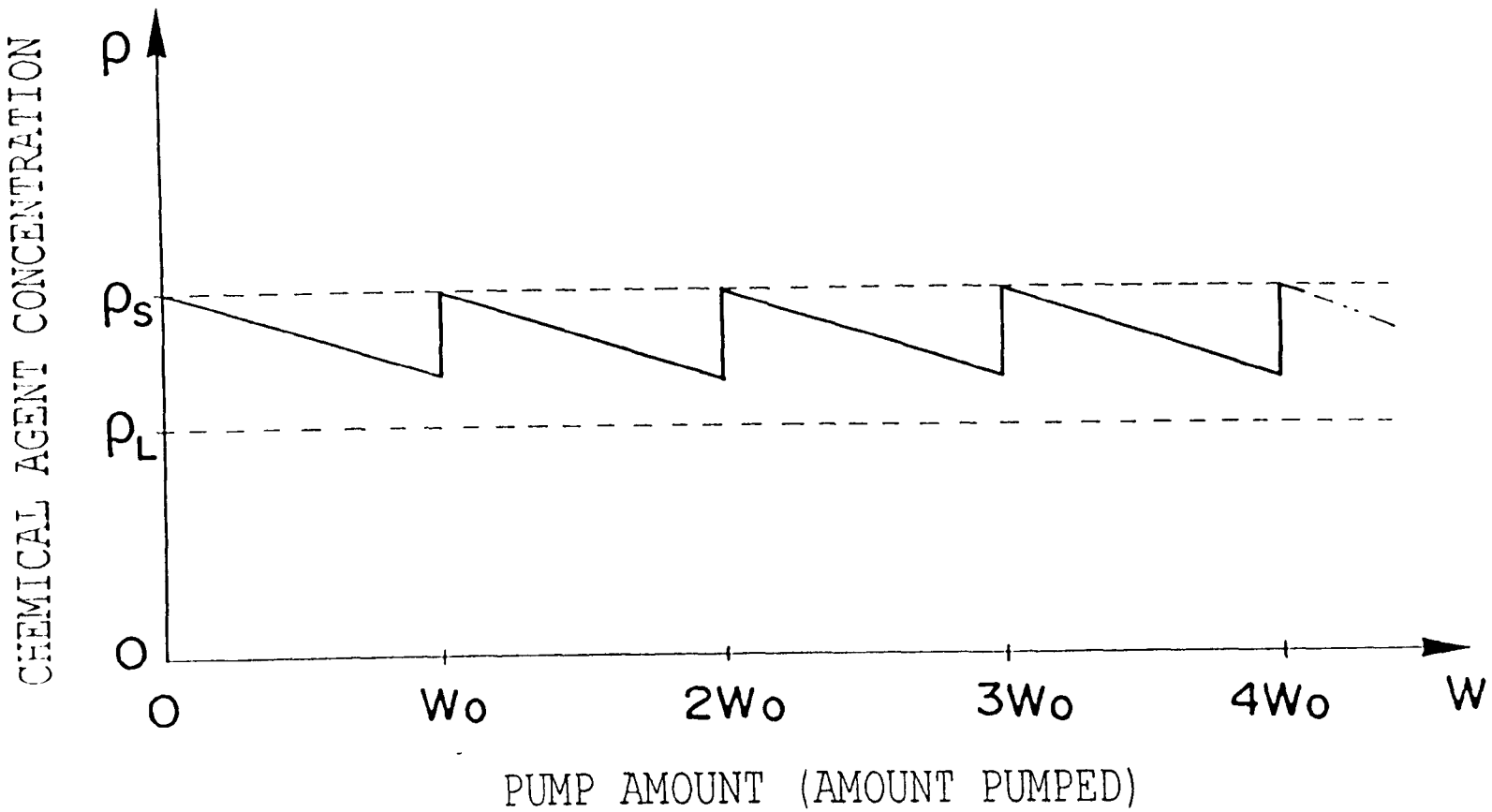
FIG. 22 is a line graph showing the outline of changes in the concentration of the chemical agents relative to the amount of water supplied to the water supply tank.

As is shown in FIG. 22, the concentration ρ of the chemical agent in the water supply tank 568 is gradually reduced as the amount of water increases. Namely, when water is pumped out of the water supply tank 568 and more water is then fed to the water supply tank 568 to replace the pumped out water, the concentration ρ of the chemical agent is gradually lowered. The amount of water supplied before the concentration ρ of the chemical agent at this time reaches the minimum limit concentration $\rho_L$ is set at a predetermined value $W_O$ (for example 10 liters).

In the PS plate processor 510, the calculation value W for the amount of water supplied increases as the PS plates 512 are processed. As a result, when the calculation value W of the amount of water supplied reaches the predetermined value $W_O$ ($W \geqq W_O$), the determination in step 654 is affirmative and the routine proceeds to step 656.

In this step 656, the chemical agent adding pump 602 is operated and a predetermined amount of chemical agent (for example, 30 ml) is added to the water supply tank 568. The amount of chemical agent added at this time is set such that the concentration ρ of the chemical agent becomes a concentration $\rho_S$ when the chemical agent is added to the predetermined value $W_O$ of water. After this, in step 658, the calculation value W of the amount of water supplied is reset (i.e. W=0), and the calculation of the amount of water supplied is started once again. Note that, if the PS plate processor 510 is stopped (i.e. processing ends) without the calculation value W reaching the value $W_O$, the calculation value W is stored and used the next time the PS plate processor is started up.

Namely, in the PS plate processor 510, each time the amount of water supplied to the water supply tank 568 reaches the predetermined value $W_O$, chemical agent in an amount corresponding to this amount of water (i.e. the predetermined value $W_O$) is added to the water supply tank 568.

As a result, as is shown in FIG. 22, the concentration ρ of the chemical agent in the water supply tank 568 gradually decreases until the water supply amount W reaches the predetermined value $W_O$, however, every time the water supply amount W reaches the predetermined value $W_O$, chemical agent is added. Accordingly, the concentration ρ of the chemical agent in the water supply tank 568 is restored to the predetermined concentration $\rho_s$. Moreover, because the predetermined value $W_O$ is an amount set so that the concentration ρ of the chemical agent in the water supply tank 568 does not reach the minimum limit concentration $\rho_L$, the water supply tank 568 is kept in a state where a suitable concentration of chemical agent is added.

In this way, in the PS plate processor 510, the water used inside the processor is supplied from a single water supply tank 568 and chemical agents are added to the water supply tank 568 in accordance with the amount of water supplied to the water supply tank 568. As a result, it is possible to reliably prevent mold and the like from forming inside the water supply tank 568 and also inside the other tanks for storing water such as the washing tank 528 and the like.

Moreover, because the chemical agent is added in accordance with the amount of water supplied to the water supply tank 568 in the PS plate processor 510, it is possible to prevent the addition of the chemical agent being forgotten by the user. In addition, the chemical agent is not added in an insufficient or excessive amount, and an appropriate amount of the chemical agent can be added efficiently.

Note that the above described embodiment does not limit the structure of the present invention. For example, in the present embodiment, the amount of water to be supplied to the water supply tank 568 is calculated from the amount of water pumped out from the water supply tank 568 by the water supply pump 598, however, it is also possible to provide a water surface sensor in the water supply tank 568 and to supply water to the water supply tank 568 using a pump or the like. In this case, water can be supplied to the water supply tank 568 and the chemical agent added when the level of the surface of the water drops by a predetermined amount $W_O$.

Moreover, in the present embodiment, an example of a PS plate processor 510 for processing PS plates 512 as the photosensitive material was described, however, the present invention may be applied to not only the PS plates 512, but to other printing plates as well as to a photosensitive material processing device for processing other photosensitive materials such as photographic film and printing paper using processing solutions that use water.

Next, in the PS plate processor 510, accost reduction in the water supply mechanism is achieved by using the ball valve 604 for supplying water to the water supply tank 568.

A mixing section 598 formed from a receiving tray 610 and a receiving conduit 612 is provided inside the water supply tank 568. When the chemical agent supply pump 602 is operated, chemical agent is poured onto the receiving conduit 612. The anti-mold agent used as the chemical agent has a comparatively high viscosity, for example, 153.0 CPS (B type viscometer, 250) and tends to be lumpy when it flows down the bottom plate 614, however, the protrusion 624 provided downstream from the pipe 618 spreads the chemical agent out across the transverse direction of the bottom plate 614.

Further, the chemical agent gradually flows towards the receiving tray 610 while being spread out across the entire surface of the bottom plate 614 by the small protrusions 626 formed in a zigzag pattern downstream from the protrusion 624.

On the other hand, in the PS plate processor 510, when the surface of the water is lowered by the operation of one of the water supply pumps 572, 576, and 580, water is supplied. Namely, the opening and closing of the ball valve 604 is performed frequently. In addition, when the valve of the ball valve 604 is opened, water falls onto the receiving conduit 612 from the nozzle 608.

Here, if water falls from the nozzle 608 while chemical agent is flowing down the receiving conduit 612, this water runs from above the opening of the pipe 618 down the bottom plate 614 towards the receiving tray 610. At this time, this water flows into the chemical agent dispersed over the bottom plate 614. As a result, the chemical agent is mixed into the water.

When the water that has mixed up the chemical agent by washing it down reaches the receiving tray 611, it falls into the water supply tank 568 from the edges of the receiving tray 610 after spreading out across the surface thereof. As a result, the chemical agent is also mixed into the water in the water supply tank 568 in a spread out manner.

Because the chemical agent that has been mixed in this way is dispersed, it dissolves in the water in a short time. Moreover, because it falls into the water supply tank 568 in a spread out manner from the edges of the receiving tray 610, the chemical agent is dissolved uniformly in the water in the water supply tank 568.

Accordingly, it is possible to dissolve the chemical agent uniformly in the water in the water supply tank 568 in a short time without using a stirring device such as a circulation pump or stirring fins or the like.

Note that the present embodiment described above does not limit the structure of the present invention. For example, in the present embodiment, by forming small protrusions 626 on the bottom plate 614 of the receiving conduit 612 and thus dispersing the chemical agent, the chemical agent is shaped like small particles and mixed into the water, however, it is also possible to form a plurality of depressions or dents on the surface of the bottom plate 614 in place of the small protrusions 626 and as a result of a small amount of the chemical agent flowing down the bottom plate 614 remaining in the depressions or dents, the chemical agent is dispersed over the bottom plate 614. Thereafter, when the chemical agent in the depressions or dents and the chemical agent on the bottom plate 614 are washed down by water, the chemical agent becomes mixed into this water.

Figure 26A:
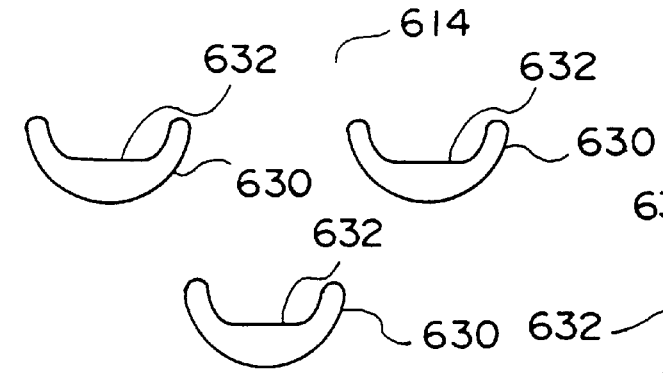
FIGS. 26A and 26B are schematic views showing another example of a dispersion device.
Figure 26B:
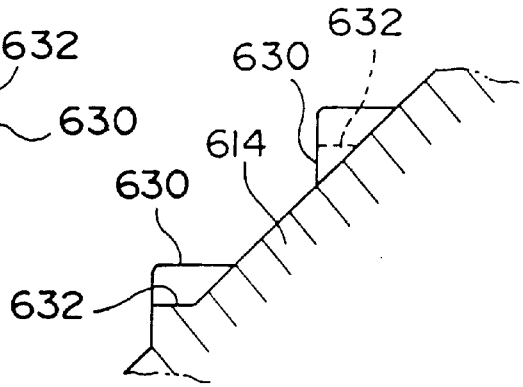

Furthermore, as is shown in FIGS. 26A and 26B, it is possible to provide receiving portions 630 formed in a concave shape as a dispersing apparatus, in place of the small protrusions 626.

These receiving portions 630 are formed on the bottom plate 614 as protruding portions having a semi cylindrical shape, and form concave portions 632 for catching the chemical agent flowing down the bottom plate 614. The chemical agent caught in the concave portions 632 is mixed into the water that subsequently flows down the bottom plate 614 when this water flows into the concave portions 632 and washes out the chemical agent therein. As a result, the chemical agent can be mixed into the water so that it can be easily dissolved therein.

Further, in the present embodiment, the mixing section 598 is formed by connecting a rectilinear receiving conduit 612 to the receiving tray 610, however, the receiving conduit is not limited to having a rectilinear shape and may be formed having a spiral shape or the like, thereby lengthening the distance over which flow the water and the chemical agent and creating a vortex in the falling water. As a result, the chemical agent can be mixed into the water so as to be even more easily dissolved therein.

Moreover, in the present embodiment, water is supplied to the water supply tank 568 using the ball valve 604, however, it is also possible, for example, to use an electrode to detect whether or not the water pumped out from the water supply tank 568 has reached a predetermined amount, and open the valve or supply water via a pump on the basis of the results of the detection by the electrode. In this case, chemical agent may be added to match the water supplied to the water supply tank 568.

When the above structure is used, firstly, a small amount of water is supplied to the receiving conduit 612 and, after water has been introduced to the surface of the bottom plate 614, the chemical agent is added. Water may then be supplied in an amount designed to bring the amount of water in the water supply tank 568 up to a predetermined amount. As a result, the dispersion of the chemical agent over the bottom plate 614 can be accelerated, and the chemical agent can be uniformly mixed into the water.

Moreover, in the present embodiment, an example of a PS plate processor 510 for processing PS plates 512 as the photosensitive material was described, however, the present invention may be applied to not only the PS plates 512, but to other printing plates as well as to a photosensitive material processing device for processing other photosensitive materials such as photographic film and printing paper using processing solutions that use water.

(Stacking Apparatus)

Figure 27:
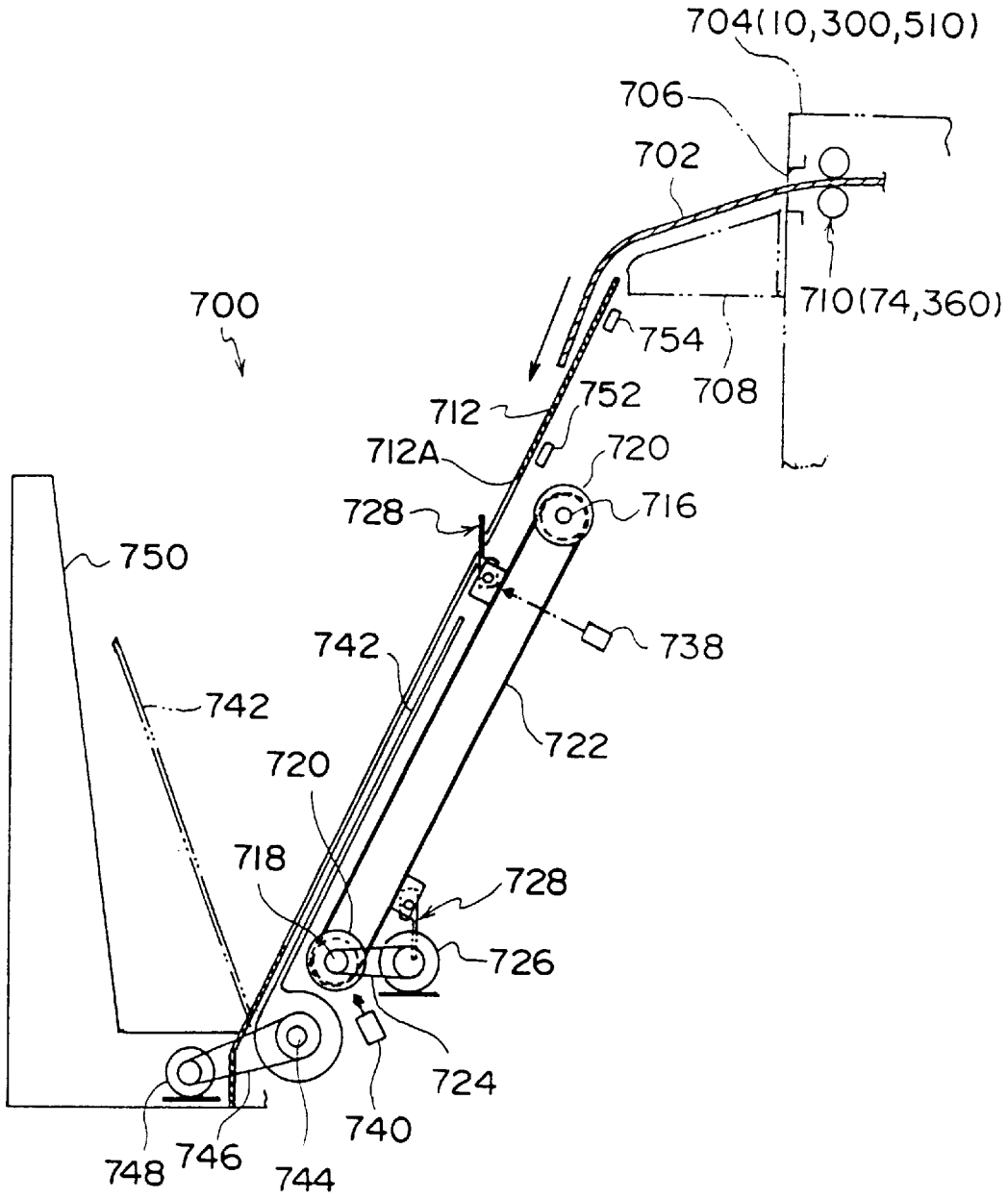
FIG. 27 is a perspective view (a partial perspective view) of a stacking device (stacker) according to the embodiments.
Figure 28:
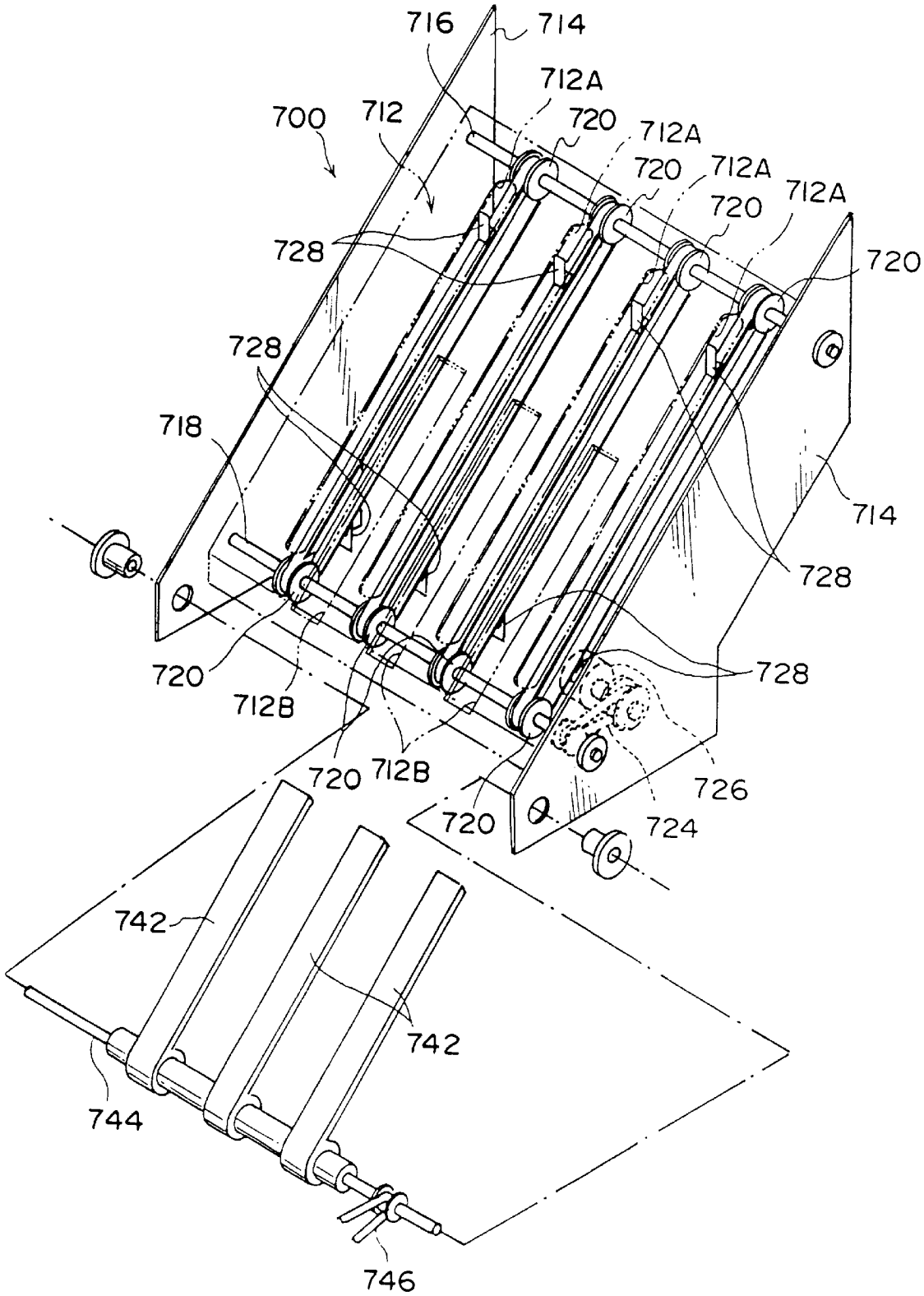
FIG. 28 is a perspective view of a stacker according to the embodiments.

FIGS. 27 and 28 show a stacking apparatus (stacker) 700 according to the present embodiment. As is shown in FIG. 27, the stacker 700 is provided, via a spacer 708, at the discharge aperture 706 of the processing device 710 for a photosensitive material 702 (for example, a photosensitive planographic printing plate (referred to below as a printing plate)). Because the stacker 700 is designed for general purpose use, there is no need to specify the processing device 710, however, examples of the processing device 710 include the automatic processing device 10 (FIG. 1), the automatic processing device 210 (FIG. 10), the automatic processing device 300 (FIG. 11), the PS plate processor 510 (FIG. 19), and a postexposure device. As an example, a transporting roller pair 710 is provided at the discharge aperture 706. These transporting rollers may also be the transporting rollers 74 or 360. The printing plate 712 is discharged while being nipped by the transporting rollers 710.

When seen from the side, the stacker 700 is formed substantially in a V shape comprising a pair of inclined faces (FIG. 27).

The inclined face on the side of the spacer 708 is taken as the slope 712. This face serves as a guide face for printing plates 702 that are discharged from the discharge aperture 706 and slide down the slope 712. Note that the slope 712 is held suspended between a pair of side plates 714 that are parallel to each other (see FIG. 28). A plurality of rollers (not shown in the drawings) are also provided on the slope 712 for easing the resistance when the printing plate 702 is sliding against the slope 712. As a result, after the printing plate 702 has become separated from the transporting rollers 710 of the discharge aperture 706, the printing plate 702 slides down almost at freefall speed.

At the top and bottom ends of the rear surface side of the slope 712 are provided respectively a rotating shaft 716 and a rotating shaft 718. Four pulleys 720 are provided at a distance apart from each other in the transverse direction of the slope 712 (i.e. across the width of the transporting direction of the printing plate) on each of the rotating shafts 716 and 718 at the respective positions (i.e. at the top end and at the bottom end). Moreover, an endless belt 722 is entrained between each of those pulleys 720 that face each other in a straight line at the top and bottom ends of the slope 712. Note that a gear and chain structure may be used instead of the pulleys 720 and the endless belt 702.

One end portion of the rotating shaft 718 at the bottom end of the slope 712 is connected to a rotating shaft of a stopper motor 726 via a drive belt 724, thereby enabling the rotating shaft 718 to be rotated by the drive force of the stopper motor 726. When this rotating shaft 718 is rotated, the rotating shaft 716 at the top end of the slope 712 is also rotated at the same time via the belt 722. As a result, all of the four belts 722 are driven simultaneously at a uniform speed of approximately 20 mm/sec.

Figure 29:
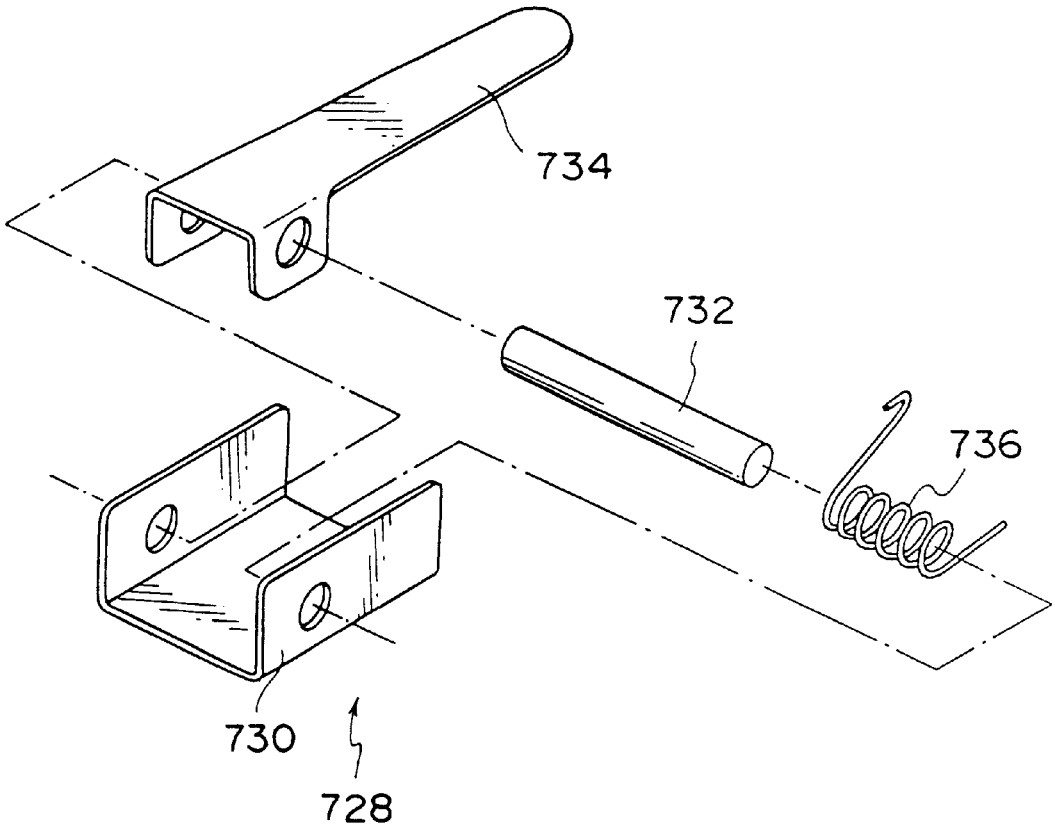
FIG. 29 is an exploded perspective view of a stopper.

Stoppers 728 are attached to the belts 722. As is shown ion FIG. 29, the stoppers 728 are formed from a substantially U shaped base member 730, a receiving plate 734 that is rotatably mounted on the base member 730 via a shaft 732, and a coil spring 736 for urging the receiving plate 734 in a direction whereby it projects outwards from the slope 712.

it is also possible to attach a cushioning material, such as plate shaped rubber, for example, on the side of the receiving plate 734 that receives the printing plate 702 in order to soften the shock with which the leading edge of the printing plate 702 hits the receiving plate 734.

Here, vertically elongated holes 212A (see FIG. 28) extending along the movement track of the stoppers 728 are provided in the slope 712. When the stoppers 728 descend along the slope 712 from a predetermined reference position at the top of the of the slope 712 (the position where the stopper 728 is halted in FIG. 27), the receiving plate 734 of the stoppers move while protruding from the vertically elongated holes 712A. Moreover, those stoppers 728 that are ascending having been reversed by the lower pulleys 720 do not protrude from the slope 712.

Here, stoppers 728 are attached to two positions on each belt 722. The two stoppers 728 have the following relationship with each other. Namely, when one stopper 728 as at a fixed reference position at the top of the slope 712, the other stopper 728 is at a position at the bottom of the slope 712 where it does not protrude from the slope 712. Note that these positions are each able to be detected by position detecting sensors 738 and 740.

Rectangular through holes 712B are provided between each of the vertically elongated holes 712A (see FIG. 28). Pressing plates 742 are able to be housed in each of the rectangular through holes 712B. The base portion of each pressing plate 742 is fixed to a rotating shaft 744. This rotating shaft 744 is provided slightly below the rotating shaft 718 that supports the lower pulleys 720. The rotating shaft of a flipper motor 748 is connected via a belt 746 to one end portion of the rotating shaft 744. By moving the flipper motor in either normal rotation or reverse rotation, the pressing plates 742 can be moved from a state of being contained in the rectangular through holes 712B to a state of protruding therefrom, and back to a state of being contained therein again.

The pressing plates 742 have the task of pressing against a printing plate 702 standing against the slope 712 so as to rotate the printing plate 702 around the bottom end portion thereof, such that the printing plate 702 is transferred to the stacking shelf 750 which is the other sloping surface.

Two printing plate detecting sensors 752 and 754 are provided at the top end of the slope 712. The printing plate detecting sensors 752 and 754 detect signals corresponding to the presence of a printing plate 702 (a high level signal) and the absence of a printing plate 702 (a low level signal). In this case, the printing plate detecting sensor 754 nearest the spacer 708 is used mainly for detecting the rear edge of the printing plate 702 (namely, the fall time when the high level signal switches to a low level signal). The printing plate detecting sensor 752 positioned below the printing plate detecting sensor 754 is mainly used to detect the front edge of the printing plate 702 (namely, the rise time when the low level signal switches to a high level signal). Where necessary, the printing plate detecting sensor 752 for detecting the front edge of the printing plate 702 will be referred to below as the front edge detecting sensor 752, while the printing plate detecting sensor 754 for detecting the rear edge of the printing plate 702 will be referred to as the rear edge detecting sensor 754.

The driving of the stopper motor 726 and the flipper motor 748 are controlled by the signals detected by the printing plate detecting sensors 752 and 754 and by the signals detected by position detecting sensors 738 and 740 for detecting the position of the stoppers 728.

The present embodiment will now be described with reference to the time chart in FIG. 30.

Figure 30:
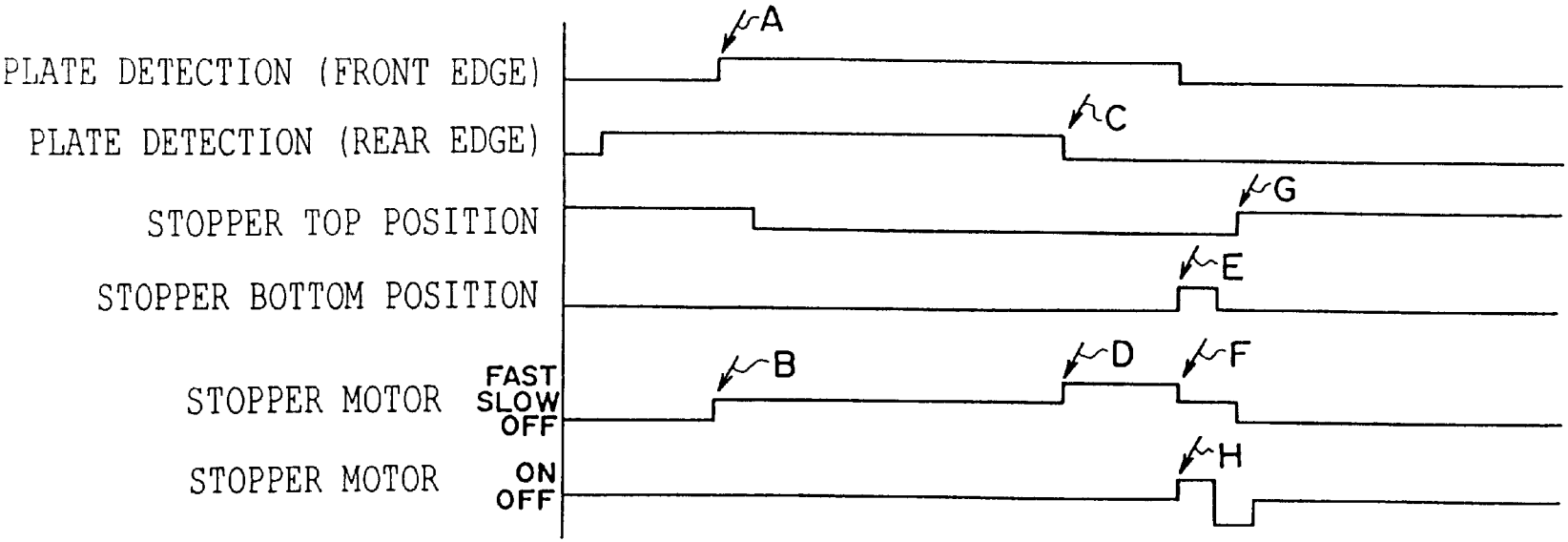
FIG. 30 is a timing chart for describing the flow of the basic operation in the embodiments.

In the initial state, one of the stoppers 728 is in the reference position and the stopper motor 726 and the flipper motor 748 are stopped (FIG. 30).

In this state, when a printing plate 702 is discharged from the discharge aperture 706 of the processing device 704, firstly, the front edge of the printing plate 702 is detected by the front edge detecting sensor 752 (A in FIG. 30). As a result of this detection signal, regardless of the size of the printing plate 702, when the distance between the stoppers 728 and the front edge of the printing plate 702 has reached a predetermined value between 50 mm and 200 mm, the driving of the stopper motor 726 is started (B in FIG. 30). As a result, the stopper 728 begins descending. At this time, the printing plate 702 also descends down the slope 712, however, because the stoppers 728 are descending at substantially the same speed, i.e. 20 mm/sec, as the rotation speed of the transporting rollers 710 while the printing plate 702 is held by the transporting rollers 710 of the discharge aperture 706, the distance between the stoppers 728 and the front edge of the printing plate 702 is kept substantially the same, thereby keeping the stoppers 728 and the printing plate 702 out of contact with each other.

Here, when the rear end of the printing plate 702 separates from the transporting rollers 710, the printing plate 702 slides down the slope 712 at a speed close to freefall speed. The printing plate 702 is then caught by the stopper 728. In this case, because the distance between the front edge of the printing plate 702 when it begins to slide down the slope 712 and the stopper 728 is short, i.e. 50 mm to 200 mm, the force of the shock received by the printing plate 702 when it is caught by the stopper 728 is extremely moderate and there is no deformation or the like by the printing plate 702.

When the printing plate 702 has slid partway down the slope 712, the rear edge detecting sensor 754 detects the rear edge of the printing plate 702 (C in FIG. 30). As a result of this detection, the speed of the stopper motor 726 is increased (D in FIG. 30). Namely, the rear edge of the printing plate 702 separates from the transporting rollers 710 and the printing plate 702 slides down the slope 712. At substantially the same time as the front edge of the printing plate 701 is caught by the stopper 728, the speed of descent of the stopper 728, which until that point had been 20 mm/sec, is increased to a predetermined speed of between 200 mm/sec to 700 mm/sec., enabling a rapid descent. In particular, in the case of a small sized printing plate 702, because the rear edge is detected comparatively early, a sizable distance remains for the stopper to descend to the bottommost end of the slope 712. In this case, by causing the stopper 728 to descend rapidly, the preparation for the next printing plate 702 (i.e. moving the stopper 728 downwards to match the downwards movement on the slope 712 of the front edge of the next printing plate 702) can be rapidly performed.

Note that, instead of detecting the rear edge of the printing plate 702 using the rear edge detecting sensor 754 when the printing plate 712 has slid partway down the slope 712, it is also possible to ascertain the timing for increasing the speed of the stopper motor 726 from the signal indicating the detection by the front edge detecting sensor 752 of the front edge of the printing plate 702 and data on the length of the printing plate 702 in the transporting direction.

When the stoppers 728 reach the bottom of the slope 712, they are reversed by the pulleys 720. As a result, they change from a state of protruding from the slope 712 to a state of not protruding from the slope 712. At this moment, the printing plate 702 drops to the bottommost position on the slope 712. However, because the distance of this drop is extremely short, the force of the shock received by the printing plate 702 is small enough so as to pose no problem.

When it is detected by the position detection sensor 740 that the stopper 728 has reached the bottom end position (E in FIG. 30), the acceleration of the stopper motor 726 is terminated and it returns to normal speed (F in FIG. 30). When this movement is continued, the other stopper 728 arrives at the initial position. When it is detected by the position detection sensor 738 that the stopper 728 has returned to the initial position (G in FIG. 30), the driving of the stopper motor 726 is stopped. The device then remains in a state of waiting for the next printing plate 702.

Note that, the driving (normal and reverse rotation for predetermined times) of the flipper motor 748 is started by the detection of the stopper 728 at the bottom end position (E in FIG. 30). As a result, the printing plate 702 is transferred from the slope 712 to the stacking shelf 750.

Figure 31:
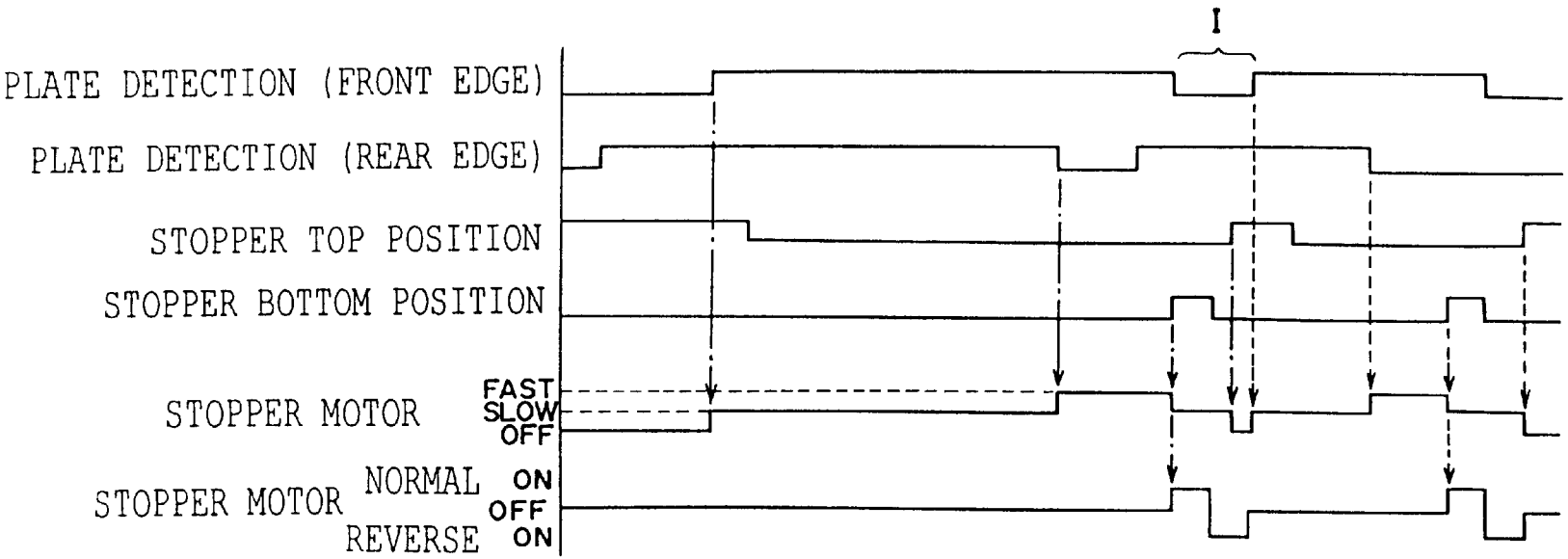
FIG. 31 is a timing chart when two PS plate are discharged consecutively.

The description above is of the basic operation of the stacking device, however, depending on the processing capabilities of the processing device 704, sometimes the printing plates 702 are discharged with practically no interval between them. In cases such as this, if the returning of the stopper 728 is too late, it is possible that the printing plate 702 might not be able to be caught by the stopper 728. However, in the present embodiment, because two stoppers 728 are provided for each belt 722, there is no such lateness and it is possible to deal with the next printing plate 702 reliably. FIG. 31 is a timing chart when a large sized printing plate 702 and a small sized printing plate 702 are discharged in succession. As is shown in this timing chart, even if the interval between the two printing plates 702 is short (I in FIG. 31), there is no delay and it is possible to position a stopper 728 in a predetermined position with reliability.

Moreover, because the stoppers 728 are provided at intervals transversely across the transporting direction of the printing plate 702, if, for example, a printing plate 702 is discharged diagonally from the discharge aperture 706, the corner portion thereof does not strike directly against the stoppers 728 and becomes positioned in the space between a stopper 728 and a stopper 728. Therefore, the corner portion receives practically no stock, and it is possible to prevent the corner portions, which are sensitive to shock, from deforming.

According to the present embodiment, stoppers 728 are provided that protrude and move only when descending down the slope 712, and when the printing plate 702 that is discharged from the discharge aperture 706 of the processing device 704 separates from the transporting rollers 710 and slides down the slope 712, it is possible for the stopper 728 to catch the printing plate 702 in a comparatively short distance. Therefore, it is possible to prevent a large shock being given to the front edge of the printing plate 702 and the printing plate 702 being thereby deformed. Furthermore, because the stoppers 728 are provided spaced at intervals transversely across the transporting direction, even if the printing plate 702 slides diagonally down the slope 712, the corner portions of the printing plate 702 are not caught directly by the stoppers 728 and the corner portions, which are sensitive to shock, can be protected.

Note that, in the present embodiment, two stoppers 728 are attached to the belt 722, however, the present embodiment is not limited to this and it is possible to attach three or more stoppers 728.

Moreover, in the present embodiment, the rear edge detecting sensor 754 is provided between the discharge aperture 706 and the front edge detecting sensor 752, however, it is also possible to place the rear edge detecting sensor 754 along the slope 712 below the front edge detecting sensor 752.

Further, in the present embodiment, the stopper 728 is accelerated after the rear edge of the printing plate 702 has been detected by the rear edge detecting sensor 754 and until the front edge of the printing plate 702 caught by the stopper 728 reaches the bottommost end of the slope 712. However, the present embodiment is not limited to this, and it is possible to move the stopper 728 downwards at high speed for a predetermined time in accordance with a signal from the front edge detecting sensor 752, and to decelerate the stopper 728 directly before the front edge of the printing plate 702 reaches the bottommost end of the slope 712. The degree of the deceleration is such that there is no deformation of the printing plate 702 when the front edge of the printing plate 702 hits the bottommost end of the slope 712.

Moreover, in place of the detection of the rear edge of the printing plate 702 by the rear edge detecting sensor 754, it is also possible to increase the speed of the descent of the stopper 728 using a signal from the detection of the rear edge of the printing plate 702 from an insertion sensor provided at the insertion aperture of the processing device 704.

Furthermore, in the present embodiment, an example is described in which a photosensitive planographic printing plate is used as the photosensitive material, however, another photosensitive planographic printing plate (for example, a photopolymer plate or a thermal plate) may be used. Moreover, another photosensitive material such as a silver salt photographic film or printing paper may be used.

What is claimed is:

1. A photosensitive material processing device for processing a photosensitive material inserted via a transit passage provided upstream in a transporting direction of the photosensitive material using processing solutions stored in processing tanks, and discharging the photosensitive material via a transit aperture provided downstream in the transporting direction, comprising:

blades provided above and below the transit passage and forming an aperture between tips of both blades protruding into the transit passage through which the photosensitive material is able to pass;

a shutter section supported by a supporting shaft and formed in a cylindrical shape in an area facing the aperture; and a moving mechanism for moving a cylindrically shaped outer peripheral portion of the shutter section between a position of blocking the aperture portion and a position of opening the aperture portion.

2. The photosensitive material processing device according to claim 1, wherein the shutter section is provided with the supporting shaft provided at a position adjacent to the transporting path of the photosensitive material that passes through the aperture and a blocking portion formed substantially in a semicircular cylindrical shape and supported at the supporting shaft by substantially fan shaped leg portions that are formed so that both end portions thereof extend out from the supporting shaft, and is provided with a guide roller provided between the leg portions so as to rotate freely on the supporting shaft so as to guide the photosensitive material passing through the aperture when the shutter section is at a position of opening the aperture.

3. The photosensitive material processing device according to claim 1, wherein the shutter section is a guide roller provided so as to rotate freely on the supporting shaft and serving as a guide device for guiding the photosensitive material passing through the aperture in a predetermined direction, and the moving mechanism moves the guide roller between a position of blocking the aperture and a guide position adjacent to a transporting route of the photosensitive material.

4. The photosensitive material processing device according to claim 1, wherein the moving mechanism is provided with a drive section for moving the shutter section, and a sensor provided upstream from the transit aperture for detecting the presence of the photosensitive material in order to control an operation of the drive section.

5. The photosensitive material processing device according to claim 2, wherein the moving mechanism is provided with a drive section for moving the shutter section, and a sensor provided upstream from the transit aperture for detecting the presence of the photosensitive material in order to control an operation of the drive section.

6. The photosensitive material processing device according to claim 3, wherein the moving mechanism is provided with a drive section for moving the shutter section, and a sensor provided upstream from the transit aperture for detecting the presence of the photosensitive material in order to control an operation of the drive section.

* * * * *